US007259739B2

(12) United States Patent
Yun et al.

(10) Patent No.: US 7,259,739 B2
(45) Date of Patent: Aug. 21, 2007

(54) METHOD AND APPARATUS FOR DRIVING LIQUID CRYSTAL DISPLAY

(75) Inventors: Sang Chang Yun, Dong-ku (KR); June Ho Park, Kumi-shi (KR); Jae Woo Lee, Ulsan-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 290 days.

(21) Appl. No.: 10/327,998

(22) Filed: Dec. 26, 2002

(65) Prior Publication Data

US 2003/0197672 A1 Oct. 23, 2003

(30) Foreign Application Priority Data

Apr. 20, 2002 (KR) ..... 2002-21795

(51) Int. Cl.
*G09G 3/36* (2006.01)

(52) U.S. Cl. ..... 345/93; 345/98

(58) Field of Classification Search ..... 345/87, 345/90, 93, 98–100
See application file for complete search history.

(56) References Cited

U.S. PATENT DOCUMENTS 4,890,097 A * 12/1989 Yamashita et al. ..... 345/93
5,119,082 A * 6/1992 Lumelsky et al. ..... 345/600
5,311,205 A * 5/1994 Hamada et al. ..... 345/88
5,946,068 A * 8/1999 Lee et al. ..... 349/143
6,160,535 A * 12/2000 Park ..... 345/88
6,229,513 B1 * 5/2001 Nakano et al. ..... 345/99
6,236,388 B1 * 5/2001 Iida et al. ..... 345/698
6,266,038 B1 * 7/2001 Yoshida et al. ..... 345/92
6,512,505 B1 * 1/2003 Uchino et al. ..... 345/96
6,812,908 B2 * 11/2004 Lim ..... 345/87
7,167,153 B2 * 1/2007 Kimura et al. ..... 345/100
2001/0050678 A1 * 12/2001 Nishikubo et al. ..... 345/204
2002/0109652 A1 * 8/2002 Lim et al. ..... 345/87

* cited by examiner

*Primary Examiner*—Amr A. Awad
*Assistant Examiner*—Tom V. Sheng
(74) *Attorney, Agent, or Firm*—McKenna Long & Aldridge LLP

(57) ABSTRACT

A method and apparatus for driving a liquid crystal display enhances display quality and reduces power consumption. A portion of inputted data may be reproduced and used in the generation of dummy data. A scanning pulse is applied to gate lines of a liquid crystal display panel supporting lines crossing the gate lines. Consecutive ones of thin film transistors within columns of liquid crystal calls may be alternately coupled to adjacent ones of data lines. The inputted data and the dummy data are applied to the data lines in synchrony with the scanning pulse.

28 Claims, 35 Drawing Sheets

FIG.2A
RELATED ART

| | | | | | | | |
|---|---|---|---|---|---|---|---|
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |

ODD FRAME(FRAME INVERSION)

FIG.2B
RELATED ART

| | | | | | | | |
|---|---|---|---|---|---|---|---|
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |

EVEN FRAME(FRAME INVERSION)

FIG.3A
RELATED ART

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

ODD FRAME(LINE INVERSION)

FIG.3B
RELATED ART

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

EVEN FRAME(LINE INVERSION)

FIG.4A
RELATED ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

ODD FRAME(COLUMN INVERSION)

FIG.4B
RELATED ART

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

EVEN FRAME(COLUMN INVERSION)

FIG.5A
RELATED ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

ODD FRAME(DOT INVERSION)

FIG.5B
RELATED ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

EVEN FRAME(DOT INVERSION)

METHOD AND APPARATUS FOR DRIVING LIQUID CRYSTAL DISPLAY

This application claims the benefit of Korean Patent Application No. 2002-21795 filed on Apr. 20, 2002, which is hereby incorporated by reference for all purposes as if fully set forth herein.

BACKGROUND OF THE INVENTION

1. Field of the Invention

The present invention relates to a liquid crystal display, and more particularly to a method and apparatus driving a liquid crystal display capable of enhancing display quality and reducing power consumption.

2. Discussion of the Related Art

Generally, liquid crystal displays LCDs include a liquid crystal display panel having a plurality of liquid crystal cells arranged in a matrix pattern and driving circuit for driving the liquid crystal display panel. To display images, liquid crystal displays control light transmittance characteristics of each liquid crystal cell in accordance with an inputted video signal. Active matrix LCDs include a plurality of thin film transistors (TFTs) arranged within each liquid crystal cell and are capable of displaying moving images having a higher quality than passive matrix LCDs.

Referring to FIG. 1, active matrix LCDs generally include a liquid crystal display panel 2, a data driver 6 for applying a data signal to data lines DL1 to DLm arranged on the liquid crystal display panel, and a gate driver 4 for applying a scanning pulse to gate lines DL1 to DLn also arranged on the liquid crystal display panel 2.

The liquid crystal display panel 2 may include an upper glass substrate separated from a lower glass substrate by a layer of liquid crystal material. The liquid crystal display panel 2 includes m×n liquid crystal cells arranged in a matrix pattern. M data lines DL1 to DLm are arranged to cross n gate lines GL1 to GLn. TFTs are arranged where the data lines cross the gate lines and drive each liquid crystal cell (Clc). The TFTs respond to a scanning pulse by supplying a data signal, applied to the data lines DL1 to DLm, to the liquid crystal cell Clc. Gate electrodes of TFTs within a single horizontal line are connected to one of the gate lines GL1 to GLm. Source electrodes of TFTs within a single vertical line are connected to adjacent ones of the data lines DL1 to DLm. Drain electrodes of TFTs are connected adjacent ones of pixel electrodes of the liquid crystal cells Clc.

A gate driver 4 is controlled by a timing controller (not shown), generates a scanning pulse, and sequentially applies the scanning pulse to the gate lines GL1 to GLn. The gate driver 4 includes a shift register for sequentially generating a scanning pulse and a level shifter for shifting a voltage swing width of the scanning pulse such that it is suitable for driving the liquid crystal cell Clc. In response to the scanning pulse from the gate driver 4, the TFT is turned on. Accordingly, when turned on, the TFT supplies video data, applied to the data lines DL1 to DLn, to the corresponding pixel electrode within the liquid crystal cell Clc.

A data driver 6 samples and latches video data inputted from the timing controller (not shown), converts the latched video data into a pixel data voltage having a predetermined gamma compensating voltage, and applies the pixel data voltage to the data lines DL1 to DLm. The converted latched video data is synchronized with each generated scanning pulse and is applied to the data lines DL1 to DLm for each horizontal line during one horizontal period.

Liquid crystal cells within liquid crystal display panels 2 such as those illustrated in FIG. 1 may be driven using an inversion system. An inversion system inverts a polarity of the voltage of the data signals applied to the data lines both temporally and spatially. Accordingly, the rate at which liquid crystal material deteriorates may be reduced and the picture quality of the liquid crystal display may be improved.

Depending upon the nature in which the voltage of the data signals is inverted, the inversion systems used in LCDs are defined as frame inversion, line inversion, a column inversion, and dot inversion systems.

Referring to FIGS. 2A and 2B, when driven according to the frame inversion system, the polarity of the voltage of the video signals supplied to the liquid crystal cells is inverted every frame. For example, the voltage of the data signals applied to the liquid crystal cells is positive during an odd frame, as shown in FIG. 2A while the voltage of the data signals applied to the liquid crystal cells is negative during an even frame, as shown in FIG. 2B. Driving liquid crystal cells by the frame inversion system, however, is disadvantageous in that a flicker phenomenon is induced due to variations in voltage charged within the liquid crystal cells between frames is large.

Referring to FIGS. 3A and 3B, when driven according to the line inversion system, the polarity of the polarity of the voltage of the video signals supplied to liquid crystal cells connected to a gate line is opposite the polarity of the voltage of the video signals supplied to liquid crystal cells connected to adjacent gate lines. Further, the polarities of the voltages of the video signals applied to the liquid crystal cells are inverted every frame. For example, during odd frames as shown in FIG. 3A, the voltage of the data signals applied to odd numbered gate lines is positive while voltage of the data signals applied to even numbered gate lines is negative. During even frames as shown in FIG. 3B, the voltage of the data signals applied to odd numbered gate lines is negative while voltage of the data signals applied to even numbered gate lines is positive. Driving liquid crystal cells by the line inversion system, however, is disadvantageous in that a flicker phenomenon is induced in horizontal lines due to electrical cross-talk between liquid crystal cells arranged along the gate lines.

Referring to FIGS. 4A and 4B, when driven according to the column inversion system, the polarity of the voltage of the video signals supplied to liquid crystal cells connected to a data line is opposite the polarity of the voltage of the video signals supplied to the liquid crystal cells connected to adjacent data lines. Further, the polarities of the video signals applied to the liquid crystal cells are inverted every frame. For example, during odd frames as shown in FIG. 4A, the voltage of the data signals applied to odd data lines is positive while voltage of the data signals applied to even numbered data lines is negative. During even frames as shown in FIG. 4B, the voltage of the data signals applied to odd numbered data lines is negative while the voltage of the data signals applied to the even numbered data lines is positive. Driving liquid crystal cells by the column inversion system, however, is disadvantageous in that a flicker phenomenon is induced in vertical lines due to electrical cross-talk between liquid crystal cells arranged along the data lines.

Referring to FIGS. 5A and 5B, when driven according to the dot inversion system, the polarity of the voltage of the video signals supplied to a liquid crystal cells is opposite the polarity of the voltage of the video signals supplied to adjacent liquid crystal cells (e.g., liquid crystal cells connected to adjacent gate and data lines). Further, the polarities of the video signals applied to the liquid crystal cells are inverted every frame. For example, during odd frames as shown in FIG. 5A, the voltage of the data signals applied to liquid crystal cells arranged at crossings of odd numbered gate and data lines and liquid crystal cells arranged at crossings of even numbered gate and data lines is positive while the voltage of the data signals applied to liquid crystal cells arranged at crossings of odd numbered data lines and even numbered gate lines and liquid crystal cells arranged at crossings of even numbered data lines and odd numbered gate is negative. During even frames as shown in FIG. 5B, the voltage of the data signals applied to liquid crystal cells arranged at crossings of odd numbered gate and data lines and liquid crystal cells arranged at crossings of even numbered gate and data lines is negative while the voltage of the data signals applied to liquid crystal cells arranged at crossings of odd numbered data lines and even numbered gate lines and liquid crystal cells arranged at crossings of even numbered data lines and odd numbered gate is positive. Driving liquid crystal cells by the dot inversion system offsets any flicker phenomenon that may be induced between vertically or horizontally adjacent liquid crystal cells. Accordingly, pictures generated by the liquid crystal display panel driven using the dot inversion method have superior qualities over pictures generated by liquid crystal display panels driven using other inversion methods.

Use of the dot inversion system, however, is disadvantageous in that the polarity of voltage of the video signals supplied from the data driver to the data lines is inverted in horizontal and vertical directions and individual pixel voltages required by the dot inversion method are typically greater than those required by other inversion methods. Accordingly, liquid crystal displays driven using a dot inversion method typically consume a relatively large amount of power during their operation.

SUMMARY OF THE INVENTION

Accordingly, the present invention is directed to an array substrate for a liquid crystal display device and a method of fabricating the same that substantially obviates one or more of the problems due to limitations and disadvantages of the related art.

Accordingly, an advantage of the present invention provides a method and apparatus for driving a liquid crystal display capable of enhancing a display quality and reducing power consumption.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a method of fabricating a liquid crystal device may, for example, include reproducing an input data to generate a dummy data; applying a scanning pulse to gate lines of a liquid crystal display panel, wherein the gate lines cross data lines of the liquid crystal display panel, and wherein consecutively arranged ones of thin film transistors within any column of thin film transistors provided between adjacent data lines are alternately connected to adjacent data lines; and applying the input data and the dummy data to the data lines in synchrony with the scanning pulse.

In one aspect of the present invention, generating the dummy data may, for example, include detecting the last data of the input data included within a first data interval; generating a first dummy data using the last data; outputting input data included in the first data interval and the first dummy data via an assigned output data bus; detecting the first data of the input data included within a second data interval; generating a second dummy data using the first data; delaying data inputted via a specific input data bus of the input data included within the second data interval; and shifting an output data bus assigned to the input data by one to thereby output the input data within the second data interval, excluding the delayed input data, via the shifted output data bus and simultaneously outputting the delayed input data and the second dummy data via a specific output data bus.

In another aspect of the present invention, the step of generating the dummy data may, for example, include detecting the first data of the input data included within a first data enable interval; generating a first dummy data using the first data; outputting input data included in the first data interval and the first dummy data via an assigned output data bus; detecting the last data of the input data included within a second data interval; generating a second dummy data using the last data; delaying data inputted via a specific input data bus of said input data included within the second data interval; and shifting an output data bus assigned to the input data by one to thereby output input data within the second data interval, excluding the delayed input data, via the shifted output data bus and simultaneously outputting the delayed input data and the second dummy data via a specific output data bus.

In yet another aspect of the present invention, the step of generating the dummy data may, for example, include detecting the last data of the input data included within a first data interval; delaying the last data by one horizontal period to generate a first dummy data; outputting input data included in a second data interval following the first data interval and the first dummy data via an assigned output data bus; detecting the first data of the input data included in a second data interval; delaying the first data by one horizontal period to generate a second dummy data; delaying data inputted via a specific input data bus of said input data included in a third data interval following the second data interval; and shifting an output data bus assigned to the input data by one to thereby output input data within the third data interval, excluding the delayed input data, via the shifted output data bus and simultaneously outputting the delayed input data and the second dummy data via a specific output data bus.

In still another aspect of the present invention, the step of generating the dummy data may, for example, include detecting the first data of the input data included within a first data interval; delaying the first data by one horizontal period to generate a first dummy data; outputting input data included in a second data interval following the first data interval and the first dummy data via an assigned output data bus; detecting the last data of the input data included within a second data interval; delaying the last data by one horizontal period to generate a second dummy data; delaying data inputted via a specific input data bus of the input data included in a third data interval following the second data interval; and shifting an output data bus assigned to the input data by one to thereby output input data within the third data interval, excluding the delayed input data, via the shifted output data bus and simultaneously outputting the delayed input data and the second dummy data via a specific output data bus.

In one aspect of the present invention, the step of applying the data may, for example, include applying the first dummy data to a rightmost one of consecutively arranged data lines within the liquid crystal display panel and simultaneously applying the input data included within the first data interval to other ones of the consecutively arranged data lines, excluding the rightmost data line; and applying the second dummy data to a leftmost one of the consecutively arranged data lines within the liquid crystal display panel and simultaneously applying the input data included within the second data interval to other ones of the consecutively arranged data lines, excluding the leftmost data line.

In another aspect of the present invention, the step of applying the data may, for example, include applying the first dummy data to a leftmost one of consecutively arranged data lines within the liquid crystal display panel and simultaneously applying the input data included within the first data interval to other ones of the consecutively arranged data lines, excluding the leftmost data line; and applying the second dummy data to a rightmost one of the consecutively arranged data lines within the liquid crystal display panel and simultaneously applying the input data included within the second data interval to other ones of the consecutively arranged data lines, excluding the rightmost data line.

In yet another aspect of the present invention, the step of applying the data may, for example, include applying the first dummy data to a leftmost one of consecutively arranged data lines within the liquid crystal display panel and simultaneously applying the input data included within the second data interval to other ones of the consecutively arranged data lines, excluding the leftmost data line; and applying the second dummy data to the rightmost one of consecutively arranged data lines within the liquid crystal display panel and simultaneously applying the input data included within the third data interval to other ones of the consecutively arranged data lines, excluding the rightmost data line.

In still another aspect of the present invention, the step of applying the data may, for example, include applying the first dummy data to the rightmost one of consecutively arranged data lines within the liquid crystal display panel and simultaneously applying the input data included within the second data interval to other ones of the consecutively arranged data lines, excluding the rightmost data line; and applying the second dummy data to the leftmost one of consecutively arranged data lines within the liquid crystal display panel and simultaneously applying the input data included within the third data interval to other ones of the consecutively arranged data lines, excluding the leftmost data line.

According to the principles of the present invention, a driving apparatus of a liquid crystal display may, for example, include a dummy data generator for reproducing an input data to generate a dummy data; a liquid crystal display panel having data lines crossing gate lines; consecutively arranged ones of thin film transistors arranged within any column of thin film transistors provided between adjacent data lines are alternately connected to adjacent data lines; a gate driver for applying a scanning pulse to the gate lines within the liquid crystal display panel; and a data driver for applying the input data and the dummy data to the data lines within the liquid crystal display panel in synchrony with the scanning pulse.

In one aspect of the present invention, the dummy data generator may, for example, output a first dummy data, generated with the aid of the last data of the input data included within a first data interval, along with the input data included within the first data interval via an assigned output data bus; and delay data inputted via a specific input data bus of the input data included within a second data interval to thereby output a second dummy data, generated with the aid of the first data included in the second data interval, and the delayed data via a specific output data bus and shift an output data bus for the input data, excluding the delayed data.

In another aspect of the present invention, the dummy data generator may, for example, output a first dummy data, generated with the aid of the first data of the input data included within a first data interval, along with said input data included within the first data interval via an assigned output data bus; and delay data inputted via a specific input data bus of the input data included within a second data interval to thereby output a second dummy data, generated with the aid of the last data included within the second data interval, and the delayed data via a specific output data bus and shift an output data bus for the input data, excluding the delayed data.

In one aspect of the present invention, the dummy data generator may, for example, include a latch for delaying the input data to generate the first and second dummy data; a register for temporarily storing data outputted from the latch and data inputted via the specific input data bus; a selector for selecting the input data from an input line and data from the register; and a controller for controlling the selector during each horizontal period.

In one aspect of the present invention, the dummy data generator may, for example, output a first dummy data, generated by delaying the last data of the input data included within a first data interval by one horizontal period, along with input data included in a second data interval following the first data interval via an assigned output data bus; and delay data inputted via a specific input data bus of the input data included within a third data interval following the second data interval to thereby output a second dummy data, generated by delaying the first data of the input data included within the second data interval by one horizontal period, and the delayed data via a specific output data bus and shift an output data bus for the input data included within the third data interval, excluding the delayed data.

In another aspect of the present invention, the dummy data generator may, for example, output a first dummy data, generated by delaying the first data of the input data included within a first data interval by one horizontal period, along with input data included in a second data interval following the first data interval via an assigned output data bus; and delay data inputted via a specific input data bus of the input data included in a third data interval following the second data interval to thereby output a second dummy data, generated by delaying the last data of the input data included within the second data interval by one horizontal period, and the delayed data via a specific output data bus and shift an output data bus for the input data included within the third data interval, excluding the delayed data.

In one aspect of the present invention, the dummy data generator may, for example, include a line memory for delaying the input data by one horizontal period to generate the first and second dummy data; a register for temporarily storing data outputted from the line memory and data inputted via the specific input data bus; a selector for selecting the input data from an input line and data from the register; and a controller for controlling the selector during each horizontal period.

In one aspect of the present invention, the data driver may, for example, apply the first dummy data to the rightmost one of consecutively arranged data lines within the liquid crystal display panel and simultaneously apply the input data included within the first data interval to other ones of the consecutively arranged data lines, excluding the rightmost data line; and apply the second dummy data to the leftmost one of the consecutively arranged data lines within the liquid crystal display panel and simultaneously apply the input data included within the second data interval to other ones of the consecutively arranged data lines, excluding the leftmost data line.

In another aspect of the present invention, the data driver may, for example, apply the first dummy data to the leftmost one of consecutively arranged data lines within the liquid crystal display panel and simultaneously apply the input data included within the first data interval to other ones of the consecutively arranged data lines, excluding the leftmost data line; and apply the second dummy data to the rightmost one of the consecutively arranged data lines within the liquid crystal display panel and simultaneously apply the input data included within the second data interval to other ones of the consecutively arranged data lines, excluding the rightmost data line.

In yet another aspect of the present invention, the data driver may, for example, apply the first dummy data to the leftmost one of consecutively arranged data lines within the liquid crystal display panel and simultaneously apply the input data included within the second data interval to other ones of the consecutively arranged data lines, excluding the leftmost data line; and apply the second dummy data to the rightmost one of the consecutively arranged data lines within the liquid crystal display panel and simultaneously apply the input data included within the third data interval to other ones of the consecutively arranged data lines, excluding the rightmost data line.

In still another aspect of the present invention, the data driver may, for example, apply the first dummy data to the rightmost one of consecutively arranged data lines within the liquid crystal display panel and simultaneously apply the input data included within the second data interval to other ones of the consecutively arranged data lines, excluding the rightmost data line; and apply the second dummy data to the leftmost one of the consecutively arranged data lines within the liquid crystal display panel and simultaneously apply the input data included within the third data interval to other ones of the consecutively arranged data lines, excluding the leftmost data line.

In one aspect of the present invention, polarities of the voltages applied to adjacent data lines are inverted.

In another aspect of the present invention, polarities of the voltages applied to the data lines are maintained during a frame.

In yet another aspect of the present invention, polarities of the voltages applied to the data lines are inverted every frame.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 2A and 2B illustrate a frame inversion system of driving a liquid crystal display;

FIGS. 3A and 3B illustrate a line inversion system of driving a liquid crystal display;

FIGS. 4A and 4B illustrate a column inversion system of driving a liquid crystal display;

FIGS. 5A and 5B illustrate a dot inversion system of driving a liquid crystal display;

DETAILED DESCRIPTION OF THE ILLUSTRATED EMBODIMENTS

Reference will now be made in detail to embodiments of the present invention, examples of which are illustrated in the accompanying drawings.

Figure 1:
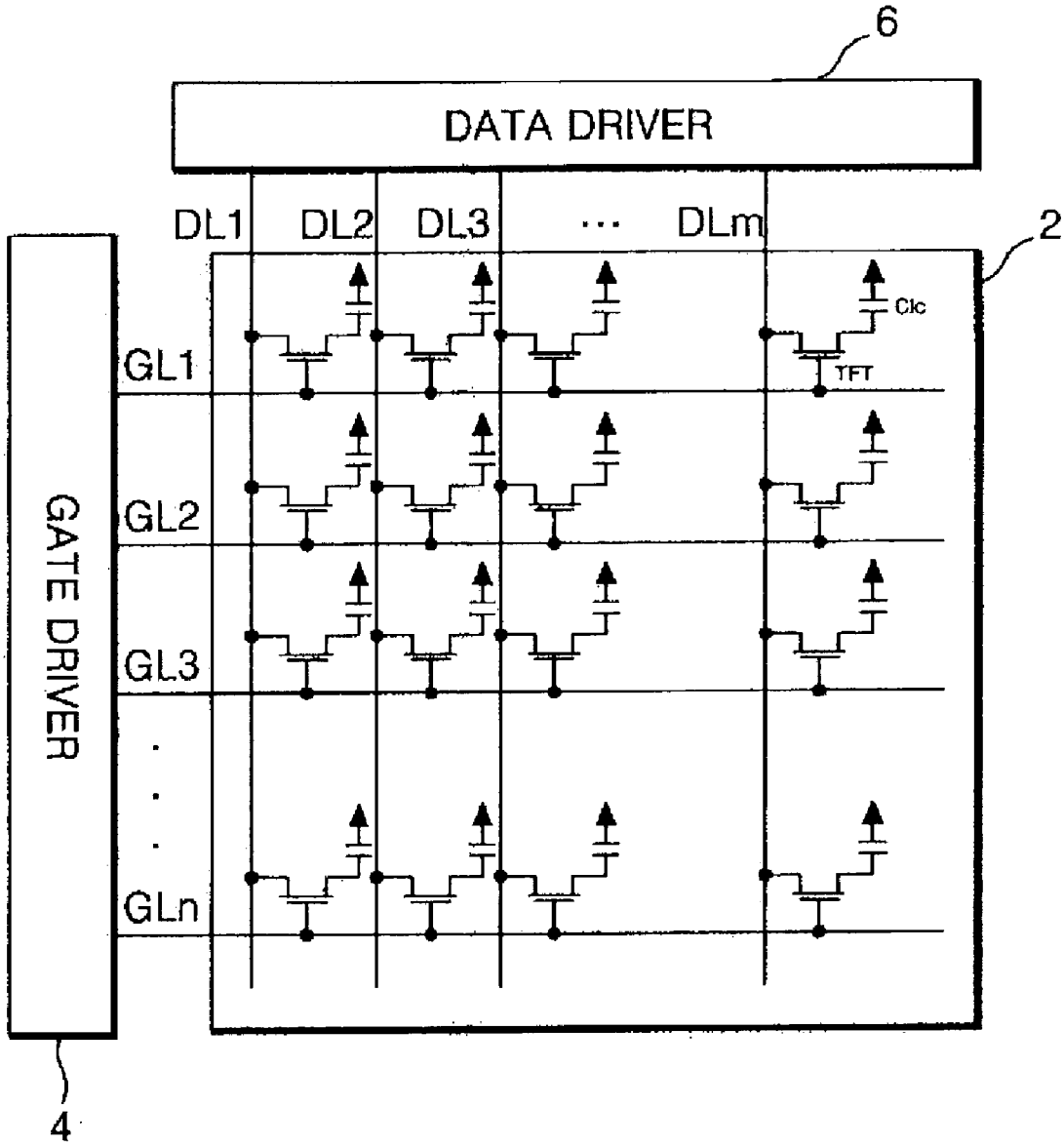
FIG. 1 RELATED ART
FIG. 1 illustrates a schematic view of a related art liquid crystal display.
Figure 6:
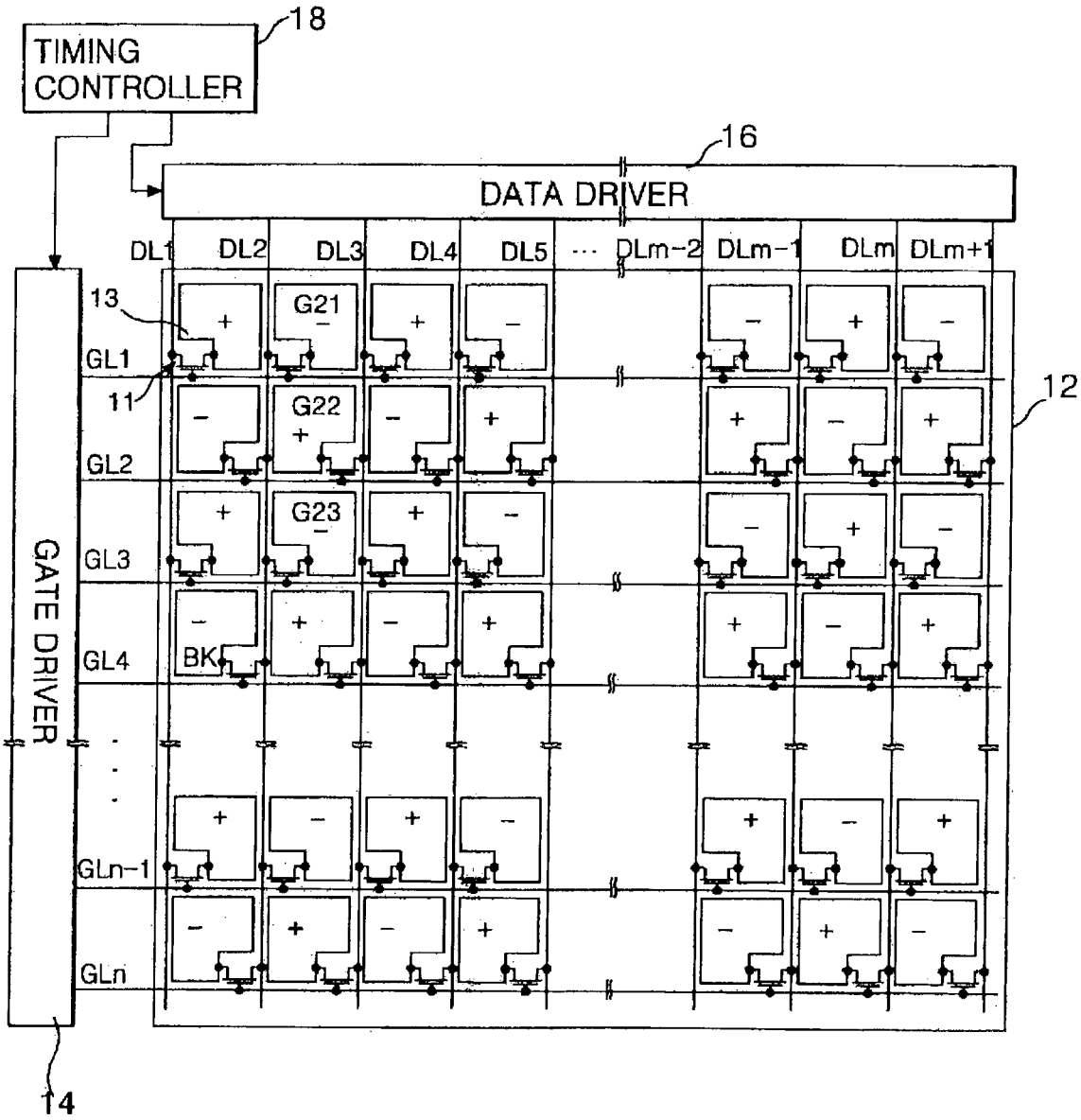
FIG. 6 illustrates a schematic view of a liquid crystal display according to a first aspect of the present invention.

FIG. 6 illustrates a schematic view of a liquid crystal display (LCD) according to a first aspect of the present invention.

Referring to FIG. 6, the LCD may, for example, include a liquid crystal display panel 12 having a plurality of liquid crystal cells arranged in a matrix pattern, a gate driver 14 for driving gate lines GL1 to GLn arranged on the liquid crystal display panel 12, a data driver 16 for driving successively arranged data lines DL1 to DLm+1 also arranged on the liquid crystal display panel 12, and a timing controller 18 for controlling the gate and data drivers 14 and 16, respectively.

The liquid crystal display panel 12 may, for example, comprise an upper glass substrate and a lower glass substrate separated from each other by a layer of liquid crystal material (not shown). The liquid crystal display panel 12 may include a predetermined number (e.g., m×n) of liquid crystal cells Clc arranged in a matrix pattern. The (m+1) data lines DL1 to DLm+1 may be arranged to cross the n gate lines GL1 to GLn and TFTs 11 may be arranged at each crossing of the gate and data lines to drive each liquid crystal cell Clc also arranged at each crossing of the gate and data lines. The TFTs 11 respond to a scanning pulse by turning on and supplying a data signal, applied to the data lines DL1 to DLm, to a corresponding liquid crystal cell Clc. In one aspect of the present invention, liquid crystal cells including TFTs 11 coupled to odd numbered gate lines GL1, GL3, . . . , GLn−1 may be coupled to adjacent ones of preceding data lines while liquid crystal cells including TFTs 11 coupled to even numbered gate lines GL2, GL4, . . . , GLn may be coupled to adjacent ones of successive data lines. Gate electrodes of the TFTs 11 may be coupled to the gate lines GL1 to GLm. Source electrodes of TFTs 11 coupled to odd numbered gate lines may be connected to adjacent ones of preceding 1st to mth data lines DL1 to DLm while source electrodes of TFTs 11 coupled to even numbered gate lines may be connected to adjacent ones of successive 2nd to (m+1)th data lines DL2 to DLm+1. Drain electrodes of TFTs 11 coupled to odd numbered gate lines may be connected to adjacent ones of successive of pixel electrodes 13 while drain electrodes of TFTs 11 coupled to even numbered horizontal lines may be connected to adjacent ones of adjacent ones of preceding pixel electrodes 13. Accordingly, odd numbered horizontal lines of liquid crystal cells Clc may be charged with data signals supplied from preceding data lines DL1 to DLm while even numbered horizontal lines of liquid crystal cells Clc may be charged with data signals supplied from successive data lines DL2 to DLm+1. Therefore, consecutive ones of TFTs 11 coupled to liquid crystal cells arranged between any two adjacent data lines may be alternately connected to one of the two adjacent data lines. Via TFTs 11, the liquid crystal cells Clc may be charged with positive voltages or negative voltages supplied by any one of two adjacent data lines.

In one aspect of the present invention, the timing controller 18 may, for example, supply digital video data from a digital video card (not shown) to the data driver. Using horizontal/vertical synchronizing signals H and V, the timing controller 18 may generate timing control signals required by the gate and data drivers 14 and 16, respectively. Accordingly, the timing control signals required by the data driver 16 may, for example, include a source shift clock (SSC), a source start pulse (SSP), a polarity control signal (POL), a source output enable signal (SOE), etc. The timing control signals required by the gate driver 14 may, for example, include a gate start pulse (GSP), a gate shift clock (GSC), a gate output enable signal (GOE), etc.

Using the gate start pulse (GSP), the gate shift clock (GSC), and the gate output enable signal (GOE) generated by the timing controller 18, the gate driver 14 may sequentially apply a scanning pulse to the gate lines GL1 to GLn. The scanning pulse sequentially turns on horizontal lines of TFTs 11 such that data signals may be applied to the TFTs turned on within each sequentially selected horizontal line. The gate driver 14 may, for example, include a shift register for sequentially generating a scanning pulse and a level shifter for shifting a voltage swing width of the scanning pulse such that it is suitable for driving a liquid crystal cell Clc.

The data driver 16 may output m digital video data signals generated by the timing controller 18 as they are received from the timing controller 18 during odd numbered horizontal periods and shift the digital video data signals by one channel to the right during even numbered horizontal periods using the source shift clock (SSC), the source start pulse (SSP), the polarity control signal (POL), and the source output enable signal (SOE) outputted from the timing controller 18. Further, the data driver 16 may convert the m digital video data signals shifted during the each horizontal period in addition to a blank data signal into either positive gamma compensation voltages or negative gamma compensation voltages. Accordingly, the data driver 16 may convert the digital video data signals and the blank data signal into various analog pixel voltages. The blank data signals are data signals present between data enable intervals in which the digital video data signals exist and are sampled using the timing controller 18. The blank data signals and the digital video data signals are then applied to the data driver 16. Polarities of pixel voltages applied to adjacent data lines, converted into the analog pixel voltages by the gamma compensation voltage, are inverted along the horizontal direction similar to the column inversion system. Accordingly, positive gamma compensation voltages and negative gamma voltages may be alternately applied to successively arranged data lines.

The polarities of the (m+1) pixel voltages may be inverted by the data driver 16 driven according to the column inversion system by means of the data driver 16 and are synchronized with the scanning pulse sequentially applied to n gate lines GL1 to GLn every horizontal period. In one aspect of the present invention, the (m+1) pixel voltages may, for example, include m red, green, and blue digital video data signals and a single blank data signals, as mentioned above. Video data voltages of the m pixel voltages may be shifted to the right during even numbered horizontal periods. The video data voltages are shifted during every even numbered horizontal period, then the polarities of the video data voltages are inverted, as mentioned above. Accordingly, polarities of the applied data signals are inverted by the column inversion system while the liquid crystal display panel 12 displays images representative of the data signals by the dot inversion system.

The data signal voltages representing the same colors are shifted by one channel and inverted during every horizontal period, data signal voltages applied to the liquid crystal display panel 12 are alternately applied between two adjacent data lines during every horizontal period. For example, polarities of green data signal voltage supplied to liquid crystal cells arranged within the second vertical line at the left side of FIG. 6 are inverted every horizontal period and alternately applied to the 2nd data line DL2 and the 3rd data line DL3. The polarity of the green data signal applied to an uppermost liquid crystal cell G21 via the 2nd data line DL2 may be negative during the first horizontal period of the nth frame. During the second horizontal period of the nth frame, the data driver 16 may invert the polarity of the green data signal, shift the inverted green data signal by one channel to the right, and apply the shifted, inverted green data signal to the second liquid crystal cell G22 via the 3rd data line DL3 as a positive voltage. During the third horizontal period of the nth frame, the data driver 16 may invert the polarity of the green data signal, shift the inverted green data signal by one channel to the left, and apply the shifted, inverted green data signal to the third liquid crystal cell G23, via the 2nd data line DL2, as a negative voltage.

The polarities of the pixel data voltages are inverted in the next frame. For example, the polarity of the green data signals supplied to the liquid crystal cells arranged within the second vertical line at the left side of FIG. 6 applied to the uppermost liquid crystal cell G21 via the 2nd data line DL2 may be positive during the first horizontal period of the (n+1)th frame. During the second horizontal period of the (n+1)th frame, the data driver 16 may invert the polarity of the green data signal, shift the inverted green data signal by one channel to the right, and apply the shifted, inverted green data signal to the second liquid crystal cell G22 via the 3rd data line DL3 as a negative voltage. During the third horizontal period of the (n+1)th frame, the data driver 16 may invert the polarity of the green data signal, shift the inverted green data signal by one channel to the left, and apply the inverted, shifted green data signal to the third liquid crystal cell G23, via the 2nd data line DL2, as a positive voltage.

As can be seen from the forgoing description, positive data voltages may be applied to the odd data lines DL1, DL3, DL5, . . . of the liquid crystal display panel 12 while negative data voltages may be applied to the even data lines DL2, DL4, DL6, . . . of the liquid crystal display panel 12 during the nth frame interval. During the (n+1)th frame interval, however, negative data voltages may be applied to the odd data lines DL1, DL3, DL5, . . . of the liquid crystal display panel 12 while positive data voltages may be applied to the even data lines DL2, DL4, DL6, . . . of the liquid crystal display panel 12.

In one aspect of the present invention, m video data signals may be inverted and shifted by one channel in every horizontal period. Accordingly, the blank data signal BK may be applied to the 1st data line DL1 or the (m+1)th data line DLm+1. When the blank data signal BK is applied to the (m+1)th data line DLm+1 in the nth frame interval, a video data signal is not applied to that data line during odd numbered horizontal periods. When the blank data signal BK is applied to the 1st data line DL1 in the nth frame interval, a video data signal is not applied to that data line during even numbered horizontal periods. When the blank data BK is applied to the 1st data line DL1 in the (n+1)th frame interval, a video data signal is not applied to that data line during odd numbered horizontal periods. When the blank data signal BK is applied to the (m+1)th data line DLm+1 in the (n+1)th frame interval, a video data signal is not applied to that data line during even numbered horizontal periods. The blank data BK may be sampled by means of the timing controller 18 and may be applied to the data driver 16 along with the digital video data signals.

Figure 7:
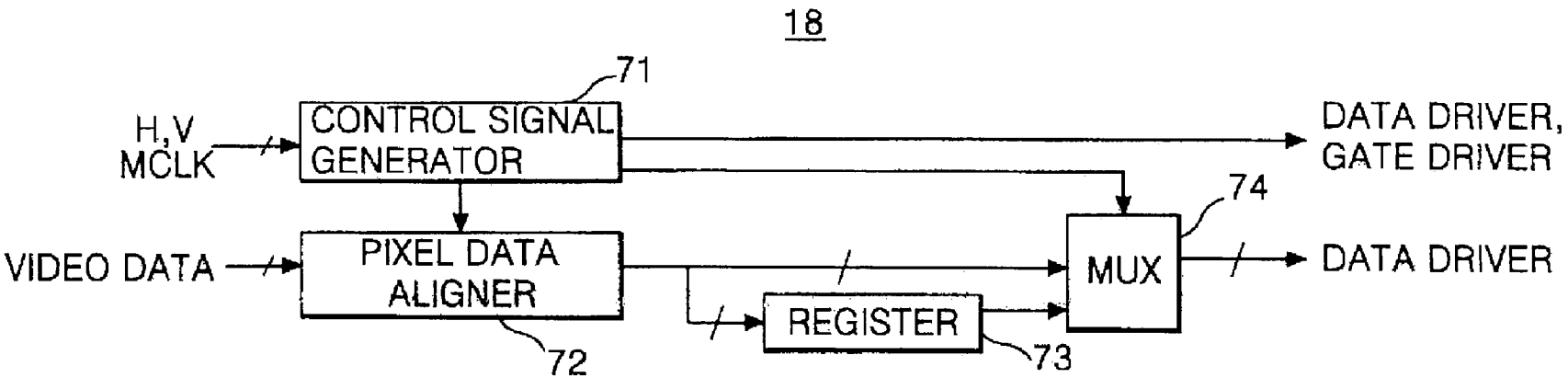
FIG. 7 illustrates a schematic view of the timing controller shown in FIG. 6.

FIG. 7 illustrates a schematic view of the timing controller shown in FIG. 6.

Referring to FIG. 7, the timing controller 18 may, for example, include a control signal generator 71 for receiving horizontal/vertical synchronizing signals H and V, a pixel data aligner 72 for receiving a digital video data, and a register 73 and multiplexor (MUX) 74 commonly connected to an output terminal of the pixel data aligner 72.

In one aspect of the present invention, the control signal generator 71 may generate gate control signals (e.g., gate start pulse (GSP), gate shift clock (GSC), gate output enable signal (GOE), etc.), suitable for controlling the gate driver 14. In another aspect of the present invention, the control signal generator 71 may use the vertical and horizontal synchronizing signals V and H, in addition to a main clock MCLK, to generate data control signals (e.g., data enable signals (DE), source shift clock (SSC), source start pulse (SSP), polarity control signal (POL), source output enable (SOE), etc.), suitable for controlling the data driver 16. Further, the control signal generator 71 may generate a clock signal required by the pixel data aligner 72 and a control signal for controlling the MUX 74.

In one aspect of the present invention, the pixel data aligner 72 may receive a digital video data signal for outputting a digital video data signal via three data buses or via six data buses in response to a clock outputted by the control signal generator 71. The pixel data aligner 72 may output data via three data buses, but may output the sampled data via six data buses such that odd pixel data and even pixel data are simultaneously outputted. Data outputted via data buses other than the last output data bus may be applied to the MUX 74. Data outputted via the last output data bus is applied to the MUX 74 and the register 73. The pixel data aligner 72 may sample or insert a blank data BK within the blank interval existing between the data enable (DE) intervals, to output the blank data BK. The number of clock signals controlling the output of the pixel data aligner 72 is determined using the equation [m/(the number of output data buses)]+1 such that m red, green, and blue digital video signal data (R, G, and B) and one blank data BK are outputted.

In one aspect of the present invention, the register 73 may temporarily store data inputted from the last data bus of three or six output data buses of the pixel data aligner 72. The register 73 may then output the stored data during the even numbered horizontal periods.

In one aspect of the present invention, the MUX 74 may output m digital video data signals and one blank data received from the pixel data aligner 72 in-situ in response to a signal indicating an odd/even horizontal period received from the control signal generator 71 during the odd numbered horizontal periods. During the even numbered horizontal periods, the MUX 74 shifts m digital video data signals received from the pixel data aligner 72 to a successive output data bus to output the digital video data signals. In one aspect of the present invention, the MUX 74 may output the last bus data, delayed by the register 73, via the first output data bus. The last bus data may include blank data BK.

Figure 8A:
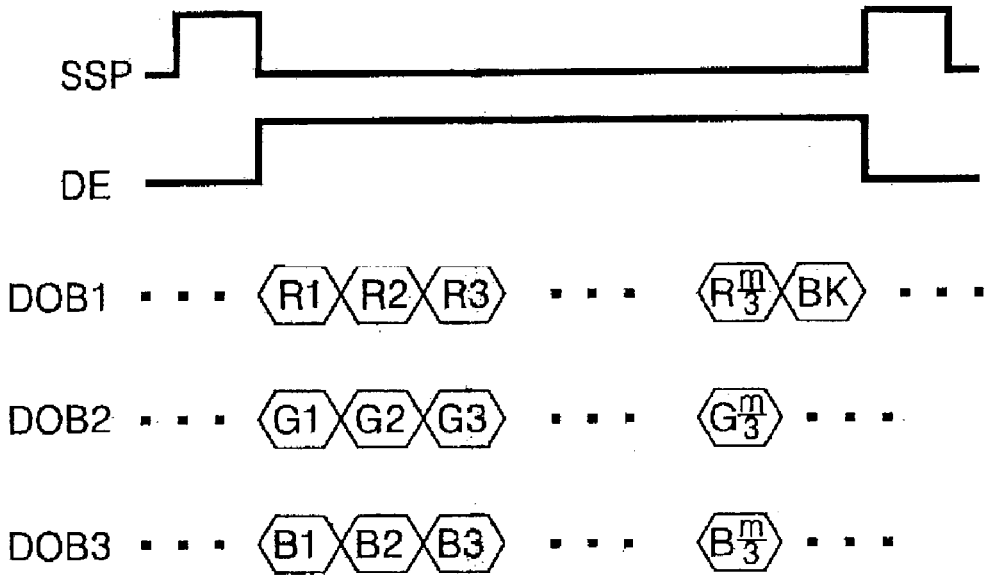
FIGS. 8A and 8B illustrate exemplary waveform diagrams of data outputted by the timing controller shown in FIG. 6.
Figure 8B:
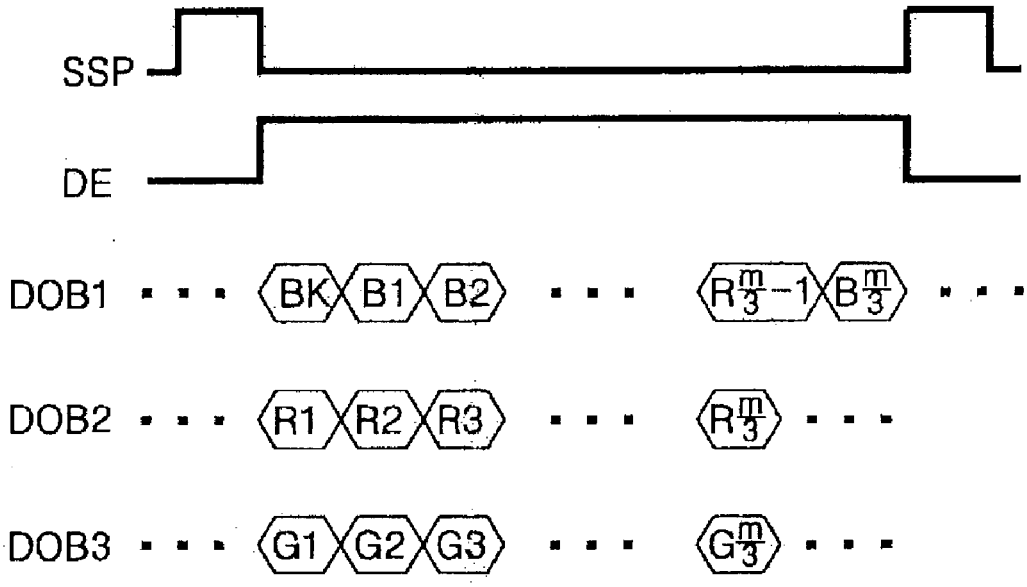

FIGS. 8A and 8B illustrate exemplary waveform diagrams of data video data and blank data outputted by the timing controller to the data driver 16 as shown in FIG. 6.

Referring to FIG. 8A, during odd numbered horizontal periods, the timing controller 18 may simultaneously apply m/3 red digital video data signals R1, R2, R3, . . . , Rm/3, m/3 green digital video data signals G1, G2, G3, . . . , Gm/3, and m/3 blue digital video data B1, B2, B3, . . . , Bm/3 to the data driver 16 via the first output data bus DOB1, the second output data bus DOB2, and the third output data bus DOB3, respectively. After m digital video data signals are applied to the data driver 16 via the first to third output data buses DOB1, DOB2 and DOB3, the timing controller 18 may apply a blank data to the data driver 16 via the first output data bus DOB1. During the data enable (DE) interval, m red, green, and blue digital video data R1, R2, R3, . . . , Rm/3, G1, G2, G3, . . . , Gm/3, and B1, B2, B3, . . . , Bm/3, respectively, may be outputted to the data driver 16 via the first to third output data buses DOB1, DOB2 and DOB3, respectively. Thereafter, one blank data BK may be outputted to the data driver 16 via the first output data bus DOB1.

In transitioning to the even numbered horizontal periods, the timing controller 18 may shift an output data bus to which a digital video data signal is outputted to a successive output data bus, one output data bus at a time. Also, the timing controller 18 may output data delayed by the register 73 via the first output data bus DOB1, which was previously empty due to the shifting of the data bus.

Referring to FIG. 8B, during even numbered horizontal periods, the timing controller 18 may simultaneously apply blank data BK, delayed by the register 73, and then apply m/3 blue digital video data B1, B2, B3 . . . . , Bm/3, also delayed by the register 73, m/3 red digital video data R1, R2, R3, . . . , Rn/3, and m/3 green digital video data G1, G2, G3, . . . , Gm/3 to the data driver 16 via the first output data bus DOB1, the second output data bus DOB2, and the third output data bus DOB3, respectively. During the data enable (DE) interval, the blank data BK, delayed by the register 73 one horizontal period, may be simultaneously outputted to the data driver 16 via the first output data bus DOB1 while the first red digital video data R1 and the first green digital video data G1 are outputted to the data driver 16, via the second and third output data buses DOB2 and DOB3, respectively. Subsequently, m/3 blue digital video data B1, B2, B3, . . . , Bm/3, delayed by the register 73 by one horizontal period, may be simultaneously outputted to the data driver 16 via the first output data bus DOB1, while the red and green digital video data R2, R3, . . . , Rm/3 and G2, G3, . . . , Gm/3 are outputted to the data driver 16 via the second and third output data buses DOB2 and DOB3, respectively.

In one aspect of the present invention, the timing controller 18 may simultaneously output odd data via a first set of three output data buses and even data via a second set of three output data buses. Accordingly, the frequencies of data applied to the data driver 16 and the timing control signal received by the data driver 16 may be reduced by half.

Figure 9A:
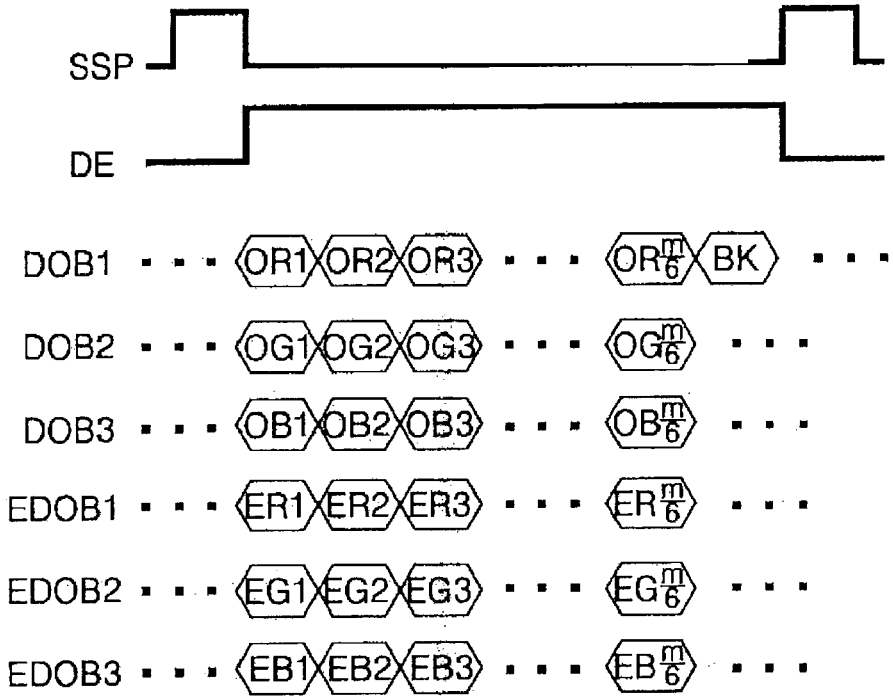
FIGS. 9A and 9B illustrate additional exemplary waveform diagrams of data outputted by the timing controller shown in FIG. 6.
Figure 9B:
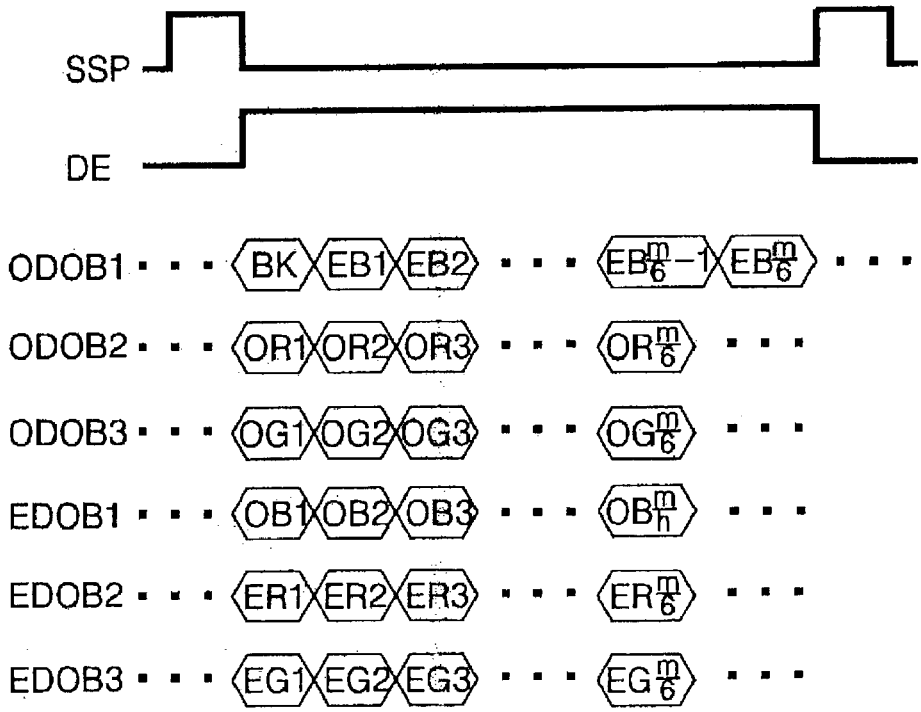

FIGS. 9A and 9B illustrate additional exemplary waveform diagrams of digital video data and blank data outputted by the timing controller to the data driver 16 shown in FIG. 6 via six output data buses.

Referring to FIG. 9A, during odd numbered horizontal periods, the timing controller 18 may simultaneously apply m/6 odd red digital video data OR1, OR2, OR3, . . . , ORm/6, m/6 odd green digital video data OG1, OG2, OG3 . . . . , OGm/6, and m/6 odd blue digital video data OB1, OB2, OB3, . . . , OBm/6 to the data driver 16, via the first odd output data bus ODOB1, the second odd output data bus ODOB2, and the third odd output data bus ODOB3, respectively. During odd numbered horizontal periods, the timing controller 18 may also simultaneously apply m/6 even red digital video data ER1, ER2, ER3, . . . , ERm/6, m/6 even green digital video data EG1, EG2, EG3, . . . , EGm/6, and m/6 even blue digital video data EB1, EB2, EB3, . . . , EBm/6 to the data driver 16 via the first even output data bus EDOB1, the second even output data bus EDOB2, and, the third even output data bus EDOB3, respectively. After m/2 odd digital video data and m/2 even digital video data are applied to the data driver 16 via the first to third odd output data buses ODOB1, ODOB2 and ODOB3 and the first to third even output data buses EDOB1, EDOB2 and EDOB3, respectively, the timing controller 18 may apply one blank data BK to the data driver 16 via the first odd output data bus ODOB1. During the data enable (DE) interval, m red, green, and blue digital video data OR1, OR2, OR3, . . . , ORm/6, OG1, OG2, OG3, . . . , OGm/6, OB1, OB2, OB3, . . . , OBm/6, ER1, ER2, ER3, . . . , ERm/6, EG1, EG2, EG3, . . . , EGm/6, and EB1, EB2, EB3, . . . , EBm/6 may be outputted to the data driver 16. Thereafter, one blank data BK is outputted to the data driver 16 via the first odd output data bus ODOB1.

In transitioning to even numbered horizontal periods, the timing controller 18 may shift a data bus to which a digital video data signal is outputted to a successive one of an output data bus, one output data bus at a time. Also, the timing controller 18 may output data delayed by the register 73 via the first odd output data bus ODOB1, which was empty due to the shifting of the data bus.

Referring to FIG. 9B, during even numbered horizontal periods, the timing controller 18 may apply blank data BK, delayed by the register 73, and then apply m/6 even blue digital video data EB1, EB2, EB3, . . . , EBm/6, also delayed by the register 73, m/6 odd red digital video data OR1, OR2, OR3, . . . , ORm/6, and m/6 odd green digital video data OG1, OG2, OG3, . . . , OGm/6 to the data driver 16 via the first odd output data bus ODOB1, the second odd output data bus ODOB2, and the third odd output data bus ODOB3, respectively. During the even numbered horizontal periods, the timing controller 18 may also apply m/6 odd blue digital video data OB1, OB2, OB3, . . . , OBm/6, m/6 even red digital video data ER1, ER2, ER3, . . . , ERm/6, and applies m/6 even green digital video data EG1, EG2, EG3, . . . , EGm/6 to the data driver 16 via the first even output data bus EDOB1, the second even output data bus EDOB2, and the third even output data bus EDOB3, respectively. During the data enable (DE) interval, blank data BK, delayed by the register 73 by one horizontal period, may be simultaneously outputted to the data driver 16 via the first odd output data bus ODOB1 while the first odd red digital video data OR1 and the first odd green digital video data OG1 are outputted to the data driver 16 via the second and third odd output data buses ODOB2 and ODOB3, respectively, and while the first odd blue digital video data OB1, the first even red digital video data ER1, and the first even green digital video data EG1 are outputted to the data driver 16 via the first to third even output data buses EDOB1, EDOB2 and EDOB3, respectively. Subsequently, m/6 even blue digital video data EB1, EB2, EB3, . . . , EBm/6, delayed by the register 73 by one horizontal period, may be simultaneously outputted to the data driver 16 via the first odd output data bus ODOB1 while the odd red, green, and blue digital video data OR2, OR3, . . . , ORm/6, OG2 and OG2, OG3, . . . , OGm/6, OB2, OB3, . . . , OBm/6, even red and green digital video data ER2, ER3, . . . , ERm/6, and EG2, EG3, . . . , EGm/6, respectively, are outputted to the data driver 16 via the second and third odd output data buses ODOB2 and ODOB3 and the first to third even output data buses EDOB1, EDOB2, and EDOB3, respectively.

In FIGS. 8A to 9B, data applied to the data driver 16 may include 6 or 8 bits for each output data bus.

Figure 10:
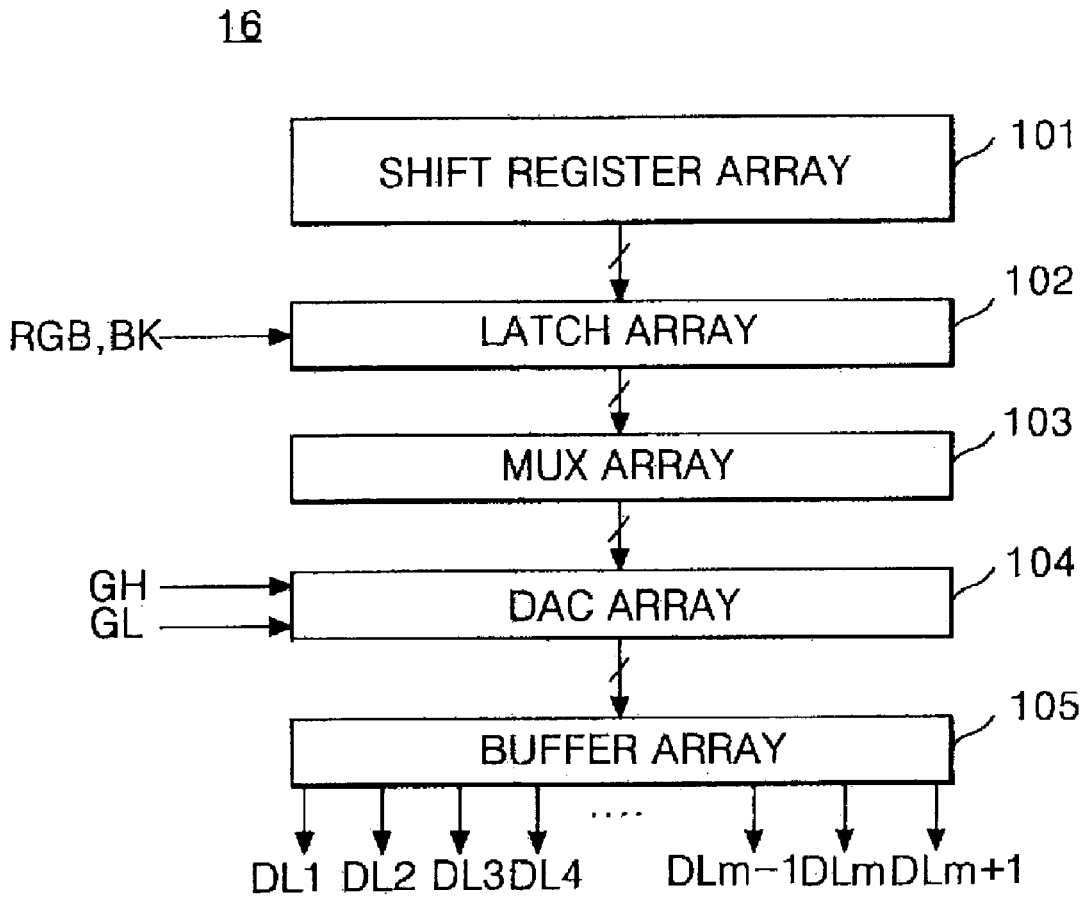
FIG. 10 illustrates a schematic view of the data driver shown in FIG. 6.

FIG. 10 illustrates a schematic view of the data driver 16 shown in FIG. 6.

Referring to FIG. 10, the data driver 16 may, for example, include a latch array 102, a MUX array 103, a digital-to-analog (DAC) array, and a buffer array 105 all connected in cascade between a shift register array 101 and the plurality of data lines DL1 to DLm+1.

In one aspect of the present invention, the shift register array 101 may sequentially shift a source start pulse (SSP) from the timing controller 18 in response to a received source shift clock (SSC) to generate a sampling clock. In response to the sampling clock generated by the shift register array 101, the latch array 102 may sample digital red, green, and blue video data signals R, G, and B and the digital blank data BK outputted from the timing controller 18 and latch data for each horizontal line. In response to a source output enable signal (SOE) outputted from the timing controller 18, the latch array 102 may simultaneously output the latched data.

In one aspect of the present invention, the MUX array 103 may output data from the latch array 102 within the horizontal period in-situ or uniformly shifted to the right by one channel. If data outputted from the latch array 102 is to be outputted to the data lines during odd numbered horizontal periods, the MUX array 103 may output data for one horizontal line unshifted (e.g., in-situ, as the data was outputted from the latch array 102). If data outputted from the latch array 102 is to be outputted to the data lines during even numbered horizontal periods, the MUX array 103 may output data for one horizontal line shifted to the right (e.g., to a successive adjacent output line), relative to the data that was outputted from the latch array 102.

In one aspect of the present invention, the DAC array 104 may convert digital video data signals and digital blank data outputted from the MUX array 103 into analog signals. Accordingly, and in response to a polarity control signal POL outputted by the timing controller 18, the DAC array 104 may select a suitable positive gamma compensation voltage GH or negative gamma compensation voltage GL suitable to convert the digital video data signals into analog signals. For example, the DAC array 104 may converts a digital video data signal outputted from the MUX array 103 into a positive gamma compensation voltage GH or a negative compensation voltage GL. Further, the DAC array 104 may convert a digital video data signal shifted by the MUX array 103 into a negative gamma compensation voltage GL or a positive gamma compensation voltage GH. In one aspect of the present invention, data signals may be shifted and may have their polarities inverted before they are applied to output lines every horizontal period via the MUX array 103 and the DAC array 104. The data signals, whether they are shifted/unshifted and/or inverted/uninverted, may be outputted to the buffer array 105 before they are applied to the plurality of data lines DL1 to DLm+1.

In one aspect of the present invention, the polarity of data signals outputted by the data driver 16 to the odd data lines DL1, DL3, DL5, . . . , DLm−1, DLm+1 may be positive voltage during the nth frame interval while the polarity of data signals outputted by the data driver 16 to the odd data lines DL1, DL3, DL5, DLm−1, DLm+1 may be positive voltage may be negative during (n+1)th frame interval. In another aspect of the present invention, the polarity of the data signals outputted by the data driver 16 to the even data lines DL2, DL4, DL6, . . . , DLm may be negative voltage during the nth frame interval while the polarity of the data signals outputted by the data driver 16 to the even data lines, DL2, DL4, DL6, . . . , DLm may be positive during the (n+1)th frame interval. Accordingly, data signals having polarities controlled via a column inversion system may be supplied to the plurality of data lines within the liquid crystal display panel 12 while the liquid crystal display panel 12 may be driven according to the dot inversion system. Accordingly, pictures may be displayed on the liquid crystal display panel 12 by liquid crystal cells having TFTs 11 within a column of liquid crystal cells alternately connected to two adjacent data lines.

Figure 11A:
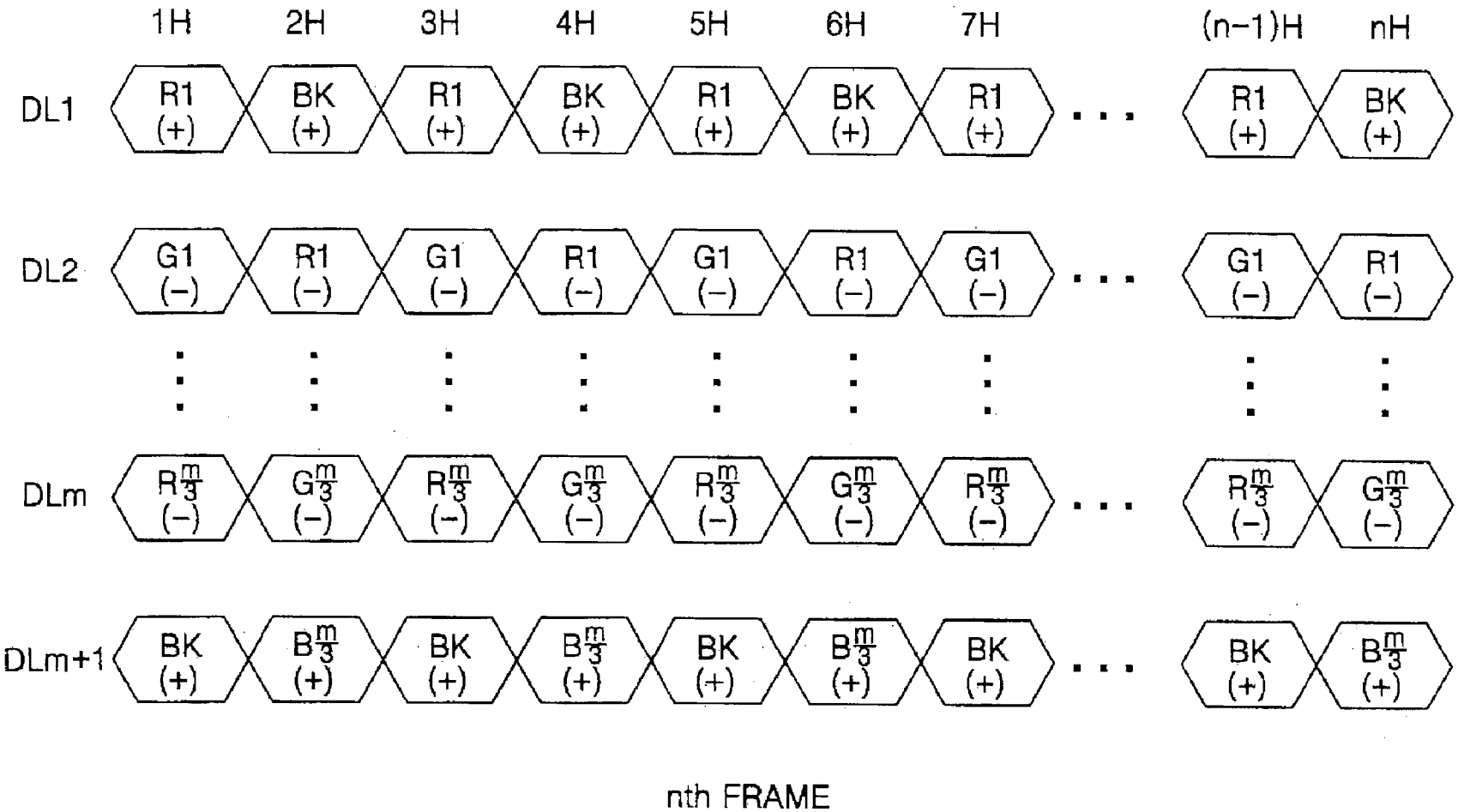
FIGS. 11A and 11B illustrate waveform diagrams of data applied to the liquid crystal display panel shown in FIG. 6.
Figure 11B:
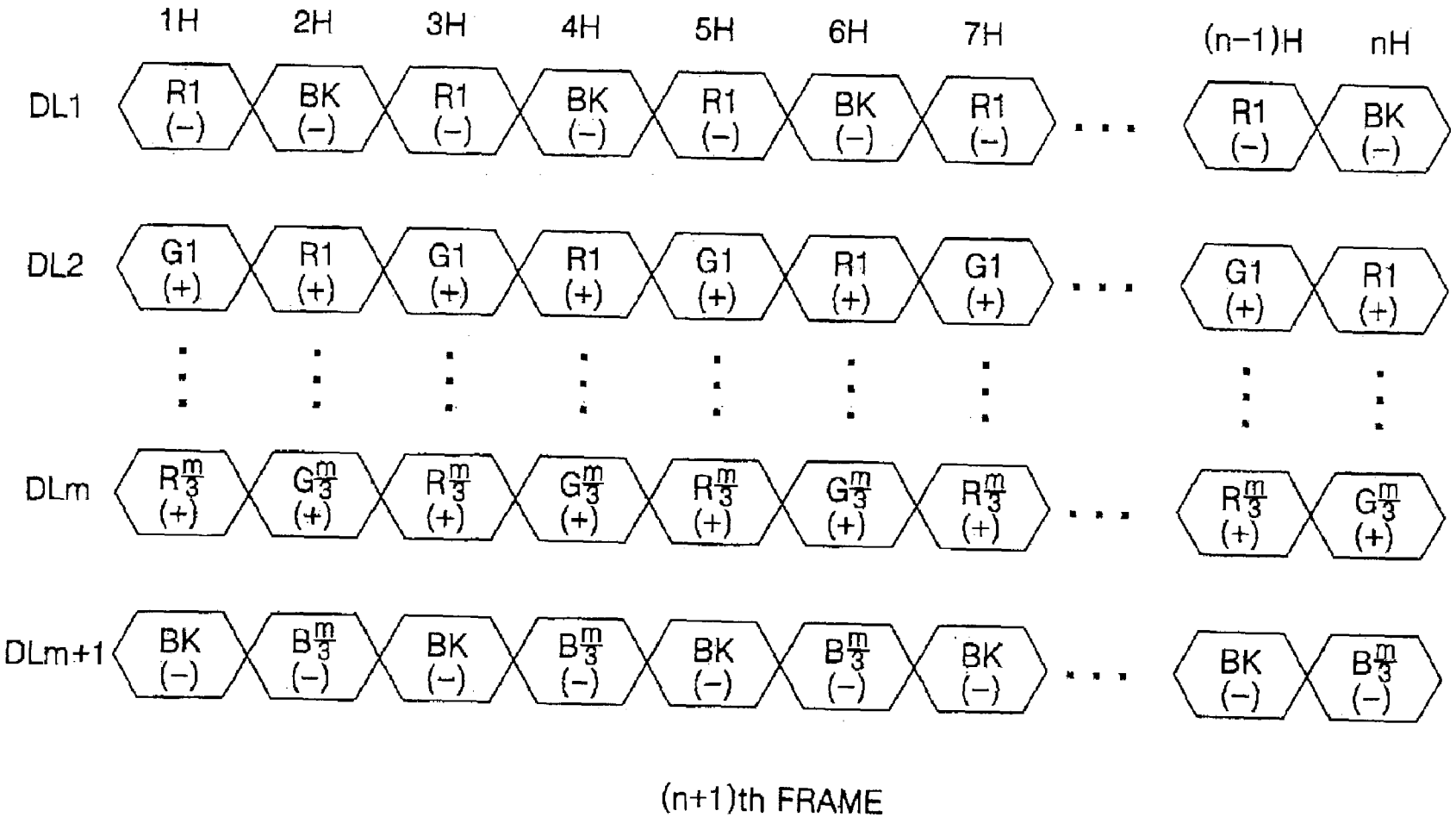

FIGS. 11A and 11B illustrate waveform diagrams of data applied to data lines DL1 to DLm+1 of the liquid crystal display panel shown in FIG. 6 during the nth and the (n+1)th frame intervals.

Referring to FIG. 11A, during odd numbered horizontal periods 1H, 3H, . . . , (n−1)H in the nth frame, red, green, and blue pixel voltages may be applied to the 1st to mth data lines DL1 to DLm while a pixel voltage of the blank data BK may be applied to the (m+1)th data line DLm+1. During even numbered horizontal periods 2H, 4H, . . . , nH in the nth frame, red, green, and blue pixel voltages may be applied to the 2nd to (m+1)th data lines DL2 to DLm+1 while a pixel voltage of the blank data BK may be applied to the first data line DL1. In one aspect of the present invention, positive pixel voltage may be applied to the odd data lines DL1, DL3, DL5, . . . , DLm−1, and DLm+1 while a negative pixel voltage may be applied to the even data lines DL2, DL4, DL6, . . . , DLm−2, and DLm in the nth frame. In another aspect of the present invention, a polarity of the pixel voltage applied to each data line DL1 to DLm+1 is inverted in transitioning to the (n+1)th frame, as shown in FIG. 11B.

Referring to FIG. 11B, during odd numbered horizontal periods 1H, 3H, . . . , (n−1)H in the (n+1)th frame, red, green, and blue pixel voltages may be applied to 1st to mth data lines DL1 to DLm while a pixel voltage of the blank data BK may be applied to the (m+1)th data line DLm+1. During even horizontal periods 2H, 4H, . . . , nH in the (n+1)th frame, red, green and blue pixel voltages may be applied to the 2nd to (m+1)th data lines DL2 to DLm+1 while a pixel voltage of the blank data BK may be applied to the 1st data line DL1. In one aspect of the present invention, negative pixel voltage may be applied to the odd data lines DL1, DL3, DL5, DLm−1, DLm+1 while a positive pixel voltage may be applied to the even data lines DL2, DL4, DL6, . . . , DLm−2, DLm during the (n+1)th frame.

Figure 12:
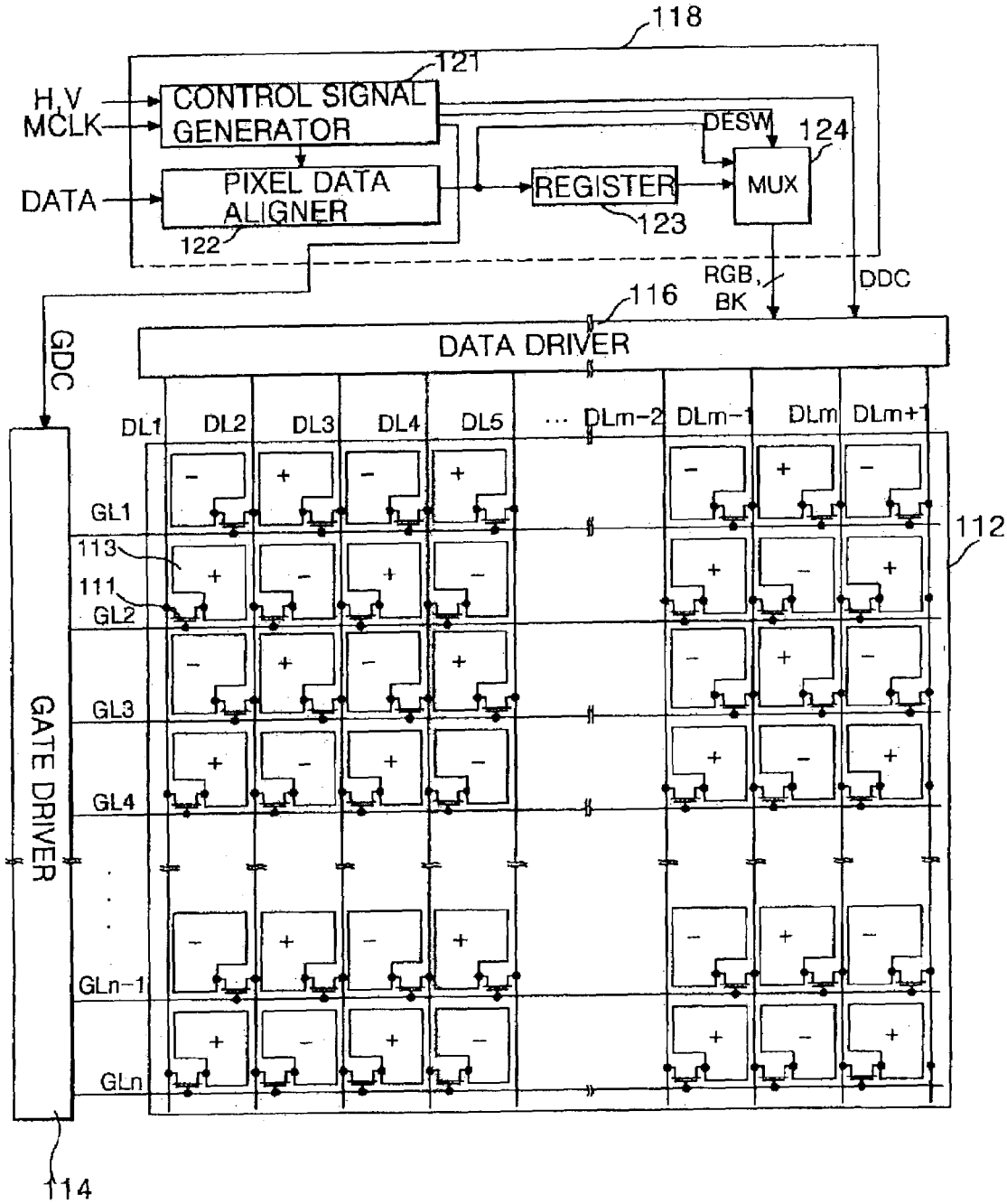
FIG. 12 illustrates a schematic view of a liquid crystal display according to a second aspect of the present invention.

FIG. 12 illustrates a schematic view of a liquid crystal display according to a second aspect of the present invention.

Referring to FIG. 12, the LCD may, for example, include a liquid crystal display panel 112 having a plurality of gate lines GL1 to GLn, a plurality of successively arranged data lines DL1 to DLm+1 arranged to cross the plurality of gate lines, and a plurality of liquid crystal cells Clc arranged in a matrix pattern at crossings of the gate and data lines. Each of the liquid crystal cells may include a TFT 111 for driving each liquid crystal cell. In one aspect of the present invention, consecutive ones of TFTs 111 arranged within a column of liquid crystal cells are alternately connected to two adjacent data lines. For example, TFTs 111 within odd numbered horizontal lines supply data signals, applied to the 2nd to (m+1)the data lines DL2 to DLm+1, to liquid crystal cells arranged within the odd numbered horizontal lines while TFTs 111 within even numbered horizontal lines supply data signals, applied to the 1st to mth data lines DL1 to DLm, to liquid crystal cells arranged within the even numbered horizontal lines. The LCD may further include a gate driver 114 for driving a plurality of gate lines GL1 to GLn arranged on the liquid crystal display panel 112, a data driver 116 for driving a plurality of data lines DL1 to DLm+1 also arranged on the liquid crystal display panel 112, and a timing controller 118 for controlling the gate driver 114 and the data driver 116.

In one aspect of the present invention, liquid crystal cells including TFTs 111 coupled to odd numbered gate lines GL1, GL3, GL5, . . . , GLn−1 may be coupled to adjacent ones of successive data lines DL2 to DLm+1 while liquid crystal cells including TFTs 111 coupled to even numbered gate lines GL2, GL4, GL6, . . . , GLn may be coupled to adjacent ones of preceding data lines DL1 to DLm. Gate electrodes of TFTs 111 may be connected to the gate lines GL1 to GLm. Source electrodes of TFTs 111 coupled to odd numbered gate lines may be connected to adjacent ones of successive 2nd to (m+1)th data lines DL2 to DLm+1 while source electrodes of TFTs 111 coupled to even numbered gate lines may be connected to adjacent ones of preceding 1st to mth data lines DL1 to DLm. Drain electrodes of TFTs 111 coupled to odd numbered gate lines may be connected to adjacent ones of preceding pixel electrodes 113 while drain electrodes of TFTs 111 coupled to even numbered gate lines may be connected to adjacent ones of successive pixel electrodes 113. Accordingly, even numbered horizontal lines of liquid crystal cells Clc may be charged with data signals supplied from adjacent ones of preceding data lines DL1 to DLm while odd numbered horizontal lines of liquid crystal cells Clc may be charged with data signals supplied from adjacent ones of successive data lines DL2 to DLm+1. Therefore, consecutive ones of TFTs 111 coupled to liquid crystal cells arranged between any two adjacent data lines may be alternately connected to one of the two adjacent data lines.

In one aspect of the present invention, the liquid crystal cells Clc may be charged with positive voltages or negative voltages, via the TFTs 111 connected to adjacent data lines as described above.

In one aspect of the present invention, the timing controller 118 may, for example, include a control signal generator 121, a pixel data aligner 122, a register 123, and a MUX 124. The timing controller 118 may supplies digital video data from a digital video card (not shown) to the data driver 116. Using horizontal/vertical synchronizing signals H and V, the timing controller 118 may generate timing control signals required by the gate and data drivers 114 and 116, respectively.

In one aspect of the present invention, the control signal generator 121 may generate gate control signals (GDC) (e.g., gate start pulse (GSP), gate shift clock (GSC), gate output enable signal (GOE), etc.), suitable for controlling the gate driver 114. In another aspect of the present invention, the control signal generator 121 may use the vertical and horizontal synchronizing signals V and H, in addition to a main clock MCLK, to generate data and data control signals (DDC) (e.g., data enable signals (DE), source shift clock (SSC), source start pulse (SSP), polarity control signal (POL), source output enable signal (SOE), etc.), suitable for controlling the data driver 116. Further, the control signal generator 121 may generate a clock signal required by the pixel data aligner 122 and a control signal for controlling the MUX 124.

In one aspect of the present invention, the pixel data aligner 122 may output inputted digital video data signals (e.g., RGB) in response to a clock outputted from the control signal generator 121. The pixel data aligner 122 may detect blank data BK within the blank interval or internally generate blank data BK, and output the blank data BK along with the digital video data signal (RGB). The pixel data aligner 122 may output sampled data via three data buses in a similar manner as shown in FIGS. 8A and 8B, but may also output the sampled data via six data buses in a similar manner as shown in FIGS. 9A and 9B such that odd pixel data and even pixel data are outputted simultaneously. Data outputted via data buses other than the last output data bus may be applied to the MUX 124. Data outputted via the last output data bus is applied to the MUX 124 and the register 123.

In one aspect of the present invention, during even numbered horizontal periods, the MUX 124 may shift m digital video data signals (RGB), outputted from the pixel data aligner 122, to successive ones of the output data buses and output the shifted digital video signals via the successive ones of the output data buses while the data delayed by the register 123 is outputted via the first output data bus. In one aspect of the present invention, the MUX 124 may output the m digital video data signals (RGB) and a single blank data, outputted from the pixel data aligner 122, in-situ in response to a signal (OESW) indicating an odd/even horizontal period received from the control signal generator 122 during odd numbered horizontal periods.

In one aspect of the present invention, when the timing controller 118 outputs data via three output data buses DOB1, DOB2, and DOB3 during odd numbered horizontal periods, m digital video data signals (RGB) may be shifted toward a successive one of the output data buses and blank data BK and blue digital video data B1, B2, . . . , Bm/3, delayed by the register 123, are outputted via the remaining first output data bus DOB1 as shown in FIG. 8B. When the timing controller 118 outputs data via three output data buses DOB1, DOB2 and DOB3 during even numbered horizontal periods, m digital video data signals (RGB) may be outputted in-situ (e.g., without being shifted) via appropriate output data buses as shown in FIG. 8A. For example, during even numbered horizontal periods, a red digital video data signal (R) may be outputted via the first output data bus DOB1, a green digital video data signal (G) may be outputted via the second output data bus DOB2, and a blue digital video data signal (B) may be outputted via the third output data bus DOB3. In one aspect of the present invention, blank data BK may be outputted via the first output data bus DOB1 at the end of even numbered horizontal periods.

In another aspect of the present invention, when data is outputted via six output data buses ODOB1, ODOB2, ODOB3, EDOB1, EDOB2 and EDOB3 during odd numbered horizontal periods, the timing controller 118 may shift m digital video data signals (RGB) to successive ones of the output data buses while the blank data BK and the odd blue digital video data OB1, OB2, . . . , OBm/6, delayed by the register 123, are outputted via first odd output data bus ODOB1 as shown in FIG. 9B. When data is outputted via six output data buses ODOB1, ODOB2, ODOB3, EDOB1, EDOB2 and EDOB3 during even numbered horizontal periods, the timing controller 118 may output m digital video data signals (RGB) in-situ (e.g., without being shifted) via the appropriate output data bus as shown in FIG. 9A. In one aspect of the present invention, blank data BK may be outputted via the first odd output data bus ODOB1 at the end of even numbered horizontal periods.

Using the gate start pulse (GSP), the gate shift clock (GSC), and the gate output enable signal (GOE) generated by the timing controller 118, the gate driver 114 may sequentially apply a scanning pulse to the gate lines GL1 to GLn. The scanning pulse sequentially turns on horizontal lines of TFTs 111 such that data signals may be applied to the TFTs 111 turned on within each sequentially selected horizontal line. The gate driver 114 may, for example, include a shift register for sequentially generating a scanning pulse and a level shifter for shifting a voltage swing width of the scanning pulse such that the voltage swing width is suitable for driving a liquid crystal cell Clc.

The data driver 116 may, for example, include a shift register array, a latch array, a MUX array, a digital-to-analog inverter (DAC) array, a buffer array 105, etc. similar as to the data driver shown in FIG. 10. Accordingly, the data driver 116 may output m digital video data signals outputted from the timing controller 118 in-situ during odd numbered horizontal periods and shift the m digital video data signals to successive ones of the output data buses by one channel (e.g., to the right) during even numbered horizontal periods using the source shift clock (SSC), source start pulse (SSP), polarity control signal (POL), and source output enable signal (SOE) outputted from the timing controller 118. Further, the data driver 116 may convert m digital video data signal shifted during each the horizontal period in addition to a blank data signal into positive gamma compensation voltages or negative gamma compensation voltages. Accordingly, the data driver 116 may convert the digital video data signals and the blank data signal into various analog pixel voltages. Polarities of the pixel voltages applied to adjacent data lines, converted into the various analog pixel voltages by the gamma compensation voltage, are inverted along the horizontal direction similar to the column inversion system. Accordingly, positive gamma compensation voltages and negative gamma voltages may be alternately applied to successively arranged data lines.

The polarities of the (m+1) pixel voltages are inverted by the column inversion system by means of the data driver 116 and are synchronized with the scanning pulse sequentially applied to n gate lines GL1 to GLn every horizontal period.

Figure 13A:
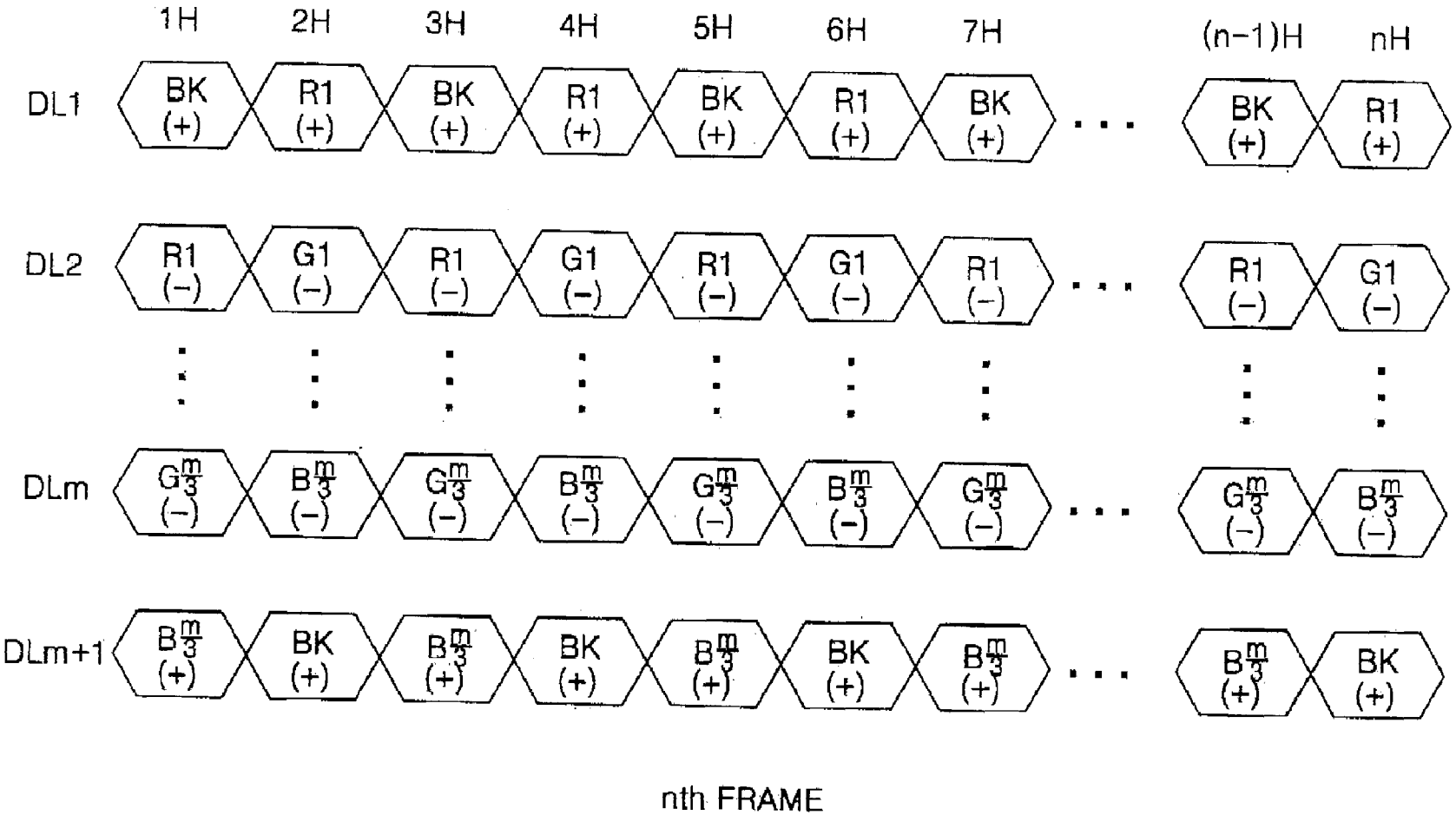
FIGS. 13A and 13B illustrate waveform diagrams of data applied to the liquid crystal display panel shown in FIG. 12.
Figure 13B:
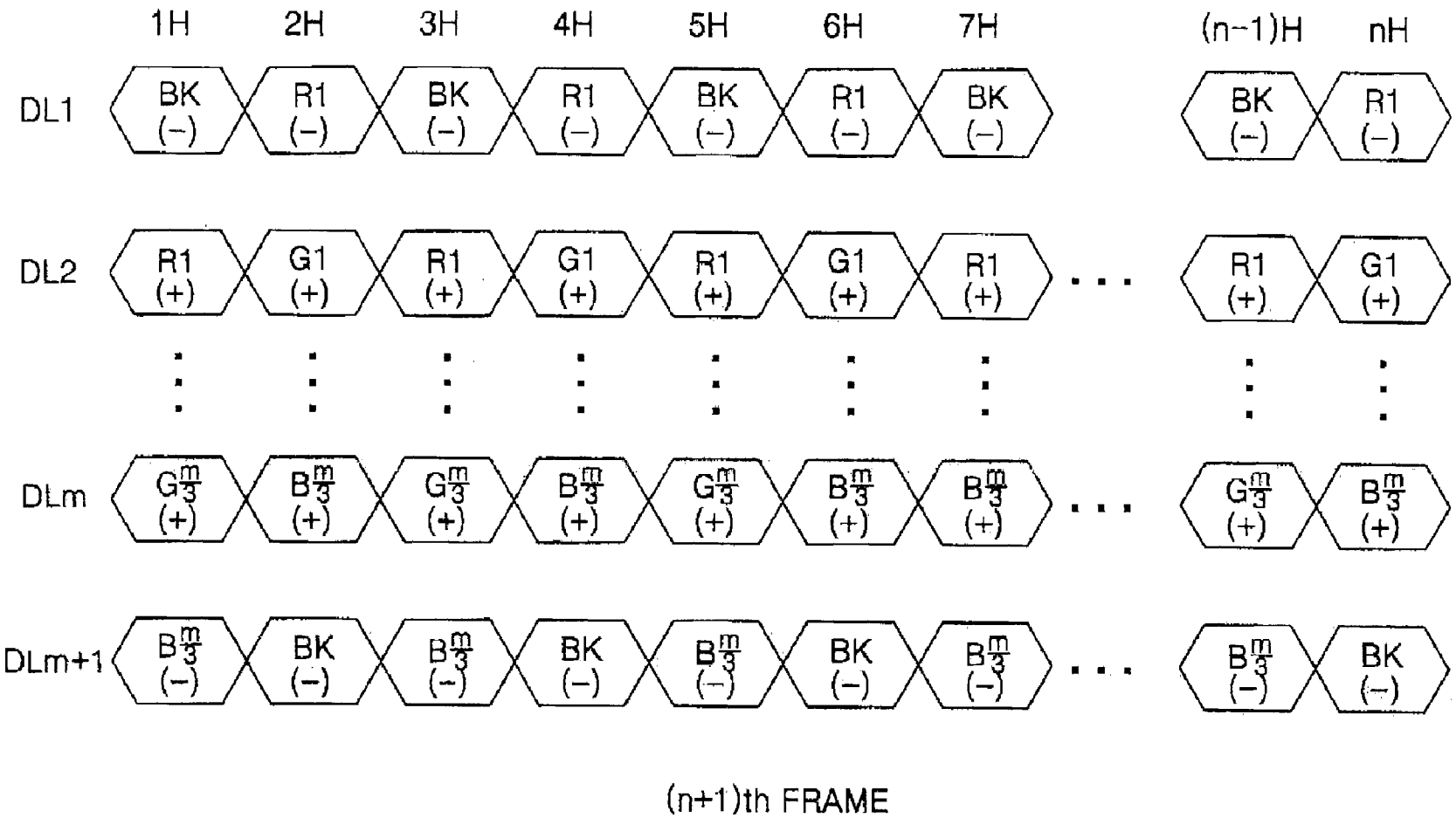

FIGS. 13A and 13B illustrate waveform diagrams of data applied to data lines DL1 to DLm+1 of the liquid crystal display panel 112 shown in FIG. 12 during the nth and the (n+1)th frame intervals.

Referring to FIG. 13A, during odd numbered horizontal periods 1H, 3H, . . . , (n−1)H in the nth frame, red, green, and blue pixel voltages may be applied to the 2nd to (m+1)th data lines DL2 to DLm+1 while a pixel voltage of the blank data BK may be applied to the 1st data line DL1. During even numbered horizontal periods 2H, 4H, . . . , nH in the nth frame, red, green, and blue pixel voltages may be applied to the 1st to mth data lines DL1 to DLm while a pixel voltage of the blank data BK may be applied to the (m+1)th data line DLm+1. In one aspect of the present invention, positive pixel voltage may be applied to the odd data lines DL1, DL3, DL5, . . . , DLm−1, and DLm+1 while negative pixel voltage may be applied to the even data lines DL2, DL4, DL6, . . . , DLm−2, and DLm in the nth frame. In another aspect of the present invention, a polarity of the pixel voltage applied to each data line DL1 to DLm+1 may be inverted in transitioning to the (n+1)th frame, as shown in FIG. 13B.

Referring to FIG. 13B, during odd numbered horizontal periods 1H, 3H, . . . , (n−1)H in the (n+1)th frame, red, green, and blue pixel voltages may be applied to the 2nd to (m+1)th data lines DL2 to DLm+1 while a pixel voltage of the blank data BK may be applied to the 1st data line DL1. During even numbered horizontal periods 2H, 4H, . . . , nH in the (n+1)th frame, red, green, and blue pixel voltages may be applied to the 1st to mth data lines DL1 to DLm while a pixel voltage of the blank data BK may be applied to the (m+1)th data line DLm+1. In one aspect of the present invention, negative pixel voltage may be applied to the odd data lines DL1, DL3, DL5, DLm−1, and DLm+1 while positive pixel voltage may be applied to the even data lines DL2, DL4, DL6, . . . , DLm−2, and DLm during the (n+1)th frame.

According to principles of the present invention, the abovementioned blank data BK may comprise a voltage detected within a black data interval between data enable intervals and may be digitally expressed as '000000' or '00000000'. When the blank data BK comprises a gamma compensation voltage by means of the data driver, the blank data BK is converted into a voltage having a maximum potential difference from a common voltage (Vcom) applied to a common electrode (not shown). Thus, in one aspect of the present invention, the voltage of the blank data BK may correspond substantially to a black grayscale level of a normally white mode LCD (i.e., an LCD transmitting a maximum amount of light when voltage is not applied to liquid crystal cells Clc, wherein the amount of light transmitted decreases as a voltage applied to the liquid crystal cell Clc increases). Further, in another aspect of the present invention, the voltage of the blank data BK may correspond substantially to a white grayscale level of a normally black mode LCD (i.e., an LCD transmitting substantially no light when voltage is not applied to the liquid crystal cells Clc, wherein the amount of light transmitted increases as a voltage applied to the liquid crystal cell Clc increases).

Accordingly, when blank data BK is applied to the liquid crystal cells Clc coupled to the first or last data lines DL1 or DLm+1 as a maximum voltage, a swing width of the voltage applied to the data lines DL1 or DLm+1 is enlarged and a load variation within the liquid crystal display panel 12 or 112 may cause an increase in power consumption by the LCD.

Figure 14:
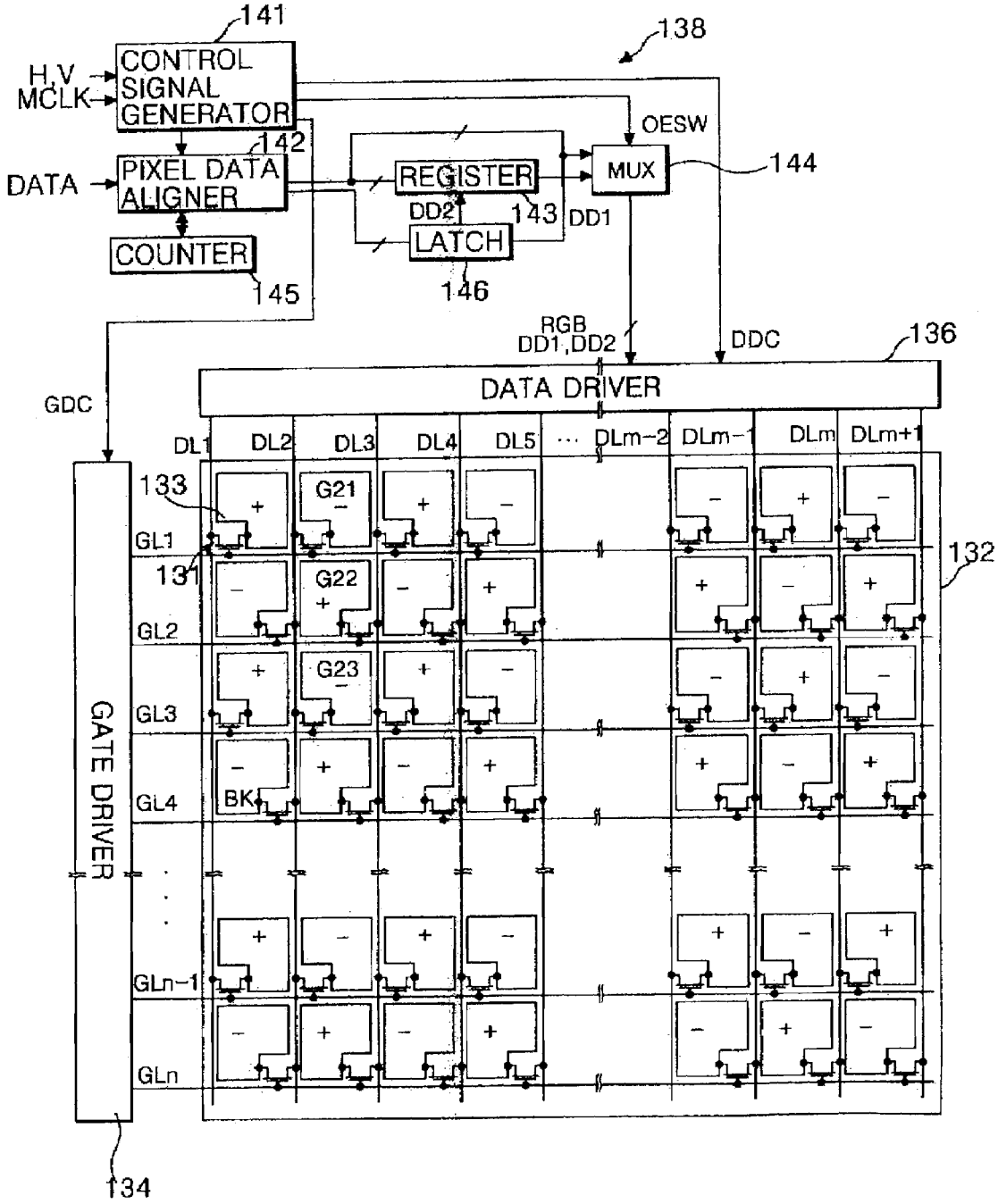
FIG. 14 illustrates a schematic view of a liquid crystal display according to a third aspect of the present invention.

FIG. 14 illustrates a schematic view of a liquid crystal display according to a third aspect of the present invention.

Referring to FIG. 14, the LCD may, for example, include a liquid crystal display panel 132 having a plurality of gate lines GL1 to GLn, a plurality of successively arranged data lines DL1 to DLm+1 arranged to cross the plurality of gate lines, and a plurality of liquid crystal cells Clc arranged in a matrix pattern at crossings of the gate and data lines. Each of the liquid crystal cells may include a TFT 131 for driving each liquid crystal cell. In one aspect of the present invention, consecutive ones of TFTs 131 arranged within a column of liquid crystal cells are alternately connected to two adjacent data lines. For example, TFTs 131 within odd numbered horizontal lines supply data signals, applied to the 1st to mth the data lines DL1 to DLm, to liquid crystal cells arranged within the odd numbered horizontal lines while TFTs 131 within even numbered horizontal lines supply data signals, applied to the 2nd to (m+1)th data lines DL1 to DLm+1, to liquid crystal cells arranged within the even numbered horizontal lines. The LCD may further include a gate driver 134 for driving gate lines GL1 to GLn arranged on the liquid crystal display panel 132, a data driver 136 for driving data lines DL1 to DLm+1 also arranged on the liquid crystal display panel 132, and a timing controller 138 for controlling the gate driver 134 and the data driver 136.

In one aspect of the present invention, liquid crystal cells including TFTs 131 coupled to odd numbered gate lines GL1, GL3, GL5, . . . , GLn−1 may be coupled to adjacent ones of preceding data lines DL1 to DLm while liquid crystal cells including TFTs 131 coupled to the even numbered gate lines GL2, GL4, GL6, . . . , GLn may be coupled to adjacent ones of successive data lines DL2 to DLm+1. Gate electrodes of TFTs 131 may be connected to the gate lines GL1 to GLm. Source electrodes of TFTs 131 coupled to odd numbered gate lines may be connected to adjacent ones of preceding 1st to mth data lines DL1 to DLm while source electrodes of TFTs 131 coupled to even numbered gate lines may be connected to adjacent ones of successive 2nd to (m+1)th data lines DL2 to DLm+1. Drain electrodes of TFTs 131 coupled to odd numbered gate lines may be connected adjacent ones of successive pixel electrodes 133 drain electrodes of TFTs 131 coupled to even numbered gate lines may be connected adjacent ones of preceding pixel electrodes 133. Accordingly, odd numbered horizontal lines of liquid crystal cells Clc may be charged with data signals supplied from adjacent ones of preceding data lines DL1 to DLm while even numbered horizontal lines of liquid crystal cells Clc may be charged with data signals supplied from adjacent ones of successive the data lines DL2 to DLm+1.

Upon receiving horizontal/vertical synchronizing signals H and V in addition to a main clock MCLK, the timing controller 138 may, for example, simultaneously supply digital video data signals (RGB) to the data driver 136 and generate timing control signals (DDC) and (GDC) required by the data driver 136 and the gate driver 134, respectively. In one aspect of the present invention, the timing controller 138 may reproduce any of the digital video data signals (RGB) to generate dummy data DD1 and DD2 and may insert the dummy data DD1 and DD2 where blank data BK is inserted in the fourth aspect of the present invention.

In one aspect of the present invention, the timing controller 138 may, for example, include a control signal generator 141 for generating timing control signals, a pixel data aligner 142 for receiving digital video data signals, a counter 145 for counting input data, and a latch 146, register 143, and MUX 144 commonly connected to an output terminal of the pixel data aligner 142.

In one aspect of the present invention, the control signal generator 141 may generate gate control signals (GDC) (e.g., gate start pulse (GSP), gate shift clock (GSC), gate output enable signal (GOE), etc.), suitable for controlling the gate driver 134. In another aspect of the present invention, the control signal generator 121 may use the vertical and horizontal synchronizing signals V and H, in addition to a main clock MCLK, to generate data and data control signals (DDC) (e.g., data enable signals (DE), source shift clock (SSC), source start pulse (SSP), polarity control signal (POL), source output enable signal (SOE), etc.), suitable for controlling the data driver 136. Further, the control signal generator 141 may generate a clock signal required by the pixel data aligner 142 and an odd/even horizontal period indication signal (OESW) for controlling the MUX 144.

In one aspect of the present invention, the pixel data aligner 142 may output inputted digital video data signals (e.g., RGB) in response to a clock outputted from the control signal generator 141. Of the digital video data signals (RGB) outputted from the pixel data aligner 142, data outputted via the last output data bus may be commonly supplied to the register 143 and the MUX 144 while data outputted via output data buses other than the last output data bus may be supplied to the MUX 144. The pixel data aligner 142 may count the inputted digital video data signals (RGB) in response to a count signal outputted from the counter 145. When an mth digital video data signal has been detected, the pixel data aligner 142 may output the mth digital video data signal to the latch 146 during odd numbered horizontal periods. During even numbered horizontal periods, the pixel data aligner 142 may detect the first digital video data signal with the aid of the source start pulse (SSP) and apply the first digital video data signal to the latch 146.

In one aspect of the present invention, the latch 146 may temporarily store the mth video data outputted by the pixel data aligner 142 during odd numbered horizontal periods and output the stored mth video data to thereby generate a first dummy data DD1. The latch 146 may then apply the first dummy data DD1 to the MUX 144. Further, the latch 146 may temporarily store the mth video data outputted by the pixel data aligner 142 during even numbered horizontal periods and output the stored mth video data to thereby generate a second dummy data DD2. The latch 146 may then apply the second dummy data DD2 to the register 143.

In one aspect of the present invention, the register 143 may temporarily store data outputted by the last of the output data buses of the pixel data aligner 142 and output data stored during even numbered horizontal periods. In another aspect of the present invention, the register 143 may temporarily store the second dummy data DD2 outputted by the latch 146 and output the second dummy data DD2 stored during even numbered horizontal periods.

Figure 15A:
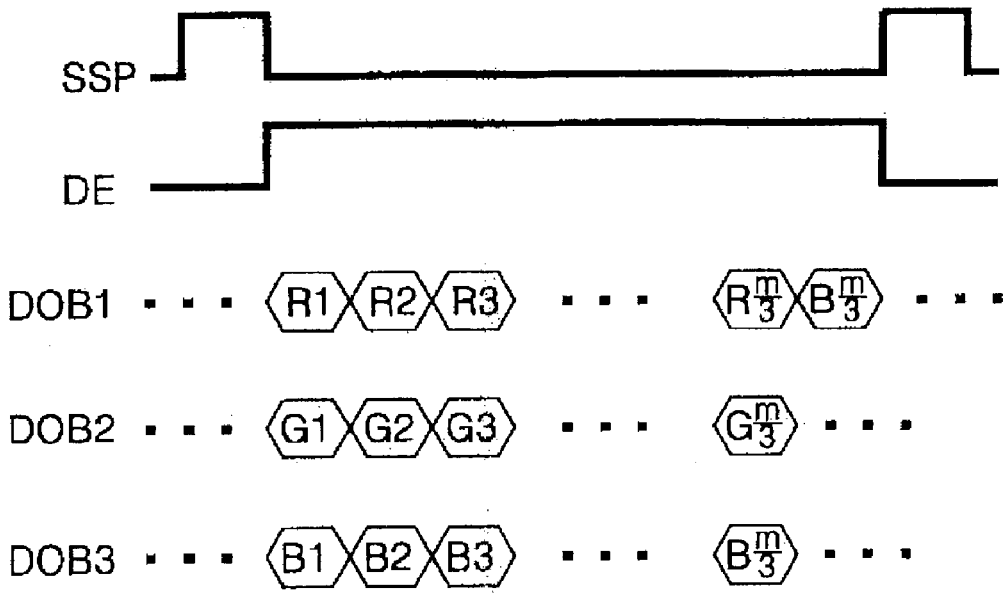
FIGS. 15A and 15B illustrate exemplary waveform diagrams of data outputted by the timing controller shown in FIG. 14.
Figure 15B:
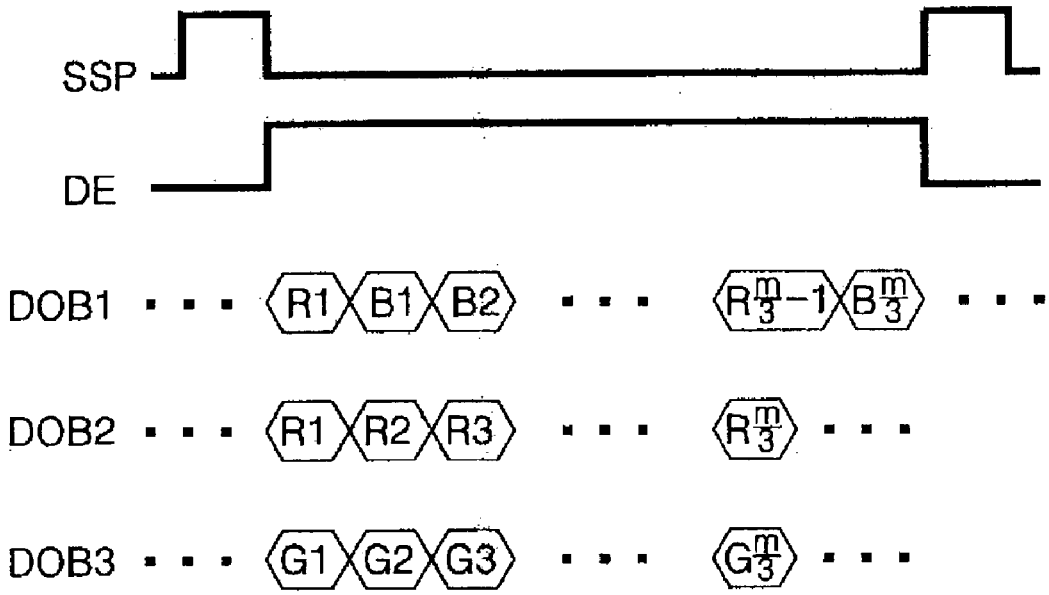
Figure 16A:
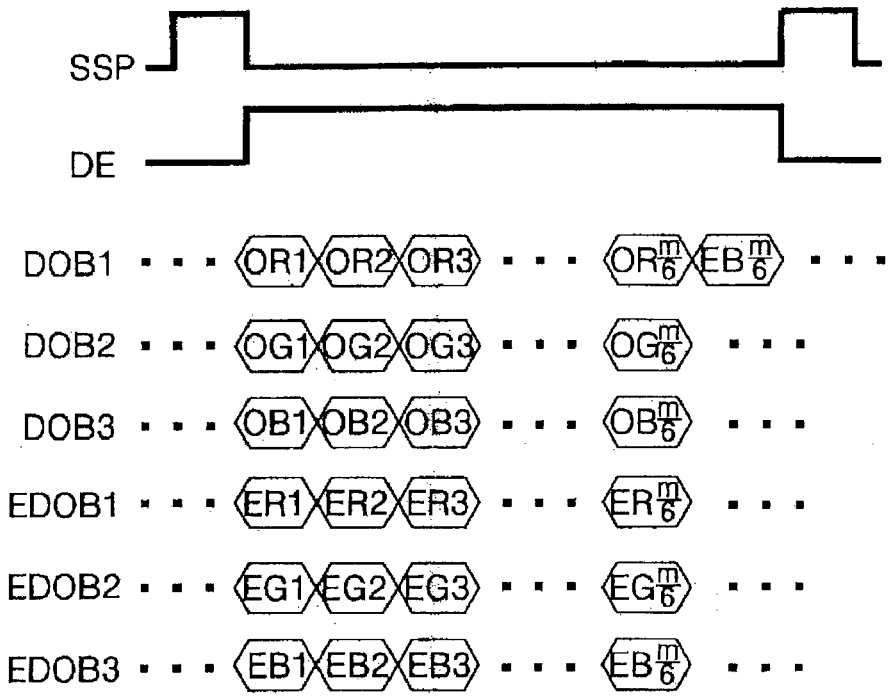
FIGS. 16A and 16B illustrate additional exemplary waveform diagrams of data outputted by the timing controller shown in FIG. 14.
Figure 16B:
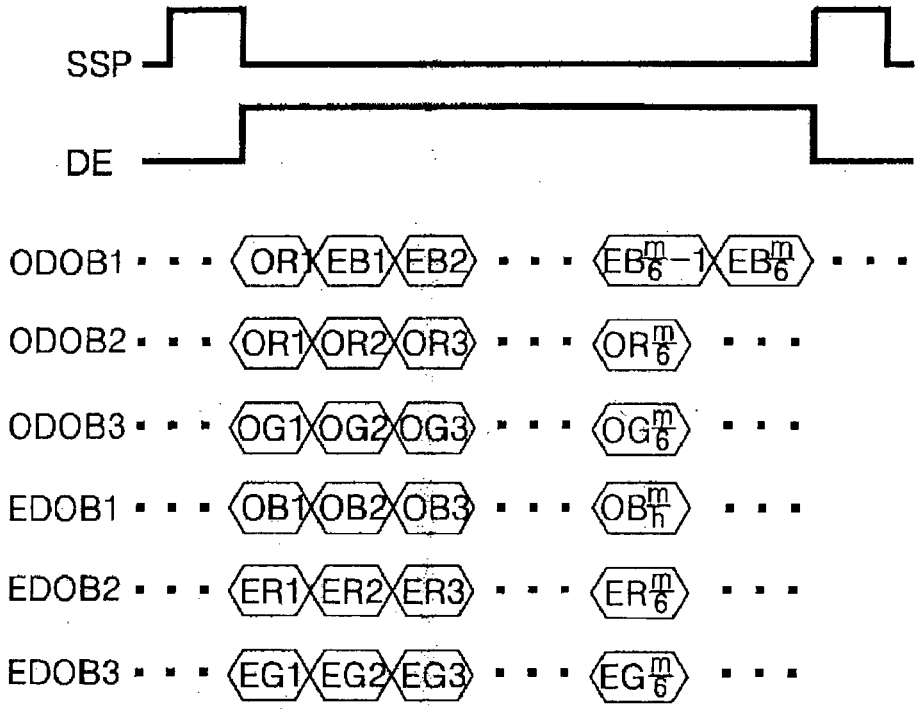

In one aspect of the present invention, the MUX 144 may output m digital video data signals outputted by the pixel data aligner 142 and the first dummy data DD1 outputted by the latch 146 in-situ during odd numbered horizontal periods in response to an odd/even horizontal indication signal outputted by the control signal generator 141. Data outputted by the MUX 144 during odd numbered horizontal periods are illustrated in FIGS. 15A and 16A. During even numbered horizontal periods, the MUX 144 may shift m digital video data signals outputted by the pixel data aligner 142 toward a successive one of the output data buses, output the shifted digital video data signals while outputting the last bus data, delayed by the register 143, and output the second dummy data DD2 via the first output data bus. Data outputted by the MUX 144 during even numbered horizontal periods are illustrated in FIG. 15B and FIG. 16B.

Using the gate start pulse (GSP), gate shift clock (GSC), and a gate output enable signal (GOE) generated by the timing controller 138, the gate driver 134 may sequentially apply a scanning pulse to the gate lines GL1 to GLn. The scanning pulse sequentially turns on horizontal lines of the TFTs 131 such that data signals may be applied to the TFTs 131 turned on within each sequentially selected horizontal line. The gate driver 134 may, for example, include a shift register for sequentially generating a scanning pulse and a level shifter for shifting a voltage swing width of the scanning pulse such that the voltage swing width is suitable for driving a liquid crystal cell Clc.

The data driver 136 may be configured in a substantially identical manner as the data driver illustrated in FIG. 10. Accordingly, the data driver 136 may apply m digital video data signals (RGB) outputted from the timing controller 138 to the 1st to mth data lines DL1 to DLm during odd numbered horizontal periods while applying the first dummy data DD1 to the (m+1)th data line DLm+1 using the data control signal (DDC) outputted from the timing controller 138. During even numbered horizontal periods, the data driver 136 may apply m digital video data RGB outputted from the timing controller 138 to the 2nd to (m+1)th data lines DL2 to DLm+1 while applying the second dummy data DD2 to the 1st data line DL1.

In one aspect of the present invention, the data driver 136 may convert m digital video data signals (RGB) in addition to dummy data DD1 and DD2 into positive gamma compensation voltages or negative gamma compensation voltages. Accordingly, the data driver 136 may convert the digital video data signals (RGB) and dummy data DD1 and DD2 into various analog pixel voltages. Polarities of the pixel voltages applied to adjacent data lines, converted into the various analog pixel voltages by the gamma compensation voltages, are inverted along the horizontal direction similar to the column inversion system. Accordingly, positive gamma compensation voltages and negative gamma voltages may be alternately applied to successively arranged data lines.

The polarities of the (m+1) pixel voltages are inverted by the column inversion system by means of the data driver 136 and are synchronized with the scanning pulse sequentially applied to n gate lines GL1 to GLn every horizontal period.

FIGS. 15A and 15B illustrate exemplary waveform diagrams of digital video data (RGB) outputted by the timing controller shown in FIG. 14 and the dummy data DD1 and DD2 applied, via three output buses, to the data driver 136.

Referring to FIG. 15A, during odd numbered horizontal periods, the timing controller 138 may simultaneously apply m/3 red digital video data R1, R2, R3, . . . , Rm/3, m/3 green digital video data G1, G2, G3, . . . , Gm/3, and m/3 blue digital video data B1, B2, B3, . . . , Bm/3 to the data driver 136 via the first output data bus DOB1, the second output data bus DOB2, the third output data bus DOB3, respectively. After m digital video data signals are applied to the data driver 136 via the first to third output data buses DOB1, DOB2 and DOB3, the timing controller 138 may apply a blue digital video data Bm/3 of the first dummy data DD1 to the data driver 136 via the first output data bus DOB1. During the data enable (DE) interval, m red, green, and blue digital video data R1, R2, R3, . . . , Rm/3, G1, G2, G3, . . . , Gm/3, and B1, B2, B3, . . . , Bm/3, respectively, may be inputted to the data driver 136 via the first to third output data buses DOB1, DOB2 and DOB3, respectively. Thereafter, a single one of the blue digital video data Bm/3 may be outputted to the data driver 136 via the first output data bus DOB1.

Since the first dummy data DD1 illustrated in FIG. 15A may be generated by delaying the output of blue digital video data Bm/3 at the last sequence at the third output data bus DOB3, the first dummy data DD1 may be substantially equal to the blue digital video data Bm/3.

Referring to FIG. 15B, during even numbered horizontal periods, the timing controller 138 may apply a red digital video data R1 of the second dummy data DD2 and m/3 blue digital video data B1, B2, B3 . . . . , Bm/3 to the data driver 136 via the first output data bus DOB1. In one aspect of the present invention, the timing controller 138 may apply m/3 red digital video data R1, R2, R3, . . . , Rm/3 and m/3 green digital video data G1, G2, G3, . . . , Gm/3 to the data driver 136 via the second output data bus DOB2 and the third output data bus DOB3, respectively. During the data enable (DE) interval, the first red digital video data R1 may be simultaneously outputted to the data driver 136 via the first output data bus DOB1 while the first red digital video data R1 and the first green digital video data GI are outputted to the data driver via the second and third output data buses DOB2 and DOB3, respectively. Subsequently, m/3 blue digital video data B1, B2, B3, . . . , Bm/3, delayed by the register 143 by one horizontal period, may be simultaneously outputted to the data driver 136 via the first output data bus DOB1, while red and green digital video data R2, R3, . . . , Rm/3 and G2, G3, . . . , Gm/3 may be outputted to the data driver 136 via the second and third output data buses DOB2 and DOB3, respectively.

The second dummy data DD2 illustrated in FIG. 15B, may include the first red digital video data R1 outputted via the second output data bus DOB2 after it has been latched.

FIGS. 16A and 16B illustrate additional exemplary waveform diagrams of digital video data (RGB) and dummy data DD1 and DD2 outputted by the timing controller 138 shown in FIG. 14 to the data driver 136 via six output data buses.

Referring to FIG. 16A, during odd numbered horizontal periods, the timing controller 138 may simultaneously apply m/6 odd red digital video data OR1, OR2, OR3, . . . , ORm/6, m/6 odd green digital video data OG1, OG2, OG3, . . . , OGm/6, and m/6 odd blue digital video data OB1, OB2, OB3, . . . , OBm/6 to the data driver 136 via the first odd output data bus ODOB1, the second odd output data bus ODOB2, and the third odd output data bus ODOB3, respectively. During odd numbered horizontal periods, the timing controller 138 may simultaneously apply m/6 even red digital video data ER1, ER2, ER3, . . . , ERm/6, m/6 even green digital video data EG1, EG2, EG3, . . . , EGm/6, and m/6 even blue digital video data EB1, EB2, EB3, . . . , EBm/6 to the data driver 136 via the first even output data bus EDOB1, the second even output data bus EDOB2, and the third even output data bus EDOB3, respectively. After m/2 odd digital video data and m/2 even digital video data are applied to the data driver 136 via the first to third odd output data buses ODOB1, ODOB2 and ODOB3 and the first to third even output data buses EDOB1, EDOB2 and EDOB3, respectively, the timing controller 138 may apply the first dummy data DD1 including a blue digital video data EBm/6 to the data driver 136 via the first odd output data bus ODOB1. During the data enable (DE) interval, m red, green, and blue digital video data OR1, OR2, OR3, . . . , ORm/6, OG1, OG2, OG3, . . . , OGm/6, OB1, OB2, OB3, . . . , OBm/6, ER1, ER2, ER3, . . . , ERm/6, EG1, EG2, EG3, . . . , EGm/6, and EB1, EB2, EB3, . . . , EBm/6 may be outputted to the data driver 136. Thereafter, the blue digital video data EBm/6 of the first dummy data DD1 is outputted to the data driver 136 via the first odd output data bus ODOB1.

In transitioning to even numbered horizontal periods, the timing controller 138 may shift a data bus to which a digital video data may be outputted to a successive one of an output data bus, one output data bus at a time. Also, the timing controller 138 may output the second dummy data DD2 via the first odd output data bus ODOB1 which was empty due to the shifting of the data bus.

Referring to FIG. 16B, during even numbered horizontal periods, the timing controller 138 may apply the second dummy data DD2 and then apply m/6 even blue digital video data EB1, EB2, EB3 . . . . , EBm/6, delayed by the register 143, to the data driver 136 via the first odd output data bus ODOB1. In one aspect of the present invention, the timing controller 138 may apply m/6 odd red digital video data OR1, OR2, OR3, . . . , ORm/6, m/6 odd green digital video data OG1, OG2, OG3, . . . , OGm/6, and m/6 odd blue digital video data OB1, OB2, OB3, . . . , OBm/6 to the data driver 136 via the second odd output data bus ODOB2, the third odd output data bus ODOB3, and the first even output data bus EDOB1, respectively. In one aspect of the present invention, the timing controller 138 may apply m/6 even red digital video data ER1, ER2, ER3, . . . , ERm/6, and m/6 even green digital video data EG1, EG2, EG3, . . . , EGm/6 to the data driver 136 via the second even output data bus EDOB2 via the third even output data bus EDOB3, respectively. During the data enable (DE) interval, the second dummy data DD2 may be simultaneously outputted to the data driver 136 via the first odd output data bus ODOB1 while the first odd red digital video data OR1 and the first odd green digital video data OG1 are outputted to the data driver 136 via the second and third odd output data buses ODOB2 and ODOB3, respectively, and while the first odd blue digital video data OB 1, the first even red digital video data ER1, and the first even green digital video data EG1 are outputted to the data driver 136 via the first to third even output data buses EDOB1, EDOB2 and EDOB3, respectively. Subsequently, m/6 even blue digital video data EB1, EB2, EB3, . . . , EBm/6, delayed by the register 143, may be simultaneously outputted to the data driver 136 via the first odd output data bus ODOB1, while the odd red, green, and blue digital video data OR2, OR3, . . . , ORm/6, OG2 and OG2, OG3, . . . , OGm/6, and OB2, OB3, . . . , OBm/6 and even red and green digital video data ER2, ER3, . . . , ERm/6 and EG2, EG3, . . . , EGm/6, respectively, are outputted to the data driver 136 via the second and third odd output data buses ODOB2 and ODOB3 and the first to third even output data buses EDOB1, EDOB2, and EDOB3, respectively.

Figure 17A:
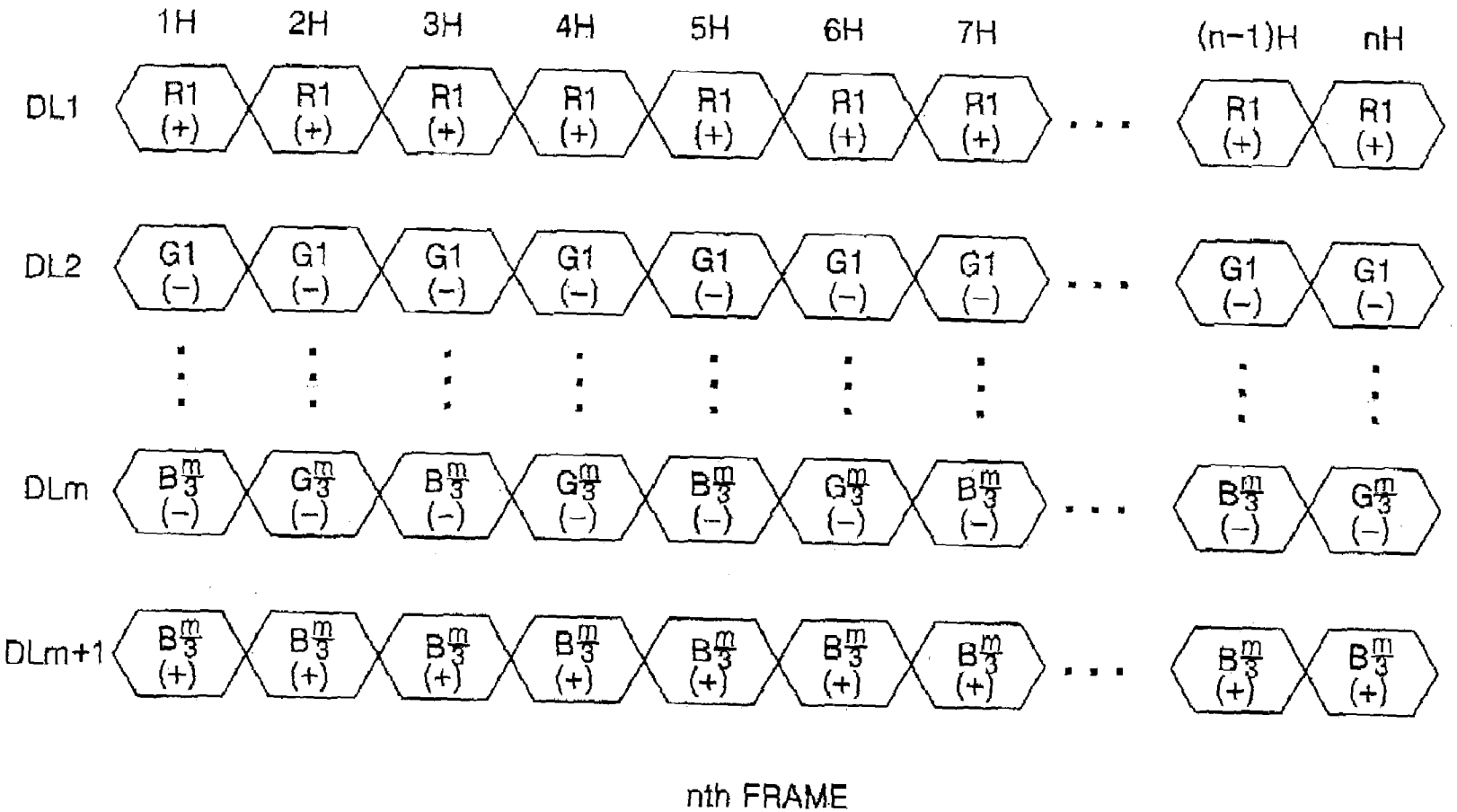
FIGS. 17A and 17B illustrate waveform diagrams of data applied to the liquid crystal display panel shown in FIG. 14.
Figure 17B:
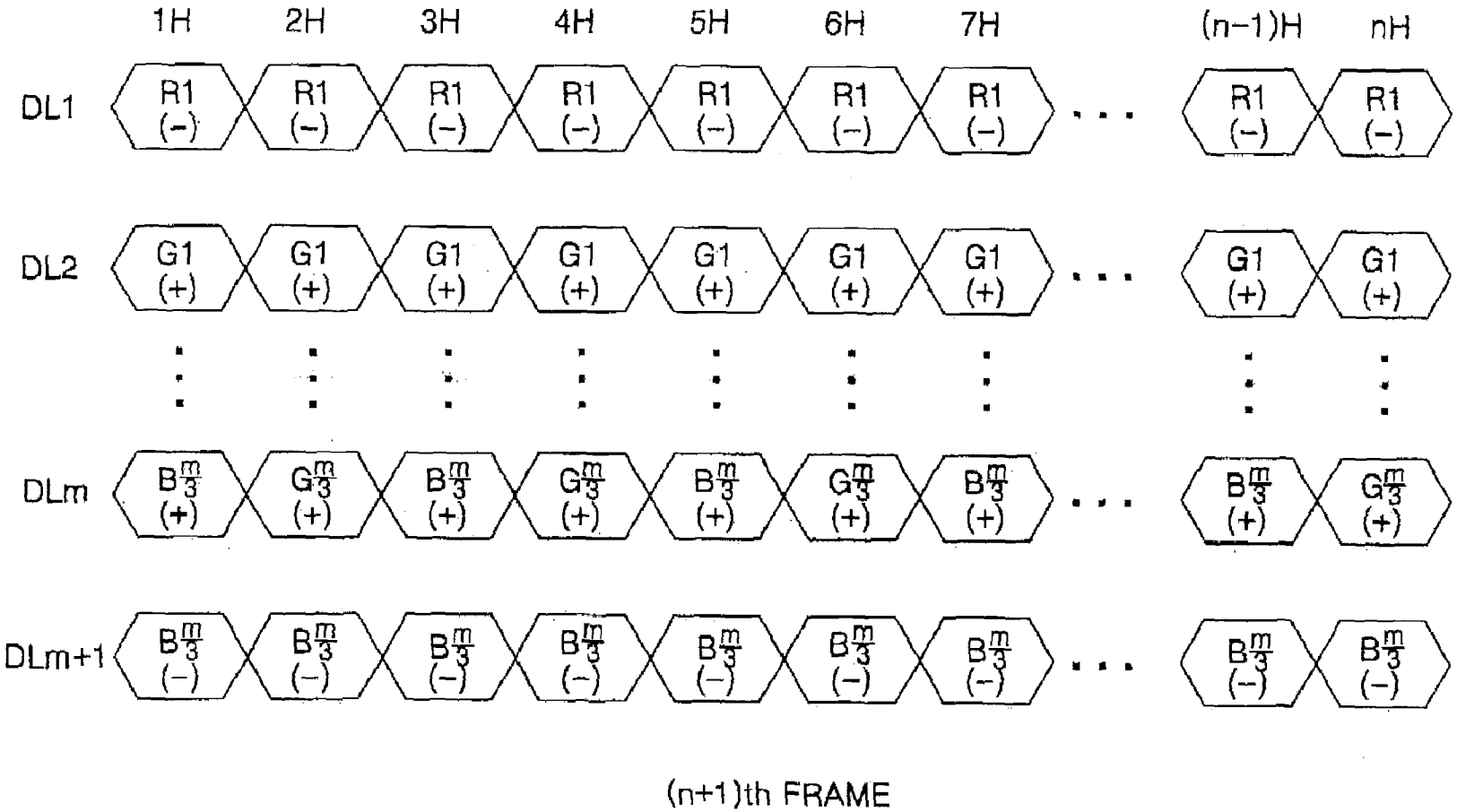

FIGS. 17A and 17B illustrate waveform diagrams of data applied to data lines DL1 to DLm+1 of the liquid crystal display panel 132 shown in FIG. 14 during the nth and the (n+1)th frame intervals.

Referring to FIG. 17A, during odd numbered horizontal periods 1H, 3H, . . . , (n−1)H at the nth frame, red, green, and blue pixel voltages R1, G1, . . . , Bm/3 may be applied to the 1st to mth data lines DL1 to DLm while the last blue pixel voltage Bm/3 may be applied to the (m+1)th data line DLm+1. In one aspect of the present invention, the blue pixel voltage Bm/3 applied to the (m+1)th data line DLm+1 may comprise a pixel voltage reproduced by a delay of the blue pixel voltage Bm/3 applied to the mth data line DLm. During even numbered horizontal periods 2H, 4H, . . . , nH in the nth frame, red, green, and blue pixel voltages may be applied to the 2nd to (m+1)th data lines DL2 to DLm+1 while the first red pixel voltage R1 may be applied to the 1st data line DL1. In one aspect of the present invention, the red pixel voltage R1 applied to the 1st data line DL1 may comprise a pixel voltage equal to the first red pixel voltage R1 applied to the 2nd data line DL2 that has been reproduced. In another aspect of the present invention, a positive voltage may be applied to the odd data lines DL1, DL3, DL5, . . . , DLm−1, and DLm+1 while a negative pixel voltage may be applied to even data lines DL2, DL4, DL6, . . . , DLm−2, and DLm in the nth frame interval. In another aspect of the present invention, a polarity of the pixel voltage applied to each data line DL1 to DLm+1 may be inverted in transitioning to the (n+1)th frame, as shown in FIG. 17B.

Referring to FIG. 17B, during odd numbered horizontal periods 1H, 3H, . . . , (n−1)H in the (n+1)th frame, red, green, and blue pixel voltages R1, G1, . . . , Bm/3 may be applied to the 1st to mth data lines DL1 to DLm while the last blue pixel voltage Bm/3 may be applied to the (m+1)th data line DLm+1. During even numbered horizontal periods 2H, 4H, . . . , nH in the (n+1)th frame, red, green, and blue pixel voltages R1, G1, . . . , Bm/3 may be applied to the 2nd to (m+1)th data lines DL2 to DLm+1 while the first red pixel voltage R1 may be applied to the 1st data line DL1. In one aspect of the present invention, negative pixel voltage may be applied to the odd data lines DL1, DL3, DL5, DLm−1, and DLm+1 while positive pixel voltage may be applied to the even data lines DL2, DL4, DL6, . . . , DLm−2, and DLm in the (n+1)th frame.

Figure 18:
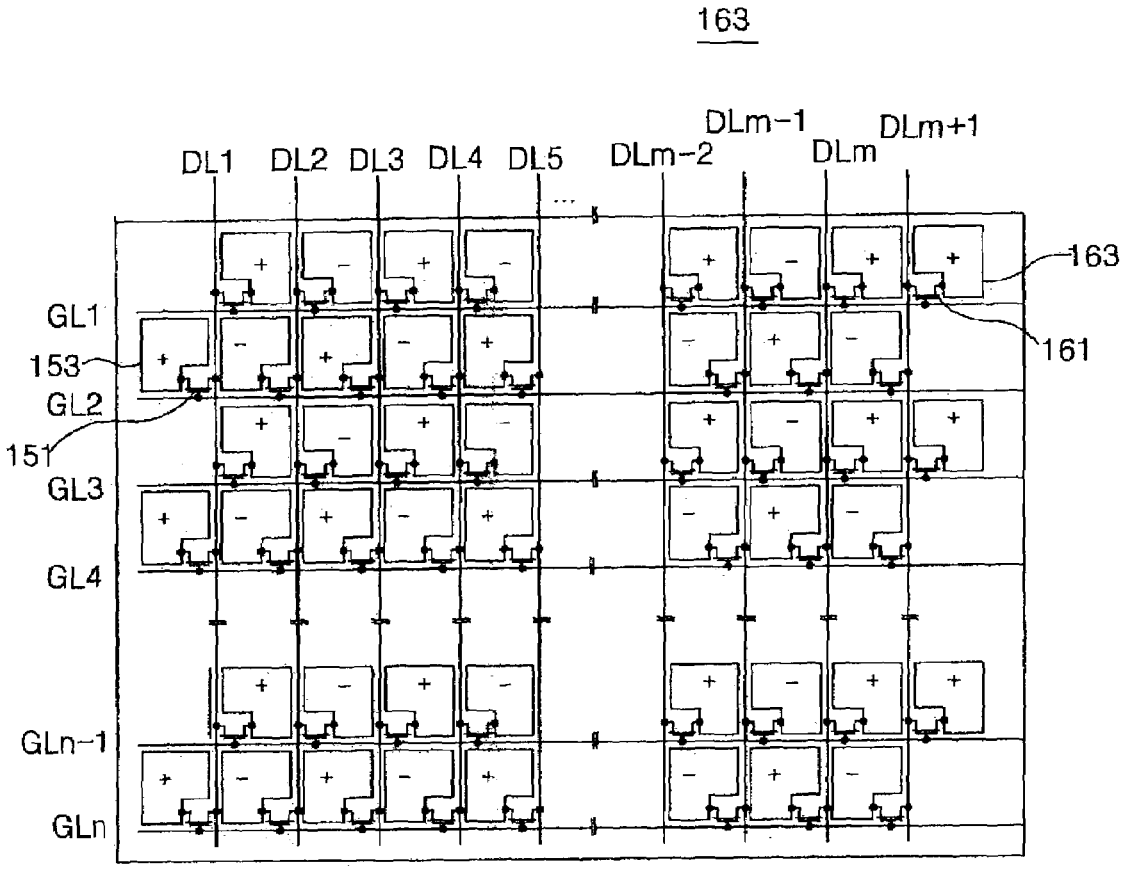
FIG. 18 illustrates a schematic view of a liquid crystal display according to a fourth aspect of the present invention.

FIG. 18 illustrates a schematic view of a liquid crystal display according to a fourth aspect of the present invention.

Referring to FIG. 18, the LCD may, for example, include a liquid crystal display panel 162 having a plurality of gate lines GL1 to GLn, a plurality of successively arranged data lines DL1 to DLm+1 arranged to cross the plurality of gate lines, and a plurality of liquid crystal cells Clc arranged in a matrix pattern at crossings of the gate and data lines. Each of the liquid crystal cells may include a TFT connected to a pixel electrode for driving each liquid crystal cell. In one aspect of the present invention, consecutive ones of TFTs arranged within a column of liquid crystal cells are alternately connected to two adjacent data lines. In another aspect of the present invention, dummy TFTs 151 and 161 may be alternately provided at left and right edges of the liquid crystal display panel 162 and be connected to corresponding ones of dummy pixel electrodes 153 and 163, respectively.

In one aspect of the present invention, liquid crystal cells including TFTs coupled to odd numbered gate lines GL1, GL3, GL5, . . . , GLn−1 may be coupled to adjacent ones of preceding data lines DL1 to DLm while liquid crystal cells including TFTs coupled to even numbered gate lines GL2, GL4, GL6, . . . , GLn may be coupled to adjacent ones of successive data lines DL2 to DLm+1. In another aspect of the present invention, dummy liquid crystal cells, adjacent only one data line, may be provided within the LCD. Dummy liquid crystal cells arranged within odd numbered horizontal lines of liquid crystal cells may, for example, include dummy TFTs 161 coupled to odd numbered gate lines and preceding adjacent (m+1)th data line DLm+1. Dummy liquid crystal cells arranged within even numbered horizontal lines of liquid crystal cells may, for example, include dummy TFTs 151 coupled to even numbered gate lines and successive adjacent 1st data line DL1. Gate electrodes of TFTs included within odd numbered horizontal lines of liquid crystal cells and within dummy TFTs 161 may be connected to the odd gate lines GL1, GL3, . . . , GLn−1. Gate electrodes of TFTs included within even numbered horizontal lines of liquid crystal cells and within dummy TFTs 151 may be connected to the even gate lines GL2, GL4, . . . , GLn. Source electrodes of TFTs included within odd numbered horizontal lines of liquid crystal cells and within dummy TFTs 161 may be connected to adjacent ones of preceding data lines DL1 to DLm+1. Source electrodes of TFTs included within even numbered horizontal lines of liquid crystal cells and within dummy TFTs 151 may be connected to adjacent ones of successive data lines DL1 to DLm+1 positioned at the right side on a basis of themselves. Drain electrodes of TFTs included within odd numbered horizontal lines of liquid crystal cells and within dummy TFTs 161 may be connected to adjacent ones of successive pixel electrodes and dummy pixel electrodes 163, respectively, while drain electrodes of TFTs included within even numbered horizontal lines of liquid crystal cells and within dummy TFTs 151 may be connected to adjacent ones of preceding pixel electrodes and dummy pixel electrodes 153, respectively. Accordingly, odd numbered horizontal lines of liquid crystal cells Clc may be charged with data signals supplied from adjacent ones of preceding data lines DL1 to DLm+1 while even numbered horizontal lines of liquid crystal cells Clc may be charged with data signals supplied from adjacent ones of successive data lines DL1 to DLm+1.

In one aspect of the present invention, the dummy pixel electrode 163 may be supplied with a dummy data voltage including, for example, a blue pixel voltage Bm/3 obtained by reproducing the last blue pixel voltage Bm/3 in a manner similar to that shown in FIGS. 17A and 17B. In another aspect of the present invention, the dummy pixel electrode 153 may be supplied with a dummy data voltage including, for example, a red pixel voltage R1 obtained by reproducing the first red pixel voltage R1 in a manner similar to that shown in FIGS. 17A and 17B. Accordingly, liquid crystal cells Clc arranged within odd numbered horizontal lines and connected to the last of successively arranged data lines, in addition to liquid crystal cells Clc arranged within even numbered horizontal lines and connected to the first of successively arranged data lines, comprise non-display liquid crystal cells where pictures are not displayed.

In one aspect of the present invention, dummy data may be applied to the first data line DL1 and the last (m+1)th data line DLm+1 by reproducing data applied to adjacent data lines so that voltage swing widths of the first data line DL1 and the last (m+1)th data line DLm+1 may be reduced compared to the blank data voltage. Dummy liquid crystal cells connected to the (m+1)th data line DLm+1 are provided at the rightmost portion of odd numbered horizontal lines and dummy liquid crystal cells connected to the 1st data line DL1 are provided at the leftmost portion of even horizontal numbered lines. Accordingly, dummy data voltages applied to the 1st data line DL1 and the (m+1)th data line DLm+1 may be applied to the dummy liquid crystal cells in a manner similar to the other adjacent data lines DL2 to DLm. Furthermore, a load variation within the 1st data line DL1 and the (m+1)th data line DLm+1 may be reduced and power consumption by the LCD may be reduced.

Figure 19:
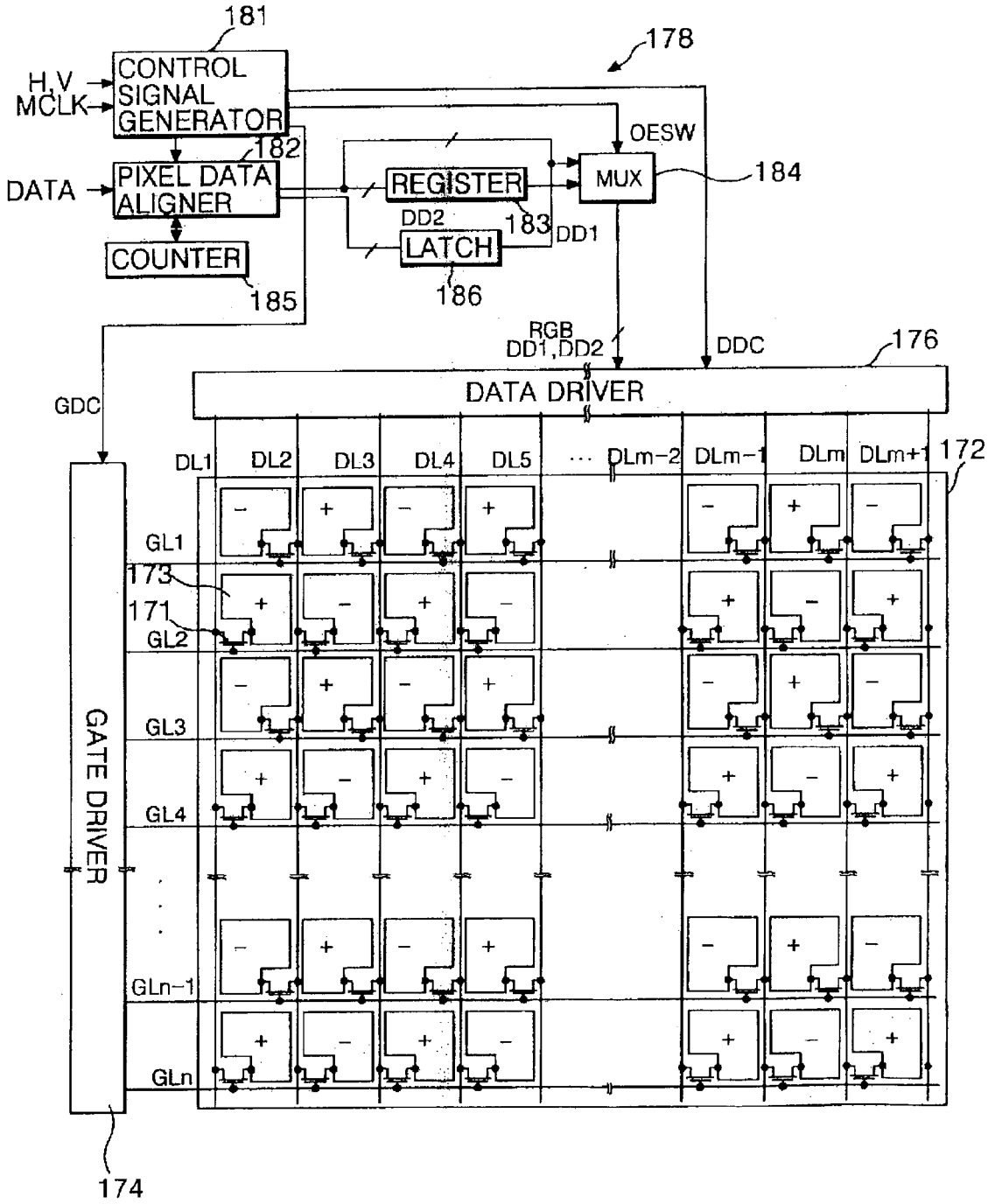
FIG. 19 illustrates a schematic view of a liquid crystal display according to a fifth aspect of the present invention.

FIG. 19 illustrates a schematic view of a liquid crystal display according to a fifth aspect of the present invention.

Referring to FIG. 19, the LCD may, for example, include a liquid crystal display panel 172 having a plurality of gate lines GL1 to GLn, a plurality of successively arranged data lines DL1 to DLm+1 arranged to cross the plurality of gate lines, and a plurality of liquid crystal cells Clc arranged in a matrix pattern at crossings of the gate and data lines. Each of the liquid crystal cells may include a TFT 171 for driving each liquid crystal cell. In one aspect of the present invention, consecutive ones of the TFTs 171 arranged within a column of liquid crystal cells are alternately connected to two adjacent data lines. For example, TFTs 171 within odd numbered horizontal lines supply data signals, applied to the 2nd to (m+1)th data lines DL2 to DLm+1, to liquid crystal cells arranged within the odd numbered horizontal lines while TFTs 171 within even numbered horizontal lines supply data signals, applied to the 1st to mth data lines DL1 to DLm, to the liquid crystal cells arranged within the even numbered horizontal lines. The LCD may further include a gate driver 174 for driving gate lines GL1 to GLn arranged on the liquid crystal display panel 172, a data driver 176 for driving data lines DL1 to DLm+1 also arranged on the liquid crystal display panel 172, and a timing controller 178 for controlling the gate driver 174 and the data driver 176.

In one aspect of the present invention, liquid crystal cells including TFTs 171 coupled to odd numbered gate lines GL1, GL3, GL5, . . . , GLn−1 may be coupled to adjacent ones of successive data lines DL2 to DLm+1 while liquid crystal cells including TFTs 171 coupled to even numbered gate lines GL2, GL4, GL6, . . . , GLn may be coupled to adjacent ones of preceding data lines DL1 to DLm. Gate electrodes of TFTs 171 may be connected to the gate lines GL1 to GLm. Source electrodes of the TFTs 171 coupled to odd numbered gate lines may be connected to adjacent ones of successive 2nd to (m+1)th data lines DL1 to DLm while source electrodes of TFTs 171 coupled to even numbered gate lines may be connected to adjacent ones of preceding 1st to mth data lines DL1 to DLm. Drain electrodes of TFTs 171 coupled to odd numbered gate lines may be connected to adjacent ones of preceding pixel electrodes 173 while drain electrodes of TFTs 171 coupled to even numbered gate lines may be connected to adjacent ones of successive pixel electrodes 173. Accordingly, odd numbered horizontal lines of liquid crystal cells Clc may be charged with data signals supplied from the adjacent ones of successive data lines DL2 to DLm+1 while even numbered horizontal lines of liquid crystal cells Clc may be charged with data signals supplied from adjacent ones of preceding data lines DL1 to DLm.

Upon receiving horizontal/vertical synchronizing signals H and V in addition to a main clock MCLK, the timing controller 178 may, for example, simultaneously supply digital video data signals (RGB) to the data driver 176 and generate timing control signals (DDC) and (GDC) required by the data driver 176 and the gate driver 174, respectively. In one aspect of the present invention, the timing controller 178 may reproduce any of the digital video data signals (RGB) to generate dummy data DD1 and DD2 and may output the dummy data DD1 and DD2 in alternation.

In one aspect of the present invention, the timing controller 178 may, for example, include a control signal generator 181 for generating timing control signals, a pixel data aligner 182 for receiving digital video data signals, a counter 185 for counting input data, and a latch 186, a register 183, and MUX 184 commonly connected to an output terminal of the pixel data aligner 182.

In one aspect of the present invention, the control signal generator 181 may generate gate control signals (GDC) (e.g., gate start pulse (GSP), gate shift clock (GSC), gate output enable signal (GOE), etc.), suitable for controlling the gate driver 174. In another aspect of the present invention, the control signal generator 181 may use the vertical and horizontal synchronizing signals V and H, in addition to a main clock MCLK, to generate data and data control signals (DDC) (e.g., data enable signals (DE), source shift clock (SSC), source start pulse (SSP), polarity control signal (POL), source output enable signal (SOE), etc.), suitable for controlling the data driver 176. Further, the control signal generator 181 may generate a clock signal required by the pixel data aligner 182 and an odd/even horizontal period indication signal (OESW) for controlling the MUX 184.

In one aspect of the present invention, the pixel data aligner 182 may output inputted digital video data signals (e.g., RGB) in response to a clock outputted from the control signal generator 181. Of the digital video data signals (RGB) outputted from the pixel data aligner 182, data outputted via the last output data bus may be commonly supplied to the register 183 and the MUX 184 while data outputted via output data buses other than the last output data bus may be supplied to the MUX 184. The pixel data aligner 182 may detect a first digital video data signal with the aid of the source start pulse (SSP) and apply the first digital video data signal to the latch 186 during odd numbered horizontal periods. During even numbered horizontal periods, the pixel data aligner 142 counts the inputted digital video data signals (RGB) in response to a count signal outputted from the counter 185. When an mth digital video data is detected, the pixel data aligner 142 may apply the mth digital video data to the latch 186.

In one aspect of the present invention, the latch 186 may temporarily store the first video data outputted by the pixel data aligner 182 during odd numbered horizontal periods and outputs the stored first video data to thereby generating a second dummy data DD2. The latch 186 may then apply the second dummy data DD2 to the register 183. Further, the latch 186 may temporarily store the mth video data outputted by the pixel data aligner 142 during even numbered horizontal periods and output the stored mth video data to thereby generate a first dummy data DD1. The latch 186 may then apply the first dummy data DD1 to the MUX 184.

In one aspect of the present invention, the register 183 may temporarily store a data outputted by the last of the output data buses of the pixel data aligner 142 and output the stored data during odd numbered horizontal periods. In another aspect of the present invention, the register 183 may temporarily store the second dummy data DD2 outputted by the latch 186 and then output the second dummy data DD2 stored during odd numbered horizontal periods.

In one aspect of the present invention, the MUX 184 may shift m digital video data signals inputted from the pixel data aligner 182 toward a successive one of the output data buses, output the shifted m digital video data signals while outputting the last bus data, delayed by the register 183, and output the second dummy data DD2 via the first output data bus during odd numbered horizontal periods in response to an odd/even horizontal indication signal (OESW) outputted by the control signal generator 181. Data outputted from the MUX 184 during odd numbered horizontal periods are illustrated in FIGS. 15B and 16B. During even numbered horizontal periods, the MUX 184 may output the m digital video data signals and the first dummy data DD1 outputted by the latch 186 in-situ (e.g., without being shifted). Data outputted from the MUX 184 during even numbered horizontal periods are shown in FIGS. 15A and 16A.

Using the gate start pulse (GSP), gate shift clock (GSC), and a gate output enable signal (GOE) generated by the timing controller 178, the gate driver 174 may sequentially apply a scanning pulse to the gate lines GL1 to GLn. The scanning pulse sequentially turns on horizontal lines of the TFTs 171 such that data signals may be applied to the TFTs 171 turned on within each sequentially selected horizontal line. The gate driver 174 may, for example, include a shift register for sequentially generating a scanning pulse and a level shifter for shifting a voltage swing width of the scanning pulse such that the voltage swing width is suitable for driving a liquid crystal cell Clc.

The data driver 176 may be configured in a substantially identical manner as the data driver illustrated in FIG. 10. Accordingly, the data driver 176 may apply m digital video data signals (RGB) outputted from the timing controller 178 to the 2nd to (m+1)th data lines DL2 to DLm+1 during odd numbered horizontal periods using the data control signal (DDC) outputted from the timing controller 178 while applying the second dummy data DD2 to the 1st data line DL1. During even numbered horizontal periods, the data driver 176 may apply m digital video data RGB outputted from the timing controller 178 to the 1st to mth data lines DL1 to DLm while applying the first dummy data DD1 to the (m+1)th data line DLm+1.

In one aspect of the present invention, the data driver 176 may convert m digital video data signals (RGB) in addition to dummy data DD1 and DD2 into positive gamma compensation voltages or negative gamma compensation voltages. Accordingly, the data driver 176 may convert the digital video data signals (RGB) and the dummy data DD1 and DD2 into various analog pixel voltages. Polarities of the pixel voltages applied to adjacent lines, converted into the various analog pixel voltages by the gamma compensation voltages, are inverted along the horizontal direction similar to the column inversion system. Accordingly, positive gamma compensation voltage and negative gamma voltages may be alternately applied to successively arranged data lines.

The polarities of the (m+1) pixel voltages are inverted by the column inversion system by means of the data driver 176 and are synchronized with the scanning pulse sequentially applied n gate lines GL1 to GLn every horizontal period.

Figure 20A:
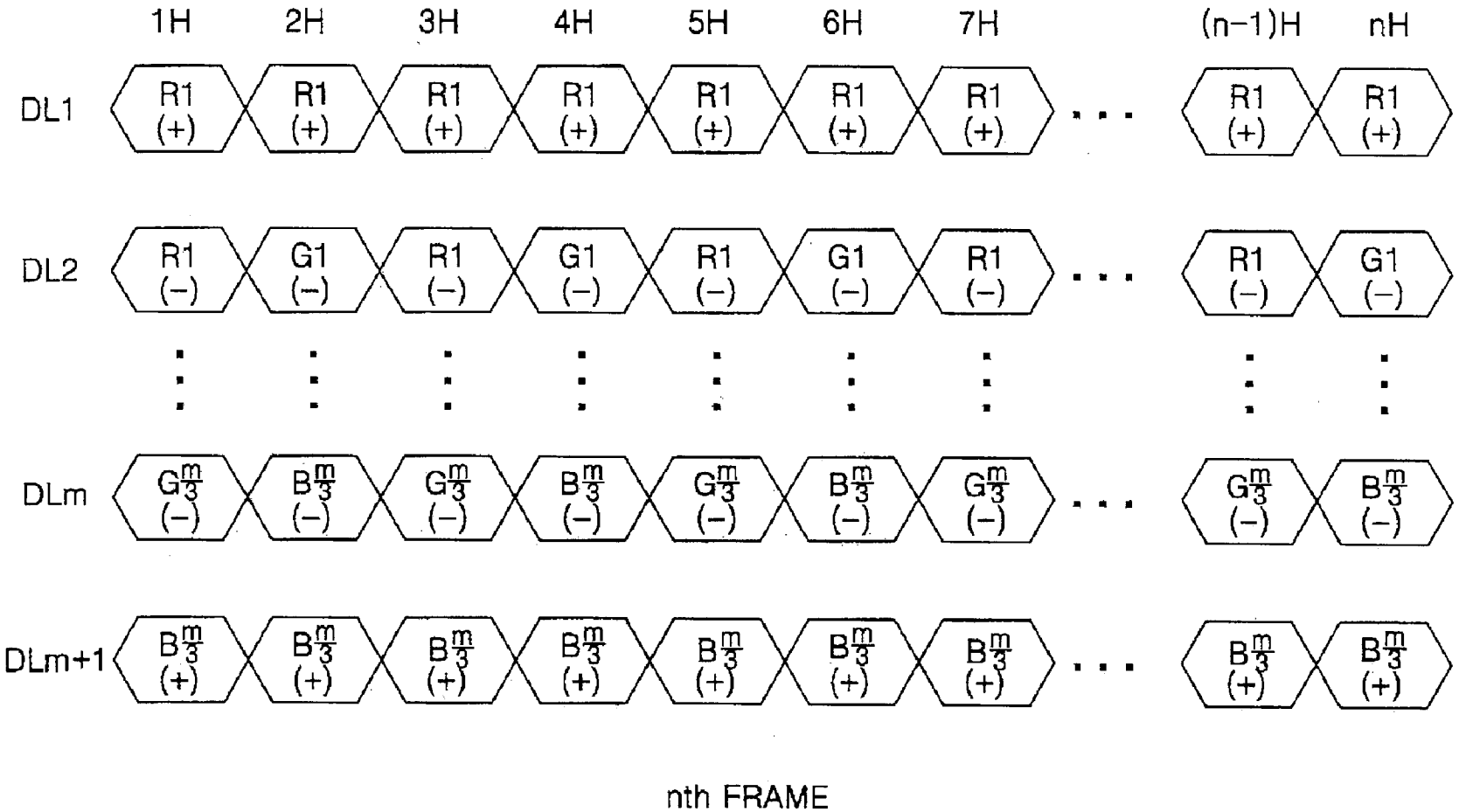
FIGS. 20A and 20B illustrate waveform diagrams of data applied to the liquid crystal display panel shown in FIG. 19.
Figure 20B:
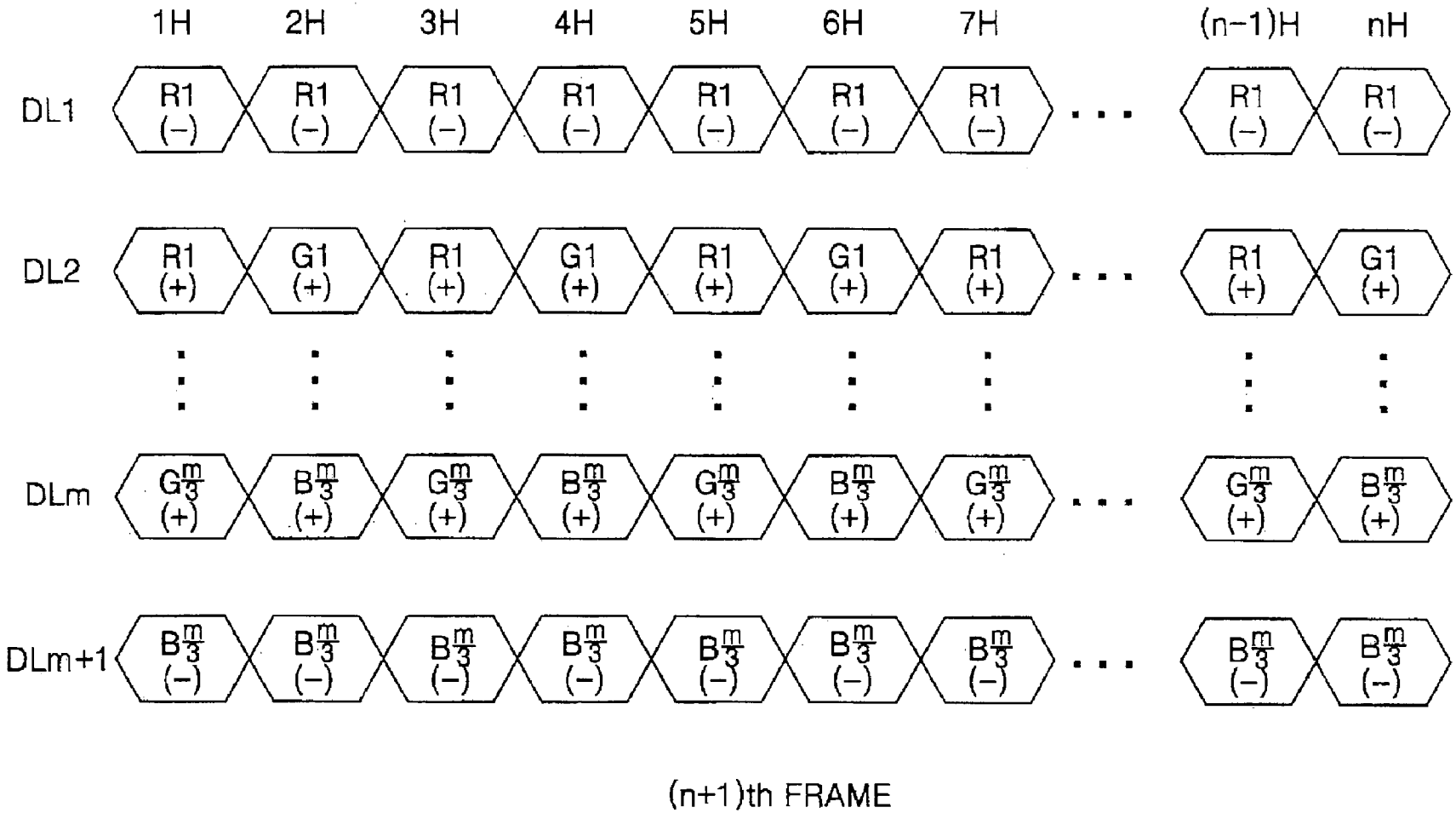

FIGS. 20A and 20B illustrate waveform diagrams of data applied to data lines DL1 to DLm+1 of the liquid crystal display panel 172 shown in FIG. 19 during the nth and the (n+1)th frame intervals.

Referring to FIG. 20A, during odd numbered horizontal periods 1H, 3H, . . . , (n−1)H at the nth frame, red, green and blue pixel voltages R1, G1, . . . , Bm/3 may be applied to the 2nd to (m+1)th data lines DL1 to DLm+1 while the first red pixel voltage R1 may be applied to the 1st data line DL1. In one aspect of the present invention, the red pixel voltage R1 applied to the 1st data line DL1 may comprise a pixel voltage wherein the first pixel voltage R1 applied to the 2nd data line DL2 has been reproduced. During even numbered horizontal periods 2H, 4H, . . . , nH in the nth frame, red, green, and blue pixel voltages R1, G1, . . . , Bm/3 may be applied to the 1st to mth data lines DL1 to DLm while the last mth blue pixel voltage Bm/3 may be applied to the (m+1)th data line DLm+1. In one aspect of the present invention, the blue pixel voltage Bm/3 applied to the (m+1) th data line DLm+1 may comprise a pixel voltage wherein the last blue pixel voltage Bm/3 applied to the mth data line DLm has been reproduced. In another aspect of the present invention, a positive pixel voltage may be applied to odd data lines DL1, DL3, DL5, . . . , DLm−1, and DLm+1 while a negative pixel voltage may be applied to even data lines DL2, DL4, DL6, . . . , DLm−2, and DLm in the nth frame interval. In another aspect of the present invention, a polarity of the pixel voltages applied to each data line DL1 to DLm+1 may be inverted in transitioning to the (n+1)th frame, as shown in FIG. 20B.

Referring to FIG. 20B, during odd numbered horizontal periods 1H, 3H, . . . , (n−1)H in the (n+1)th frame, red, green, and blue pixel voltages R1, G1, . . . , Bm/3 may be applied to the 2nd to (m+1)th data lines DL2 to DLm+1 while the last red pixel voltage R1 may be applied to the 1st data line DL1. During even numbered horizontal periods 2H, 4H, . . . , nH in the (n+1)th frame, red, green, and blue pixel voltages R1, G1, . . . , Bm/3 may be applied to the 1st to mth data lines DL1 to DLm while the last blue pixel voltage Bm/3 may be applied to the (m+1)th data line DLm+1. In one aspect of the present invention, a negative pixel voltage may be applied to the odd data lines DL1, DL3, DL5, DLm−1, and DLm+1 while a positive pixel voltage may be applied to the even data lines DL2, DL4, DL6, . . . , DLm−2, and DLm in the (n+1)th frame interval.

Figure 21:
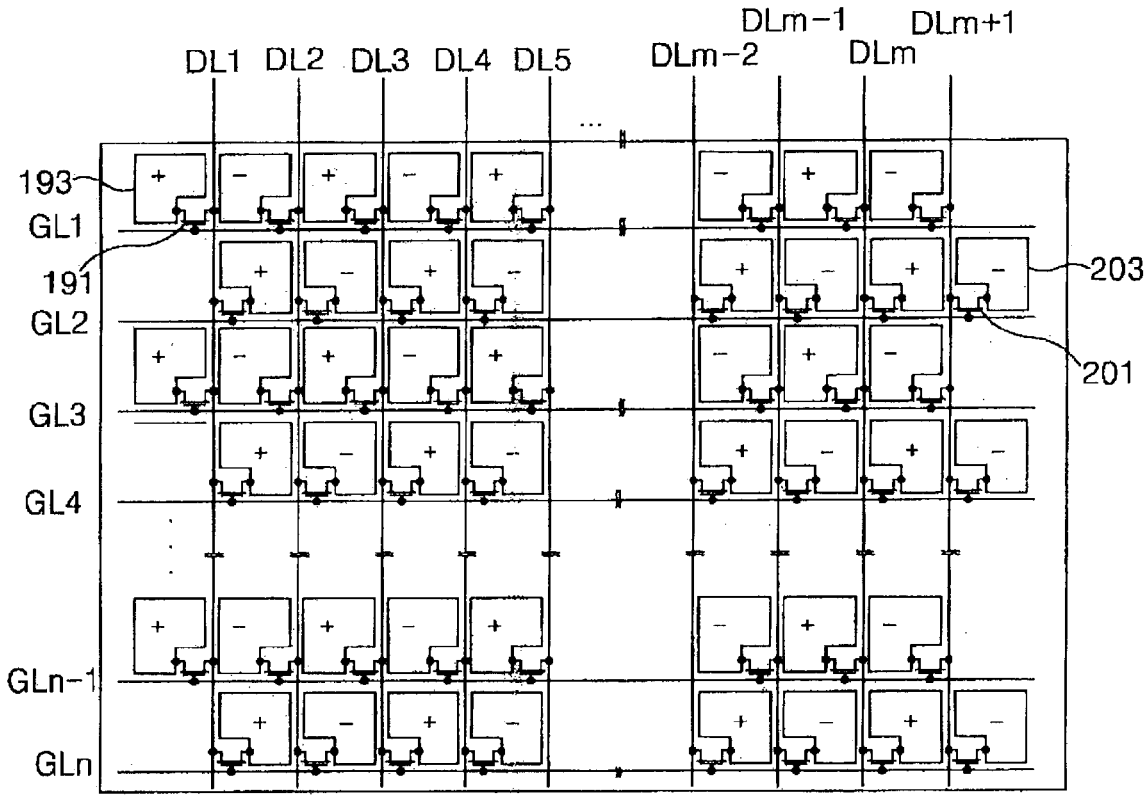
FIG. 21 illustrates a schematic view of a liquid crystal display according to a sixth aspect of the present invention.

FIG. 21 illustrates a schematic view of a liquid crystal display according to a sixth aspect of the present invention.

Referring to FIG. 21, the LCD may, for example, include a liquid crystal display panel 192 having a plurality of gate lines GL1 to GLn, a plurality of successively arranged data lines DL1 to DLm+1 arranged to cross the plurality of gate lines, and a plurality of liquid crystal cells Clc arranged in a matrix pattern at crossings of the gate and data lines. Each of the liquid crystal cells may include a TFT connected to a pixel electrode for driving each liquid crystal cell. In one aspect of the present invention, consecutive ones of TFTs arranged within a column of liquid crystal cells are alternately connected to two adjacent data lines. In another aspect of the present invention, dummy TFTs 191 and 201 may be alternately provided at left and right edges of the liquid crystal display panel 192 and be connected to corresponding ones of dummy pixel electrodes 193 and 203, respectively.

In one aspect of the present invention, liquid crystal cells including TFTs coupled to odd numbered gate lines GL1, GL3, GL5, . . . , GLn−1 may be coupled to adjacent ones of successive data lines DL2 to DLm+1 while liquid crystal cells including TFTs coupled to even numbered gate lines GL2, GL4, GL6, . . . , GLn may be coupled to adjacent ones of preceding data lines DL1 to DLm. In another aspect of the present invention, dummy liquid crystal cells, adjacent only one data line, may be provided within the LCD. Dummy liquid crystal cells arranged within odd numbered horizontal lines of liquid crystal cells may, for example, include dummy TFTs 191 coupled to odd numbered gate lines and successive adjacent 1st data line DL1. Dummy liquid crystal cells arranged within even numbered horizontal lines of liquid crystal cells may, for example, include dummy TFTs 201 coupled to even numbered gate lines and preceding adjacent (m+1)th data line DLm+1. Gate electrodes of TFTs included within odd numbered horizontal lines of liquid crystal cells and within dummy TFTs 191 may be connected to adjacent ones of successive data lines. Gate electrodes of TFTs included within even numbered horizontal lines of liquid crystal cells and within dummy TFTs 201 may be connected to adjacent ones of preceding data lines. Source electrodes of TFTs included within odd numbered horizontal lines of liquid crystal cells and within dummy TFTs 191 may be connected to adjacent ones of successive data lines DL1 to DLm+1. Source electrodes of TFTs included within even numbered horizontal lines of liquid crystal cells and within dummy TFTs 201 may be connected to adjacent ones of preceding data lines DL1 to DLm+1. Drain electrodes of TFTs included within odd numbered horizontal lines of liquid crystal cells and within dummy TFTs 191 may be connected to adjacent ones of preceding pixel electrodes and dummy pixel electrodes 193, respectively, while drain electrodes of TFTs included within even numbered horizontal lines of liquid crystal cells and within dummy TFTs 201 may be connected to adjacent ones of successive pixel electrodes and dummy pixel electrodes 203, respectively. Accordingly, odd numbered horizontal lines of liquid crystal cells Clc may be charged with data signals supplied from adjacent ones of successive data lines DL1 to DLm+1 while even numbered horizontal lines of liquid crystal cells Clc may be charged with data signals supplied from adjacent ones of preceding data lines DL1 to DLm+1.

In one aspect of the present invention, the dummy pixel electrode 193 may by supplied with a dummy data voltage including, for example, a red pixel voltage R1 obtained by reproducing the first red pixel voltage R1 in a manner similar to that shown in FIGS. 20A and 20B. In another aspect of the present invention, the dummy pixel electrode 203 may be supplied with a dummy data voltage including, for example, a blue pixel voltage B3/m obtained by reproducing the last blue pixel voltage B3/m in a manner similar to that shown in FIGS. 20A and 20B. Accordingly, liquid crystal cells Clc arranged within odd numbered data lines and connected to the first of successively arranged data lines, in addition to liquid crystal cells Clc arranged within even numbered horizontal lines and connected to the last of successively arranged data lines, comprise non-display liquid crystal cells where pictures are not displayed.

In one aspect of the present invention, dummy data may be applied to the first data line DL1 and the last (m+1)th data line DLm+1 by reproducing data applied to adjacent data lines so that voltage swing widths of the first data line DL1 and the last (m+1)th data line DLm+1 may be reduced compared to the blank data voltage. Dummy liquid crystal cells connected to the (m+1)th data line DLm+1 are provided at the rightmost portion of odd numbered horizontal lines and dummy liquid crystal cells connected to the 1st data line DL1 are provided at the leftmost portion of even horizontal numbered lines. Accordingly, dummy data voltages applied to the 1st data line DL1 and the (m+1)th data line DLm+1 may be applied to the dummy liquid crystal cells in a manner similar to other adjacent data lines DL2 to DLm. Furthermore, a load variation within the 1st data line DL1 and the (m+1)th data line DLm+1 may be reduced and power consumption by the LCD may be reduced.

Figure 22:
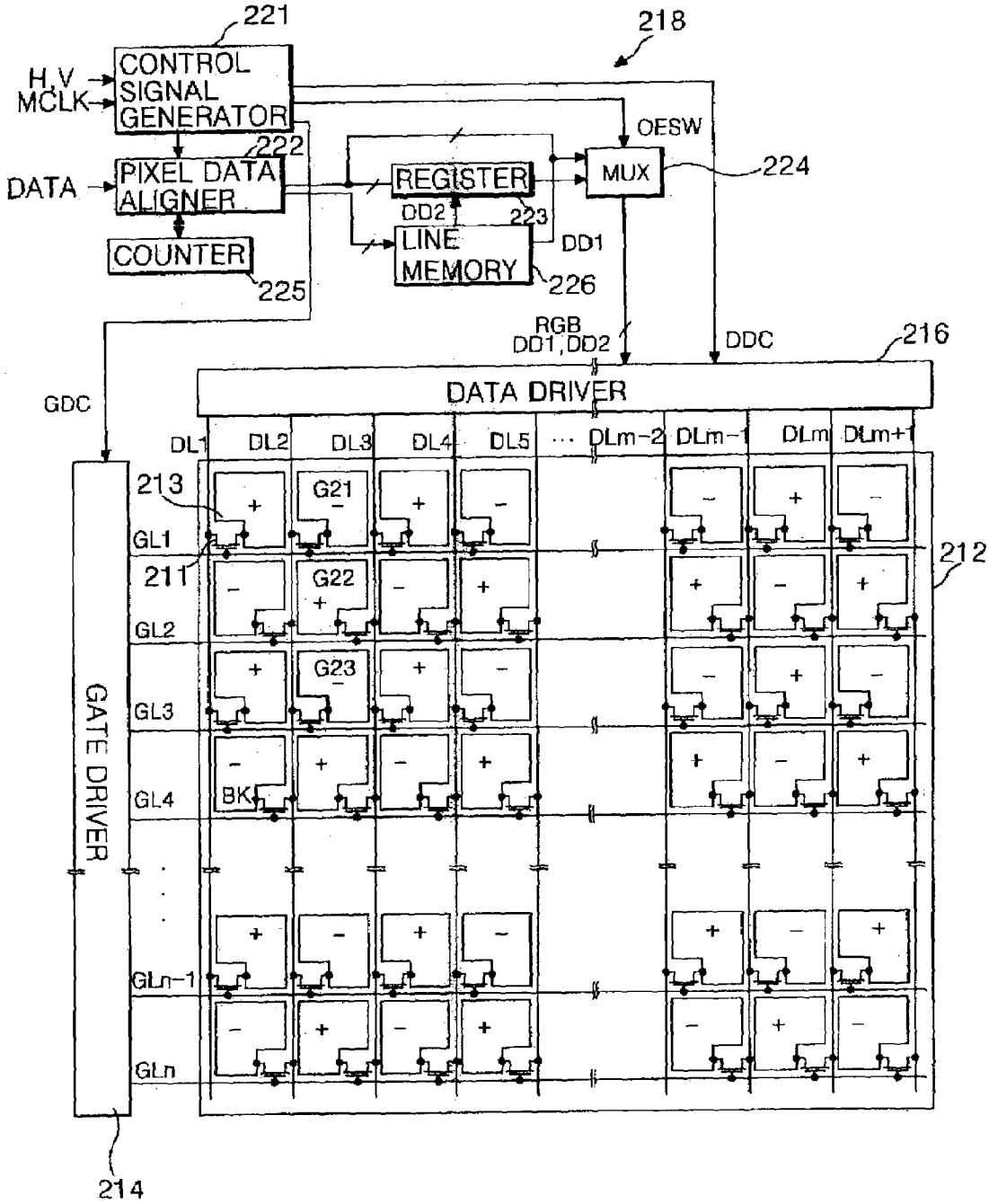
FIG. 22 illustrates a schematic view of a liquid crystal display according to a seventh aspect of the present invention.

FIG. 22 illustrates a schematic view of a liquid crystal display according to a seventh aspect of the present invention.

Referring to FIG. 22, the LCD may, for example, include a liquid crystal display panel 212 having a plurality of gate lines GL1 to GLn, a plurality of successively arranged data lines DL1 to DLm+1 arranged to cross the plurality of gate lines, and a plurality of liquid crystal cells Clc arranged in a matrix pattern at crossings of the gate and data lines. Each of the liquid crystal cells may include a TFT 211 for driving each liquid crystal cell. In one aspect of the present invention, consecutive ones of TFTs 211 arranged within a column of liquid crystal cells are alternately connected to two adjacent data lines. For example, TFTs 211 within odd numbered horizontal lines supply data signals, applied to the 1st to mth the data lines DL1 to DLm, to liquid crystal cells arranged within the odd numbered horizontal lines while TFTs 211 within even numbered horizontal lines supply data signals, applied to the 2nd to (m+1)th data lines DL2 to DLm+1, to liquid crystal cells arranged within the even numbered horizontal lines. The LCD may further include a gate driver 214 for driving gate lines GL1 to GLn arranged on the liquid crystal display panel 212, a data driver 216 for driving data lines DL1 to DLm+1 also arranged on the liquid crystal display panel 212, and a timing controller 218 for controlling the gate driver 214 and the data driver 216.

In one aspect of the present invention, liquid crystal cells including TFTs 211 coupled to odd numbered gate lines GL1, GL3, GL5, . . . , GLn−1 may be coupled to adjacent ones of preceding data lines DL1 to DLm while liquid crystal cells including TFTs 211 coupled to the even numbered gate lines GL2, GL4, GL6, . . . , GLn may be coupled to adjacent ones of successive data lines DL2 to DLm+1. Gate electrodes of TFTs 211 may be connected to the gate lines GL1 to GLm. Source electrodes of TFTs 211 coupled to odd numbered gate lines may be connected to adjacent ones of preceding 1st to mth data lines DL1 to DLm while source electrodes of TFTs 211 coupled to even numbered gate lines may be connected to adjacent ones of successive 2nd to (m+1)th data lines DL2 to DLm+1. Drain electrodes of TFTs 211 coupled to odd numbered gate lines may be connected to adjacent ones of successive pixel electrodes 213 while drain electrodes of TFTs 211 coupled to even numbered gate lines may be connected to adjacent ones of preceding pixel electrodes 213. Accordingly, odd numbered horizontal lines of liquid crystal cells Clc may be charged with data signals supplied from adjacent ones of preceding data lines DL1 to DLm while even numbered horizontal lines of liquid crystal cells Clc may be charged with data signals supplied from adjacent ones of successive data lines DL2 to DLm+1.

Upon receiving horizontal/vertical synchronizing signals H and V in addition to a main clock MCLK, the timing controller 218 may, for example, simultaneously supply digital video data signals (RGB) to the data driver 216 and generate timing control signals (DDC) and (GDC) required by the data driver 216 and the gate driver 214, respectively. In one aspect of the present invention, the timing controller 218 may reproduce any of the digital video data signals (RGB) and delays them by one horizontal period to generate dummy data DD1 and DD2 in the subsequent horizontal period.

In one aspect of the present invention, the timing controller 218 may, for example, include a control signal generator 221 for generating timing control signals, a pixel data aligner 222 for receiving digital video data signals, a counter 225 for counting input data, and a register 223, line memory 226, and MUX 224 commonly connected to an output terminal of the pixel data aligner 222.

In one aspect of the present invention, the control signal generator 221 may generate gate control signals (GDC) (e.g., gate start pulse (GSP), gate shift clock (GSC), gate output enable signal (GOE), etc.), suitable for controlling the gate driver 214. In another aspect of the present invention, the control signal generator 221 may use the vertical and horizontal synchronizing signals V and H, in addition to a main clock MCLK, to generate data and data control signals (DDC) (e.g., data enable signals (DE), source shift clock (SSC), source start pulse (SSP), polarity control signal (POL), source output enable signal (SOE), etc.), suitable for controlling the data driver 216. Further, the control signal generator 221 may generate a clock signal required by the pixel data aligner 222 and an odd/even horizontal period indication signal (OESW) for controlling the MUX 224.

In one aspect of the present invention, the pixel data aligner 222 may output inputted digital video data signals (e.g., RGB) in response to a clock outputted from the control signal generator 221. Of the digital video data signals (RGB) outputted from the pixel data aligner 222, data outputted via the last output data bus may be commonly supplied to the register 223 and the MUX 224 while data outputted via output data buses other than the last output data bus may be supplied to the MUX 224. The pixel data aligner 222 may count the inputted digital video data signals (RGB) in response to a count signal outputted from the counter 225. When an mth digital video data signal has been detected, the pixel data aligner 222 may output the mth digital video data signal to the line memory 226 during odd numbered horizontal periods. During even numbered horizontal periods, the pixel data aligner 222 may detect the first digital video data signal with the aid of the source start pulse (SSP) and apply the first digital video data signal to the line memory 226.

In one aspect of the present invention, the line memory 226 may temporarily store the mth video data outputted by the pixel data aligner 222 during odd numbered horizontal periods and output the stored mth video data to thereby generate a first dummy data DD1. The line memory 226 may then apply the first dummy data DD1 to the MUX 224. Further, the line memory 226 may temporarily store the mth video data outputted by the pixel data aligner 222 during even numbered horizontal periods and output the stored mth video data to thereby generate a second dummy data DD2. The line memory 226 may then apply the second dummy data DD2 to the register 223.

In one aspect of the present invention, the register 223 may temporarily store data outputted by the last of the output data buses of the pixel data aligner 222 and output data stored during even numbered horizontal periods. In another aspect of the present invention, the register 223 may temporarily store the second dummy data DD2 outputted by the line memory 226 and output the second dummy data DD2 stored during even numbered horizontal periods.

Figure 23A:
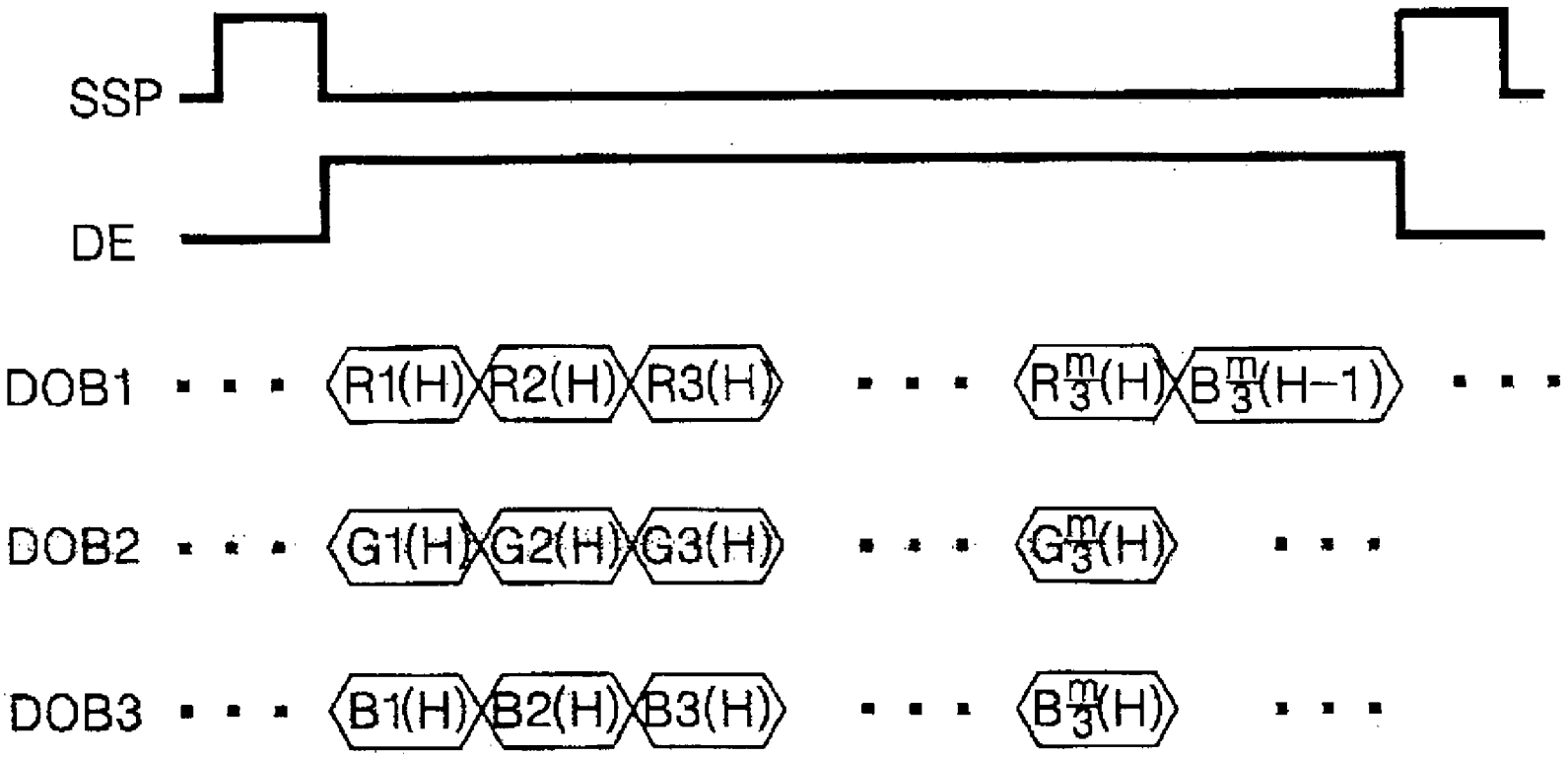
FIGS. 23A and 23B illustrate exemplary waveform diagrams of data outputted by the timing controller shown in FIG. 22.
Figure 23B:
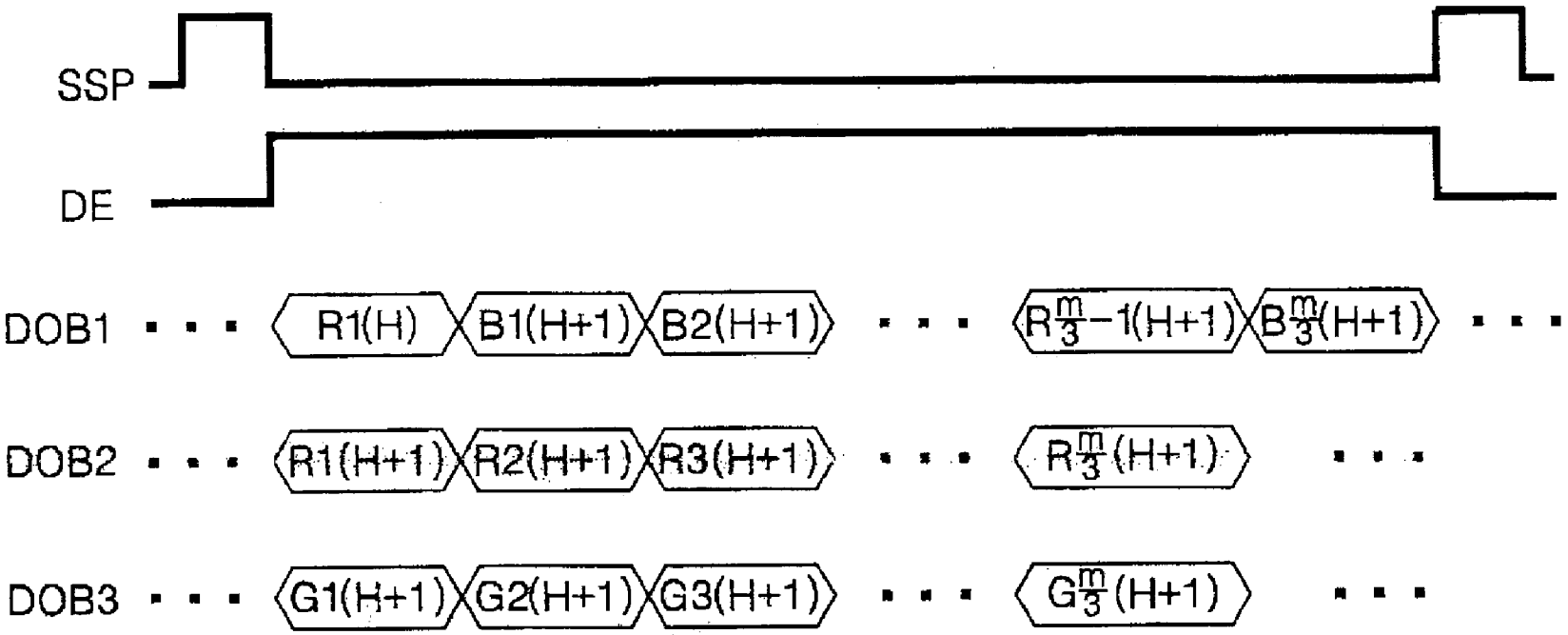
Figure 24A:
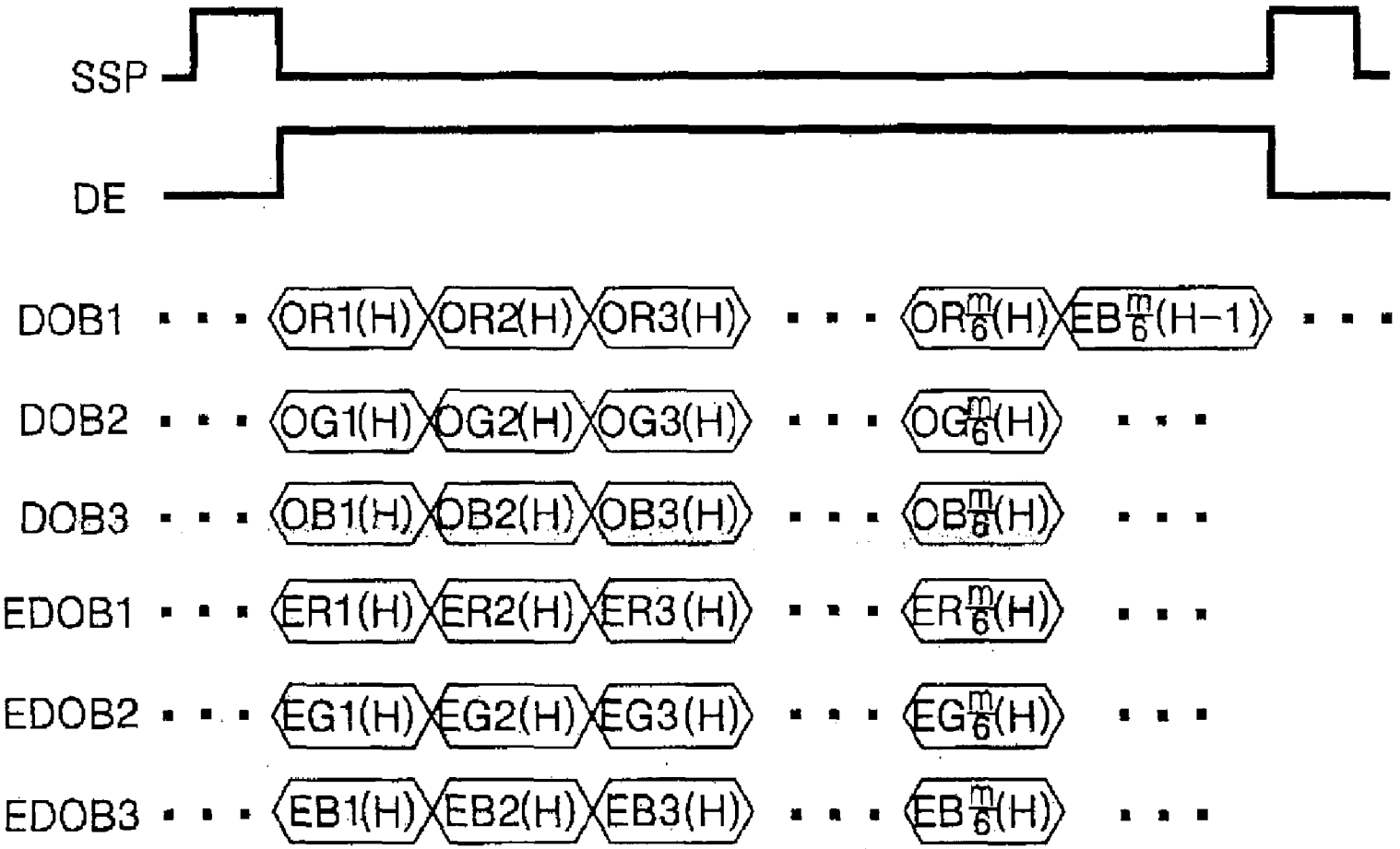
FIGS. 24A and 24B illustrate additional waveform diagrams of data outputted by the timing controller shown in FIG. 22.
Figure 24B:
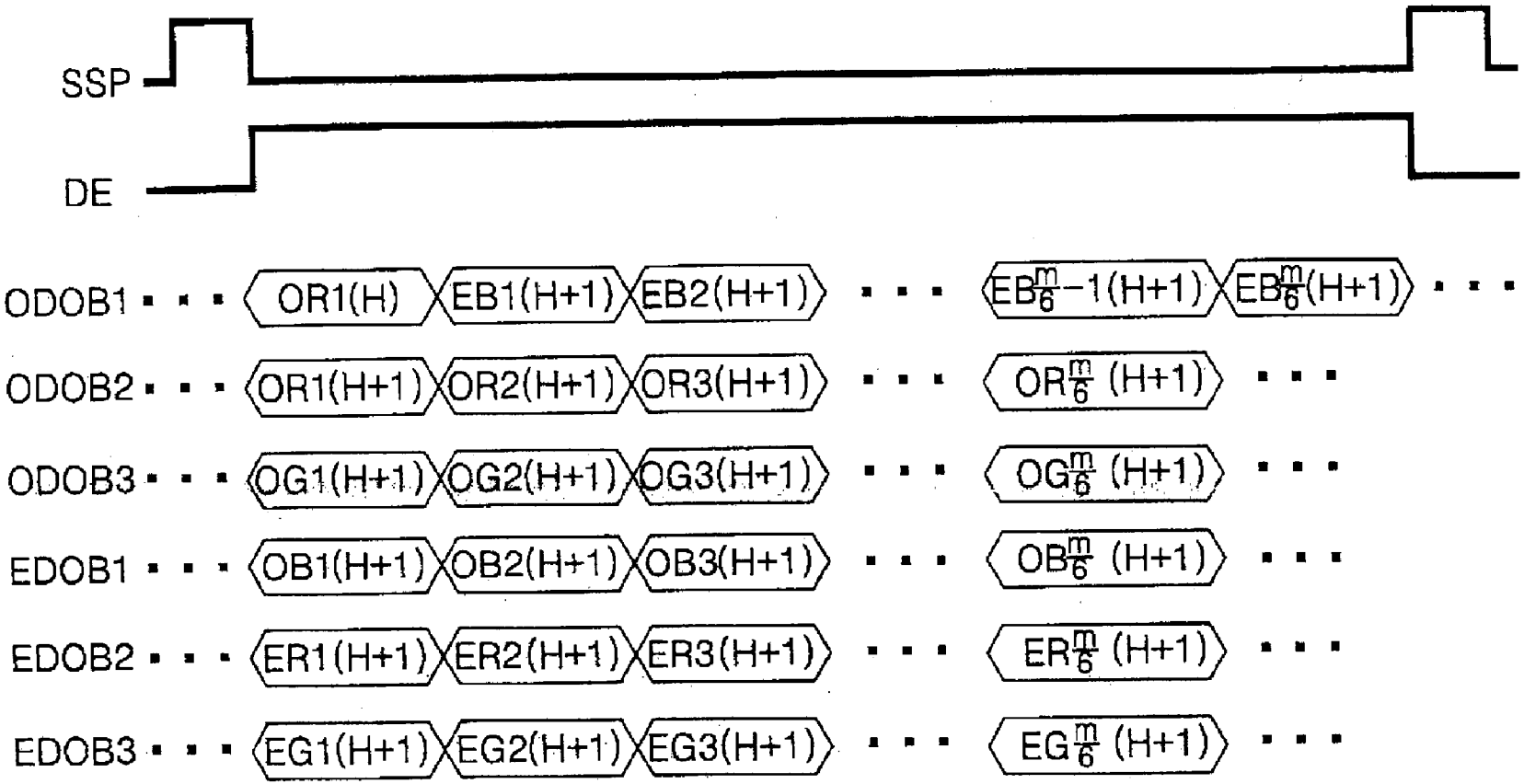

In one aspect of the present invention, the MUX 224 may output m digital video data signals outputted by the pixel data aligner 222 and the first dummy data DD1 outputted by the line memory 226 in-situ during odd numbered horizontal periods in response to an odd/even horizontal indication signal outputted by the control signal generator 221. Data outputted by the MUX 224 during odd numbered horizontal periods are illustrated in FIGS. 23A and 24A. During even numbered horizontal periods, the MUX 224 may shift m digital video data signals outputted by the pixel data aligner 222 toward a successive one of the output data buses, output the shifted digital video data signals while outputting the last bus data, delayed by the register 223, and output the second dummy data DD2 via the first output data bus. Data outputted by the MUX 224 during even numbered horizontal periods are illustrated in FIG. 23B and FIG. 24B.

Using the gate start pulse (GSP), gate shift clock (GSC), and a gate output enable signal (GOE) generated by the timing controller 218, the gate driver 214 may sequentially apply a scanning pulse to the gate lines GL1 to GLn. The scanning pulse sequentially turns on horizontal lines of the TFTs 211 such that data signals may be applied to the TFTs 211 turned on within each sequentially selected horizontal line. The gate driver 214 may, for example, include a shift register for sequentially generating a scanning pulse and a level shifter for shifting a voltage swing width of the scanning pulse such that the voltage swing width is suitable for driving a liquid crystal cell Clc.

The data driver 216 may be configured in a substantially identical manner as the data driver illustrated in FIG. 10. Accordingly, the data driver 216 may apply m digital video data signals (RGB) outputted from the timing controller 218 to the 1st to mth data lines DL1 to DLm during odd numbered horizontal periods while applying the first dummy data DD1 to the (m+1)th data line DLm+1 using the data control signal (DDC) outputted from the timing controller 218. During even numbered horizontal periods, the data driver 216 may apply m digital video data RGB outputted from the timing controller 218 to the 2nd to (m+1)th data lines DL2 to DLm+1 while applying the second dummy data DD2 to the 1st data line DL1.

In one aspect of the present invention, the data driver 216 may convert m digital video data signals (RGB) in addition to dummy data DD1 and DD2 into positive gamma compensation voltages or negative gamma compensation voltages. Accordingly, the data driver 216 may convert the digital video data signals (RGB) and dummy data DD1 and DD2 into various analog pixel voltages. Polarities of the pixel voltages applied to adjacent data lines, converted into the various analog pixel voltages by the gamma compensation voltages, are inverted along the horizontal direction similar to the column inversion system. Accordingly, positive gamma compensation voltages and negative gamma voltages may be alternately applied to successively arranged data lines.

The polarities of the (m+1) pixel voltages are inverted by the column inversion system by means of the data driver 216 and are synchronized with the scanning pulse sequentially applied to n gate lines GL1 to GLn every horizontal period.

FIGS. 23A and 23B illustrate exemplary waveform diagrams of digital video data (RGB) outputted by the timing controller shown in FIG. 22 and the dummy data DD1 and DD2 applied, via three output buses, to the data driver 216.

Referring to FIG. 23A, during odd numbered horizontal periods, the timing controller 218 may simultaneously apply m/3 red digital video data R1(H), R2(H), R3(H), . . . , Rm/3(H), m/3 green digital video data G1(H), G2(H), G3(H), . . . , Gm/3(H), and m/3 blue digital video data B1(H), B2(H), B3(H), . . . , Bm/3(H) to the data driver 216 via the first output data bus DOB1, the second output data bus DOB2, and the third output data bus DOB3, respectively. After m digital video data signals are applied to the data driver 216 via the first to third output data buses DOB1, DOB2 and DOB3, the timing controller 218 may apply the first dummy data DD1 to the data driver 216 via the first output data bus DOB1. In one aspect of the present invention, the first dummy data DD1 is substantially equal to a blue digital video data Bm/3(H−1) at the pre-stage line because the blue digital video data Bm/3(H−1) is delayed by one horizontal period via the line memory 226 of the timing controller 218. During the data enable (DE) interval, m red, green, and blue digital video data R1(H), R2(H), R3(H), . . . , Rm/3(H), G1(H), G2(H), G3(H), . . . , Gm/3(H), and B1(H), B2(H), B3(H), . . . , Bm/3(H), respectively, may be outputted to the data driver 216 via the first to third output data buses DOB1, DOB2 and DOB3, respectively. Thereafter, the blue digital video data Bm/3(H−1) at the pre-stage line is outputted to the data driver 216 via the first output data bus DOB1.

Referring to FIG. 23B, during even numbered horizontal periods, the timing controller 218 may apply the second dummy data DD2 and m/3 blue digital video data B1(H+1), B2(H+1), B3(H+1), . . . , Bm/3(H+1) to the data driver 216 via the first output data bus DOB1. In one aspect of the present invention, the second dummy data DD2 is substantially equal to a red digital video data R1(H) at the pre-stage line because the red digital video data R1(H) is delayed by one horizontal period via the line memory 226 of the timing controller 218. In one aspect of the present invention, the timing controller 218 may apply m/3 red digital video data R1(H+1), R2(H+1), R3(H+1), . . . , Rm/3(H+1) and m/3 green digital video data G1(H+1), G2(H+1), G3(H+1), . . . , Gm/3(H+1) to the data driver 216 via the second output data bus DOB2 and the third output data bus DOB3, respectively. During the data enable (DE) interval, the first red digital video data R1(H) at the pre-stage line may be simultaneously outputted to the data driver 216 via the first output data bus DOB1, to the data driver 216 while the first red digital video data R1(H+1) and the first green digital video data G1(H+1) are outputted to the data driver 216 via the second and third output data buses DOB2 and DOB3, respectively. Subsequently, m/3 blue digital video data B1(H+1), B2(H+1), B3(H+1), . . . , Bm/3(H+1), delayed by the register 223, may be simultaneously outputted to the data driver 216 via the first output data bus DOB1 while red and green digital video data R2(H+1), R3(H+1), . . . , Rm/3(H+1) and G2(H+1), G3(H+1), . . . , Gm/3(H+1), respectively, are outputted to the data driver 216 via the second and third output data buses DOB2 and DOB3, respectively.

FIG. 24A and FIG. 24B illustrate additional exemplary waveform diagrams of digital video data (RGB) and dummy data DD1 and DD2 outputted by the timing controller 218 shown in FIG. 22 to the data driver 216 via six output data buses.

Referring to FIG. 24A, during odd numbered horizontal periods, the timing controller 218 may simultaneously apply m/6 odd red digital video data OR1(H), OR2(H), OR3(H), . . . , ORm/6(H), m/6 odd green digital video data OG1(H), OG2(H), OG3(H). . . . , OGm/6(H), and m/6 odd blue digital video data OB1(H), OB2(H), OB3(H), . . . , OBm/6(H) to the data driver 216 via the first odd output data bus ODOB1, the second odd output data bus ODOB2, and the third odd output data bus ODOB3, respectively. During odd numbered horizontal periods, the timing controller 218 may simultaneously apply m/6 even red digital video data ER1(H), ER2(H), ER3(H), . . . , ERm/6(H), m/6 even green digital video data EG1(H), EG2(H), EG3(H). . . . , EGm/6(H), and m/6 even blue digital video data EB1(H), EB2(H), EB3(H), . . . , EBm/6(H) to the data driver 216 via the first even output data bus EDOB1, the second even output data bus EDOB2, and the third even output data bus EDOB3, respectively. After m/2 odd digital video data and m/2 even digital video data are applied to the data driver 216 via the first to third odd output data buses ODOB1, ODOB2 and ODOB3 and the first to third even output data buses EDOB1, EDOB2 and EDOB3, respectively, the timing controller 218 may apply the first dummy data DD1 to the data driver 216 via the first odd output data bus ODOB1. In one aspect of the present invention, the first dummy data DD1 may be substantially identical to a blue digital video data EBm/6(H−1) at the pre-stage line because the last blue digital video data Em/6(H−1) is delayed by one horizontal period via the line memory 226 of the timing controller 218. During the data enable (DE) interval, m red, green, and blue digital video data OR1(H), OR2(H), OR3(H), . . . , ORm/6(H), OG1(H), OG2(H), OG3(H), . . . , OGm/6(H), OB1(H), OB2(H), OB3(H), . . . , OBm/6(H), ER1(H), EB2(H), ER3(H), . . . , ERm/6(H), EG1(H), EG2(H), EG3(H), . . . , EGm/6(H), and EB1(H), EB2(H), EB3(H), . . . , EBm/6(H) may be outputted to the data driver 216. Thereafter, the first dummy data DD1 may be outputted to the data driver via the first odd output data bus ODOB1.

In transitioning to even numbered horizontal periods, the timing controller 218 may shift a data bus to which a digital video data may be outputted to a successive one of an output data bus, one output data bus at a time. Subsequently, the second dummy data DD2 comprising the first data at the pre-stage is outputted via the first odd output data bus ODOB1 which has been empty due to the shifting of the data bus.

Referring to FIG. 24B, during even numbered horizontal periods, the timing controller 218 may apply the second dummy data DD2 and then apply m/6 even blue digital video data EB1(H+1), EB2(H+1), EB3(H+1), . . . , EBm/6(H+1), delayed by the register 223, to the data driver 216 via the first odd output data bus ODOB1. In one aspect of the present invention, the second dummy data DD2 may be substantially equal to a red digital video data OR1(H) present at the pre-stage line because the first blue digital video data OR1(H) at the pre-stage line is delayed by one horizontal period via the line memory 226 of the timing controller 218. In another aspect of the present invention, the timing controller 218 may simultaneously apply m/6 odd red digital video data OR1(H+1), OR2(H+1), OR3(H+1), . . . , ORm/6(H+1) and m/6 odd green digital video data OG1(H+1), OG2(H+1), OG3(H+1), . . . , OGm/6(H+1) to the data driver 216 via the second odd output data bus ODOB2 and the third odd output data bus ODOB3, respectively. In one aspect of the present invention, the timing controller 218 may simultaneously apply m/6 odd blue digital video data OB1(H+1), OB2(H+1), OB3(H+1), . . . , OBm/6(H+1), m/6 even red digital video data ER1(H+1), ER2(H+1), ER3(H+1), . . . , ERm/6(H+1), and m/6 even green digital video data EG1(H+1), EG2(H+1), EG3(H+1), . . . , EGm/6(H+1) to the data driver 216 via the first even output data bus EDOB1, the second even output data bus EDOB2, and the third even output data bus EDOB3, respectively. During the data enable (DE) interval, the second dummy data DD2 may be outputted to the data driver 216 via the first odd output data bus ODOB1 while the first odd red digital video data OR1(H+1) and the first odd green digital video data OG1(H+1) are outputted to the data driver 216 via the second and third odd output data buses ODOB2 and ODOB3, respectively and while the first odd blue digital video data OB1(H+1), the first even red digital video data ER1(H+1), and the first even green digital video data EG1(H+1) are outputted to the data driver 216 via the first to third even output data buses EDOB1, EDOB2 and EDOB3, respectively. Subsequently, m/6 even blue digital video data EB1(H+1), EB2(H+1), EB3(H+1), . . . , EBm/6(H+1), delayed by the register 223, may be outputted to the data driver 216 via the first odd output data bus ODOB1 while odd red, green, and blue digital video data OR2(H+1), OR3(H+1), ORm/6(H+1), OG2(H+1), OG3(H+1), . . . , OGm/6(H+1), and OB2(H+1), OB3(H+1), . . . , OBm/6(H+1) and even red and green digital video data ER2(H+1), ER3(H+1), . . . , ERm/6(H+1) and EG2(H+1), EG3(H+1), . . . , EGm/6(H+1) may be outputted to the data driver via the second and third odd output data buses ODOB2 and ODOB3 and the first to third even output data buses EDOB1, EDOB2, and EDOB3, respectively.

Figure 25A:
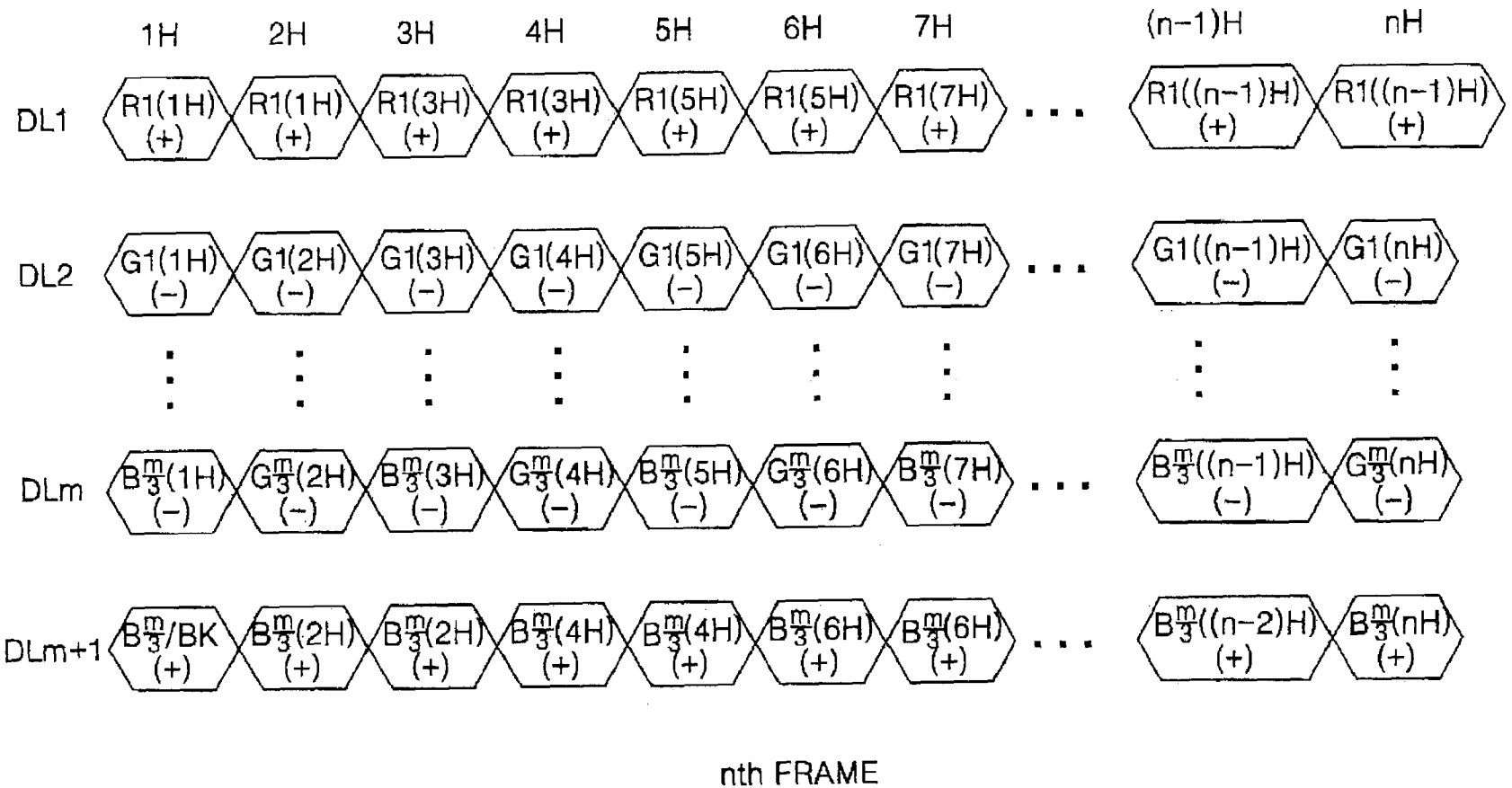
FIGS. 25A and 25B illustrate waveform diagrams of data applied to the liquid crystal display panel shown in FIG. 22.
Figure 25B:
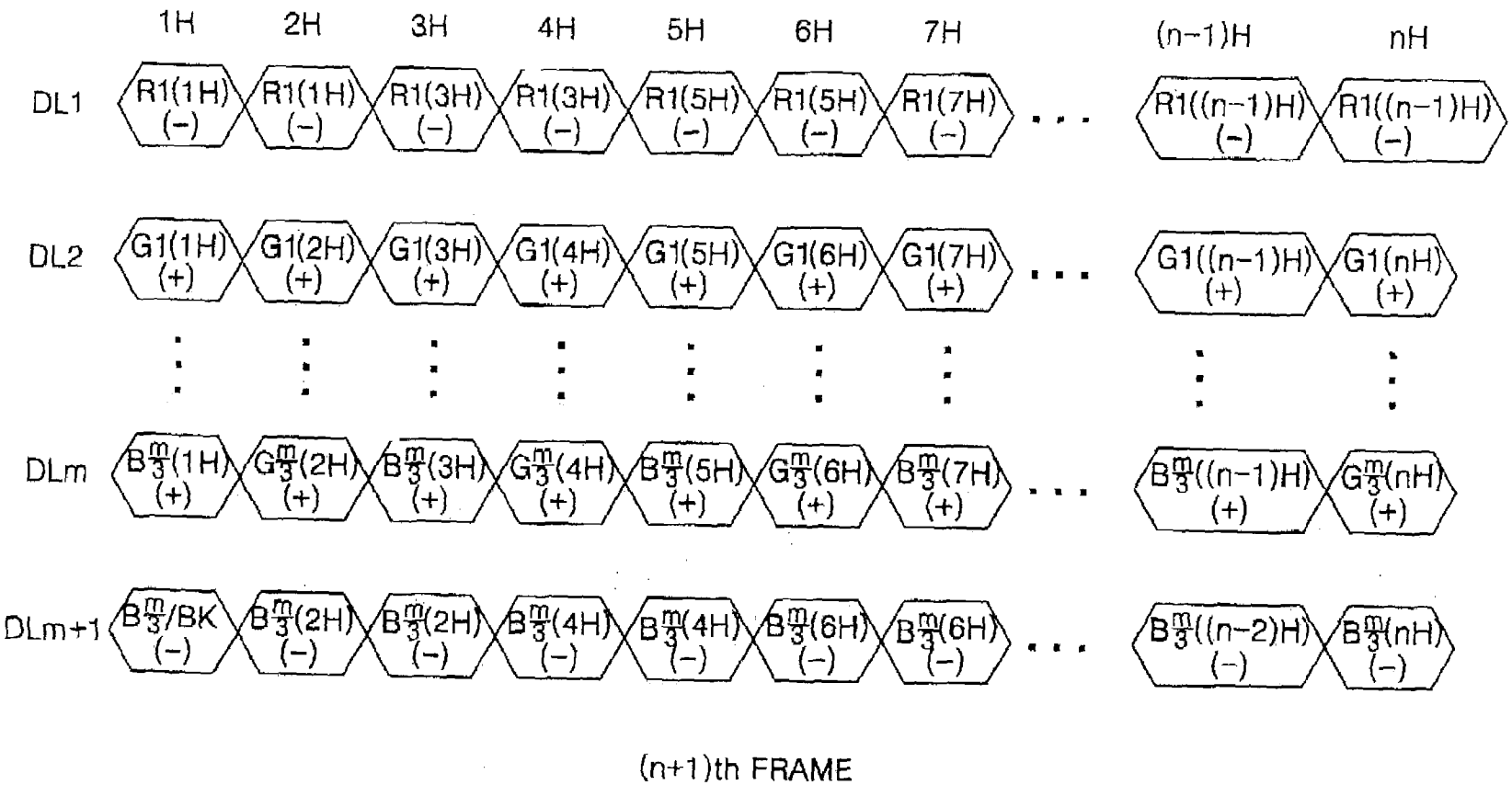

FIGS. 25A and 25B illustrate waveform diagrams of data applied to data lines DL1 to DLm+1 of the liquid crystal display panel 212 shown in FIG. 22 during the nth and the (n+1)th frame intervals.

Referring to FIG. 25A, during odd numbered horizontal periods 1H, 3H, . . . , (n−1)H in the nth frame, red, green, and blue pixel voltages R1(1H), G1(1H), . . . , Bm/3(1H), R1(3H), G1(3H), . . . , Bm/3(3H), and R1((n−1)H), G1((n−1)H), . . . , Bm/3((n−1)H) may be applied to the 1st to mth data lines DL1 to DLm. In one aspect of the present invention, the last blue pixel voltages Bm/3(2H), Bm/3(4H), . . . , Bm/3((n−2)H) at the pre-stage may be applied to the (m+1)th data line DLm+1. In another aspect of the present invention, the pre-stage blue pixel voltages Bm/3(2H), Bm/3(4H), . . . , Bm/3((n−2)H) applied to the (m+1)th data line DLm+1 may comprise pixel voltages reproduced by a delay of the blue pixel voltages Bm/3(2H), Bm/3(4H), . . . , Bm/3((n−2)H) applied to the (m+1)th data line DLm+1 at the pre-stage. During the first horizontal period 1H, a pixel voltage applied to the (m+1)th data line DLm+1 may comprise a voltage wherein the last blue pixel voltage Bm/3 applied during the last horizontal period nH of the previous frame (e.g., the (n−1)th frame) has been reproduced under control of the timing controller 218, or a blank data voltage BK. During even numbered horizontal periods 2H, 4H, . . . , nH in the nth frame, red, green, and blue pixel voltages R1(2H), G1(2H), . . . , Bm/3(2H), R1(4H), G1(4H), . . . , Bm/3(4H), . . . ; R1(nH), G1(nH), . . . , Bm/3(nH) may be applied to the 2nd to (m+1)th data lines DL2 to DLm+1 while the first red pixel voltages R1(1H), R1(3H), . . . , R1((n−1)H) at the pre-stage maybe applied to the 1st data line DL1. In one aspect of the present invention, the red pixel voltages R1(1H), R1(3H), . . . , R1((n−1)H) at the pre-stage applied to the 1st data line DL1 comprise pixel voltages wherein the first red pixel voltages R1(1H), R1(3H), . . . , R1((n−1)H) applied to the 1st data line DL1 in the previous horizontal period has been reproduced. In another aspect of the present invention, a positive pixel voltage may be applied to the odd data lines DL1, DL3, DL5, . . . , DLm−1, DLm+1 while a negative pixel voltage may be applied to the even data lines DL2, DL4, DL6, . . . , DLm−2, DLm in the nth frame interval. In another aspect of the present invention, a polarity of the pixel voltages applied to each data line DL1 to DLm+1 may be inverted in transitioning to the (n+1)th frame, as shown in FIG. 25B.

Referring to FIG. 25B, during odd numbered horizontal periods 1H, 3H, . . . , (n−1)H in the (n+1)th frame, red, green, and blue pixel voltages R1(1H), G1(1H), . . . , Bm/3(1H), R1(3H), G1(3H), . . . , Bm/3(3H), and R1((n−1)H), G1((n−1)H), . . . , Bm/3((n−1)H) may be applied to the 1st to mth data lines DL1 to DLm while the last blue pixel voltages Bm/3(2H), Bm/3(4H), . . . , Bm/3((n−2)H) at the pre-stage may be applied to the (m+1)th data line DLm+1. In one aspect of the present invention, pixel voltages applied to the (m+1)th data line DLm+1 in the first horizontal period 1H may comprise voltages wherein the last blue pixel voltage Bm/3 applied in the last horizontal period (nH) of the nth frame has been reproduced under control of the timing controller 218, or a blank data voltage BK. During even numbered horizontal periods 2H, 4H, . . . , nH in the (n+1)th frame, red, green, and blue pixel voltages R1(2H), G1(2H), . . . , Bm/3(2H), R1(4H), G1(4H), . . . , Bm/3(4H), . . . , R1(nH), and G1(nH), . . . , Bm/3(nH) may be applied to the 2nd to (m+1)th data lines DL2 to DLm+1 while the first red pixel voltages R1(1H), R1(3H), . . . , R1((n−1)H) at the pre-stage are applied to the 1st data line DL1. In one aspect of the present invention, a positive pixel voltage may be applied to the odd data lines DL1, DL3, DL5, . . . , DLm−1, DLm+1 while a negative pixel voltage may be applied to the even data lines DL2, DL4, DL6, . . . , DLm−2, DLm in the (n+1)th frame interval.

Figure 26:
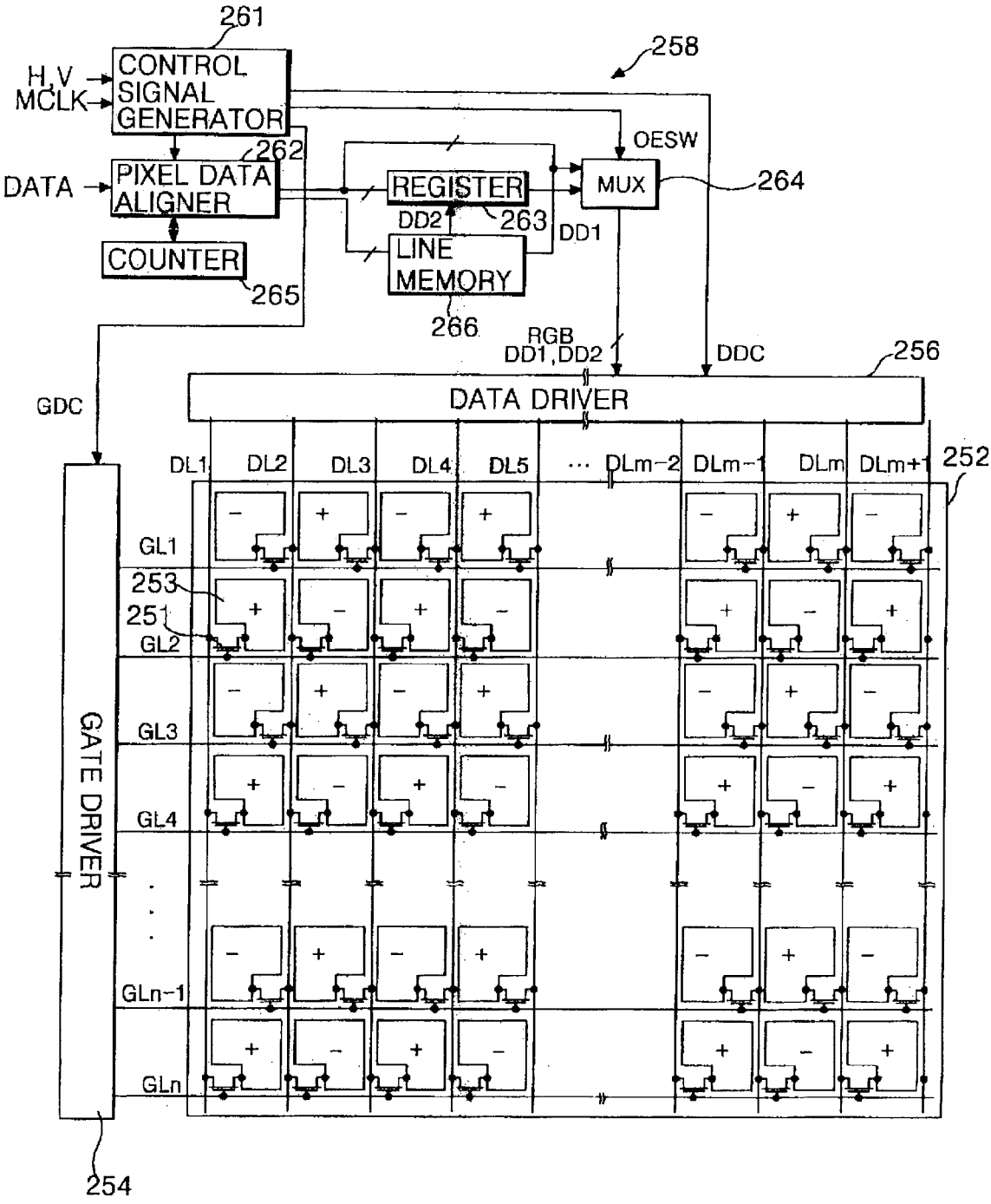
FIG. 26 illustrates a schematic view of a liquid crystal display according to a eighth aspect of the present invention.

FIG. 26, illustrates a schematic view of a liquid crystal display according to an eighth aspect of the present invention.

Referring to FIG. 26, LCD may, for example, include a liquid crystal display panel 252 having a plurality of gate lines GL1 to GLn, a plurality of successively arranged data lines DL1 to DLm+1 arranged to cross the plurality of gate lines, and a plurality of liquid crystal cells Clc arranged in a matrix pattern at crossings of the gate and data lines. Each of the liquid crystal cells may include a TFT 251 for driving each liquid crystal cell. In one aspect of the present invention, consecutive ones of TFTs 251 arranged within a column of liquid crystal cells are alternately connected to two adjacent data lines. For example, TFTs 251 within odd numbered horizontal lines supply data signals, applied to the 2nd to (m+1)th the data lines DL2 to DLm+1, to liquid crystal cells arranged within the odd numbered horizontal lines while TFTs 251 within even numbered horizontal lines supply data signals, applied to the 1st to mth data lines DL1 to DLm, to liquid crystal cells arranged within the even numbered horizontal lines. The LCD may further include a gate driver 254 for driving gate lines GL1 to GLn arranged on the liquid crystal display panel 252, a data driver 256 for driving data lines DL1 to DLm+1 also arranged on the liquid crystal display panel 252, and a timing controller 258 for controlling the gate driver 254 and the data driver 256.

In one aspect of the present invention, liquid crystal cells including TFTs 251 coupled to odd numbered gate lines GL1, GL3, GL5, . . . , GLn−1 may be coupled to adjacent ones of successive data lines DL2 to DLm+1 while liquid crystal cells including TFTs 251 coupled to the even numbered gate lines GL2, GL4, GL6, . . . , GLn may be coupled to adjacent ones of preceding data lines DL1 to DLm. Gate electrodes of TFTs 251 may be connected to the gate lines GL1 to GLm. Source electrodes of TFTs 251 coupled to odd numbered gate lines may be connected to adjacent ones of successive 2nd to (m+1)th data lines DL2 to DLm+1 while source electrodes of TFTs 251 coupled to even numbered gate lines may be connected to adjacent ones of preceding 1st to mth data lines DL1 to DLm. Drain electrodes of TFTs 251 coupled to odd numbered gate lines may be connected to adjacent ones of preceding pixel electrodes 253 while drain electrodes of TFTs 251 coupled to even numbered gate lines may be connected to adjacent ones of successive pixel electrodes 253. Accordingly, odd numbered horizontal lines of liquid crystal cells Clc may be charged with data signals supplied from adjacent ones of successive data lines DL2 to DLm+1 while even numbered horizontal lines of liquid crystal cells Clc may be charged with data signals supplied from adjacent ones of preceding data lines DL1 to DLm.

In one aspect of the present invention, the first or last data at the pre-stage may be delayed by one horizontal period to generate a dummy data. Accordingly, the dummy data voltage may be applied to a dummy liquid crystal cell (not shown) connected to the 1st data line DL1 provided within a left non-display area or to a dummy liquid crystal cell (not shown) connected to the (m+1)th data line DLm+1 provided within a right non-display area similar to the manner in which data voltages are applied to liquid crystal connected to other adjacent data lines DL2 to DLm. Therefore, a load variation within the 1st data line DL1 and the (m+1)th data line DLm+1 may be reduced and power consumption by the LCD may be reduced.

Upon receiving horizontal/vertical synchronizing signals H and V in addition to a main clock MCLK, the timing controller 258 may, for example, simultaneously supply digital video data signals (RGB) to the data driver 256 and generate timing control signals (DDC) and (GDC) required by the data driver 256 and the gate driver 254, respectively. In one aspect of the present invention, the timing controller 258 may reproduce any of the digital video data signals (RGB) at the pre-stage to generate dummy data DD1 and DD2 and alternately output the dummy data DD1 and DD2.

In one aspect of the present invention, the timing controller 258 may, for example, include a control signal generator 261 for generating timing control signals, a pixel data aligner 262 for receiving digital video data signals, a counter 265 for counting input data, and a register 263, line memory 266, and MUX 264 commonly connected to an output terminal of the pixel data aligner 262.

In one aspect of the present invention, the control signal generator 261 may generate gate control signals (GDC) (e.g., gate start pulse (GSP), gate shift clock (GSC), gate output enable signal (GOE), etc.), suitable for controlling the gate driver 254. In another aspect of the present invention, the control signal generator 261 may use the vertical and horizontal synchronizing signals V and H, in addition to a main clock MCLK, to generate data and data control signals (DDC) (e.g., data enable signals (DE), source shift clock (SSC), source start pulse (SSP), polarity control signal (POL), source output enable signal (SOE), etc.), suitable for controlling the data driver 256. Further, the control signal generator 261 may generate a clock signal required by the pixel data aligner 262 and an odd/even horizontal period indication signal (OESW) for controlling the MUX 264.

In one aspect of the present invention, the pixel data aligner 262 may output inputted digital video data signals (e.g., RGB) in response to a clock outputted from the control signal generator 261. Of the digital video data signals (RGB) outputted from the pixel data aligner 262, data outputted via the last output data bus may be commonly supplied to the register 263 and the MUX 264 while data outputted via output data buses other than the last output data bus may be supplied to the MUX 264. During even numbered horizontal periods, the pixel data aligner 262 may count the inputted digital video data signals (RGB) in response to a count signal outputted from the counter 265. When an mth digital video data signal has been detected, the pixel data aligner 262 may output the mth digital video data signal to the line memory 626 during even numbered horizontal periods. During odd numbered horizontal periods, the pixel data aligner 262 may detect the first digital video data signal with the aid of the source start pulse (SSP) and apply the first digital video data signal to the line memory 266.

In one aspect of the present invention, the line memory 266 may temporarily store the first digital video data outputted by the pixel data aligner 262 during one horizontal period in the odd numbered horizontal period and output the stored first digital video data to thereby generate a second dummy data DD2. The line memory 266 may then apply the second dummy data DD2 to the MUX 264. Further, the line memory 266 may temporarily store the mth digital video data outputted from the pixel data aligner 262 during one horizontal period in the even numbered horizontal period and output the stored mth digital video data to thereby generate a first dummy data DD1. The line memory 266 may applying the first dummy data DD1 to the register 263.

In one aspect of the present invention, the register 263 may temporarily store data outputted by the last of the outputted data buses of the pixel data aligner 262 and outputs data stored during odd numbered horizontal periods. In another aspect of the present invention, the register 263 may temporarily store the second dummy data DD2 outputted by the line memory 266 and output the second dummy data DD2 stored during odd numbered horizontal periods.

In one aspect of the present invention, the MUX 264 may shift m digital video data signals outputted by the pixel data aligner 262 toward a successive one of the output data buses and output the shifted digital video data signals during odd numbered horizontal periods in response to an odd/even horizontal period indication signal OESW while outputting the last bus data, delayed by the register 263, and output the second dummy data DD2 via the first output data bus. Data outputted by the MUX 264 during odd numbered horizontal periods is shown in FIG. 23B and FIG. 24B. Further, the MUX 264 may output m digital video data and the first dummy data DD1 outputted by the line memory 266 in-situ during even numbered horizontal periods. Data outputted by the MUX 264 during even numbered horizontal periods is shown in FIG. 23A and FIG. 24A.

Using the gate start pulse (GSP), gate shift clock (GSC), and a gate output enable signal (GOE) generated by the timing controller 258, the gate driver 254 may sequentially apply a scanning pulse to the gate lines GL1 to GLn. The scanning pulse sequentially turns on horizontal lines of the TFTs 251 such that data signals may be applied to the TFTs 251 turned on within each sequentially selected horizontal line. The gate driver 254 may, for example, include a shift register for sequentially generating a scanning pulse and a level shifter for shifting a voltage swing width of the scanning pulse such that the voltage swing width is suitable for driving a liquid crystal cell Clc.

The data driver 256 may be configured in a substantially identical manner as the data driver illustrated in FIG. 10. Accordingly, the data driver 256 may apply m digital video data signals (RGB) outputted by timing controller 258 to the 2nd to (m+1)th data lines DL2 to DLm+1 during odd numbered horizontal periods while applying the second dummy data DD1 to the 1st data line DL1 using the data control signal (DDC) outputted from the timing controller 258. During even numbered horizontal periods, the data driver 256 may apply m digital video data (RGB) outputted by the timing controller 258 to the 1st to mth data lines DL1 to DLm while applying the first dummy data DD1 to the (m+1)th data line DLm+1.

In one aspect of the present invention, the data driver 216 may convert m digital video data signals (RGB) in addition to dummy data DD1 and DD2 into positive gamma compensation voltages or negative gamma compensation voltages. Accordingly, the data driver 256 may convert the digital video data signals (RGB) and dummy data DD1 and DD2 into various analog pixel voltages. Polarities of the pixel voltages applied to adjacent data lines, converted into the various analog pixel voltages by the gamma compensation voltages, are inverted along the horizontal direction similar to the column inversion system. Accordingly, positive gamma compensation voltages and negative gamma voltages may be alternately applied to successively arranged data lines.

The polarities of the (m+1) pixel voltages are inverted by the column inversion system by means of the data driver 256 and are synchronized with the scanning pulse sequentially applied to n gate lines GL1 to GLn every horizontal period.

Figure 27A:
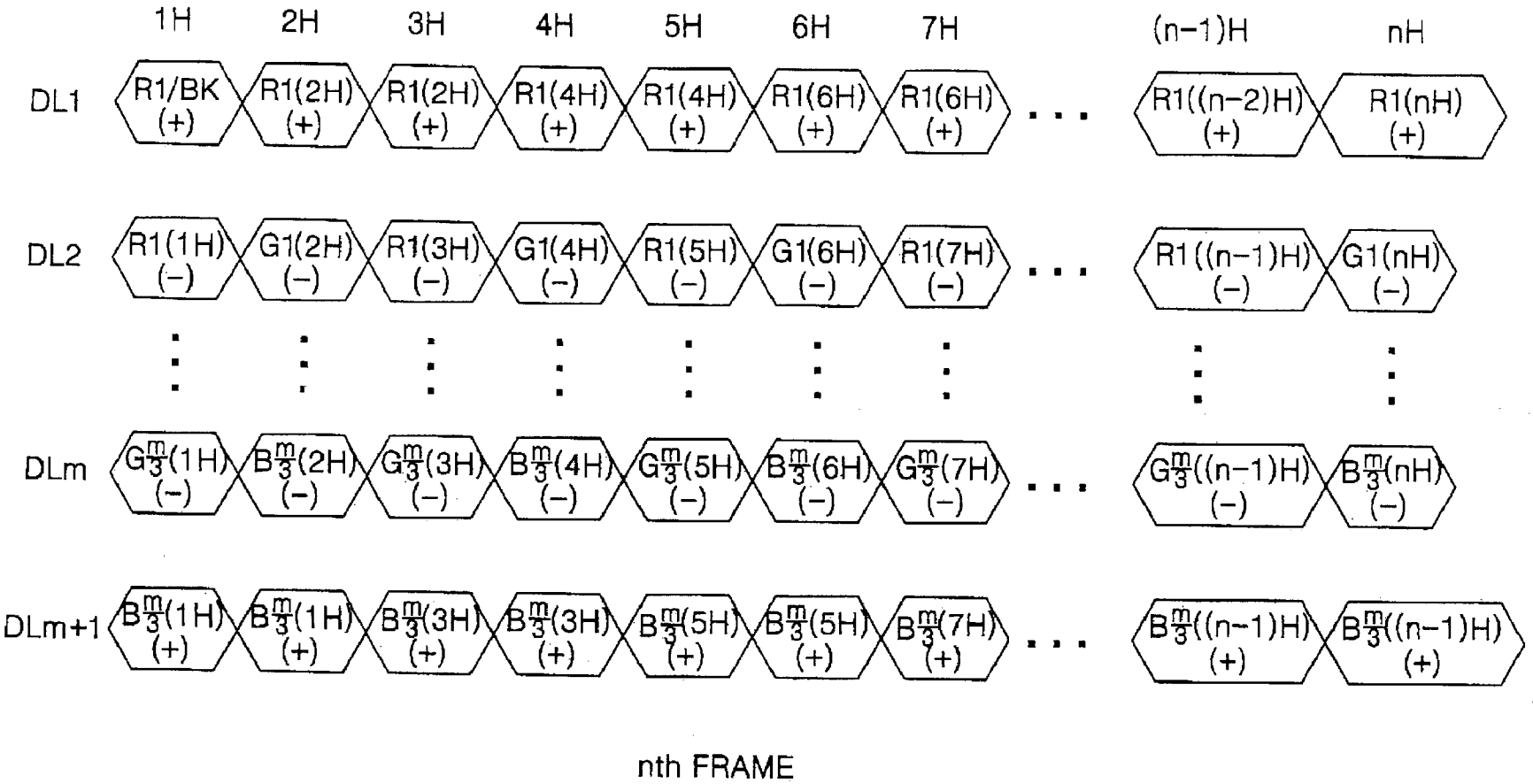
FIGS. 27A and 27B illustrate waveform diagrams of data applied to the liquid crystal display panel shown in FIG. 26.
Figure 27B:
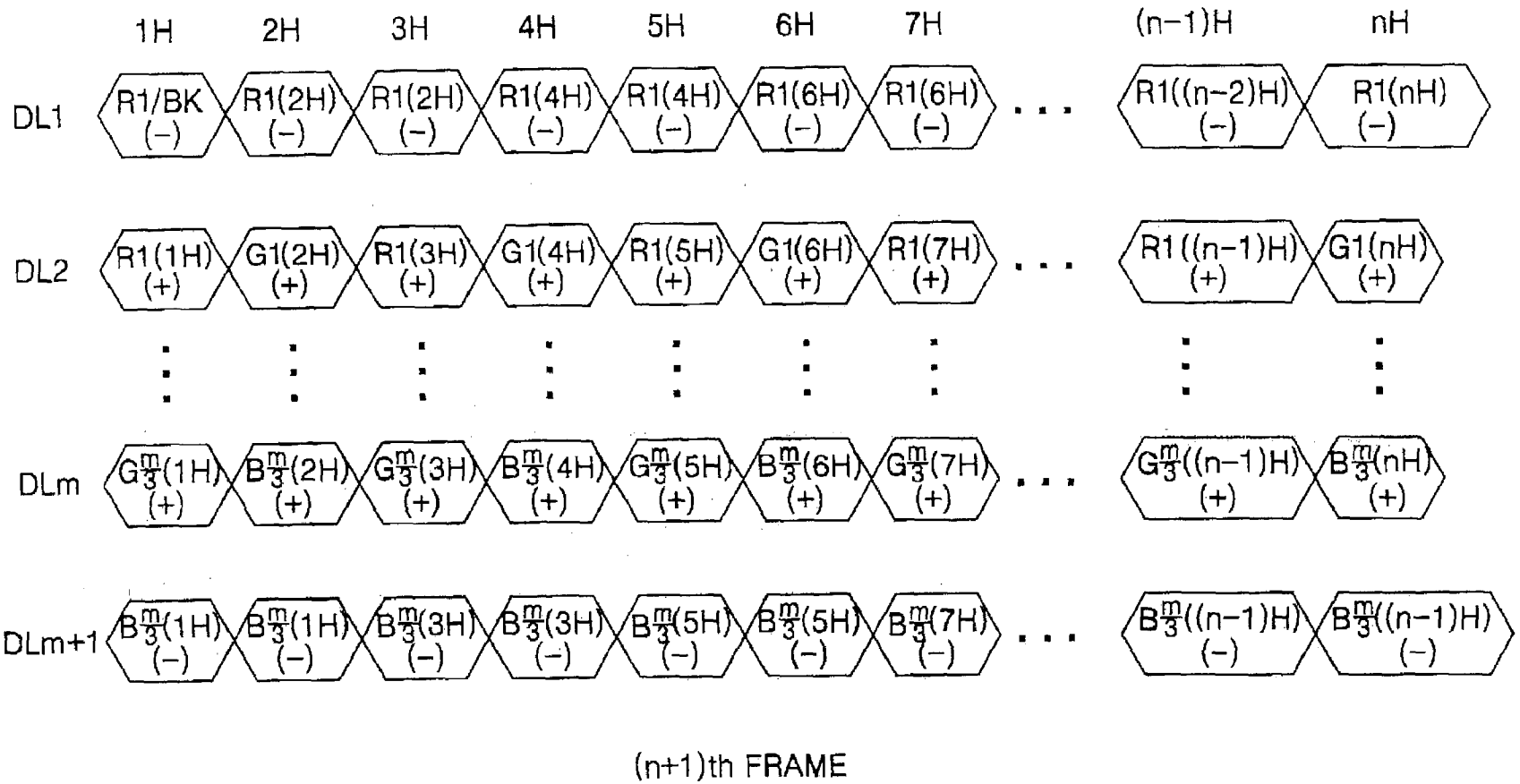

FIGS. 27A and 27B illustrate waveform diagrams of data applied to data lines DL1 to DLm+1 of the liquid crystal display panel 252 shown in FIG. 26 during the nth and the (n+1)th frame intervals.

Referring to FIG. 27A, during odd numbered horizontal periods 1H, 3H, . . . , (n−1)H in the nth frame, red, green, and blue pixel voltages R1(1H), G1(1H), . . . , Bm/3(1H), R1(3H), G1(3H), . . . , Bm/3(3H), and R1((n−1)H), G1((n−1)H), . . . , Bm/3((n−1)H) may be applied to the 2nd to (m+1)th data lines DL2 to DLm+1 while the first red pixel voltages R1(2H), R1(4H), . . . , R1((n−2)H) at the pre-stage may be applied to the 1st data line DL1. In one aspect of the present invention, the pre-stage red pixel voltages R1(2H), R1(4H), . . . , R1((n−2)H) applied to the 1st data line DL1 comprise pixel voltages reproduced by a delay of the blue pixel voltages R1(2H), R1(4H), . . . , R1((n−2)H) applied to the 1st data line DL at the pre-stage. During the first horizontal period 1H, a pixel voltage applied to the 1st data line DL1 may comprise a voltage wherein the first red pixel voltage R1 applied during the last horizontal period nH of the previous frame (e.g., the (n−1)th frame) has been reproduced under control of the timing controller 258, or a blank data voltage BK. During even numbered horizontal periods 2H, 4H, . . . , nH in the nth frame, red, green, and blue pixel voltages R1(2H), G1(2H), . . . , Bm/3(2H), R1(4H), G1(4H), . . . , Bm/3(4H), . . . , R1(nH), G1(nH), . . . , Bm/3(nH) may be applied to the 1st to mth data lines DL1 to DLm while the mth blue pixel voltages Bm/3(1H), Bm/3(3H), . . . , Bm/3((n−1)H) at the pre-stage may be applied to the (m+1)th data line DLm+1. In one aspect of the present invention, the blue pixel voltages Bm/3(1H), Bm/3(3H), . . . , Bm/3((n−1)H) at the pre-stage applied to the (m+1)th data line DLm+1 comprise pixel voltages wherein the last blue pixel voltages Bm/3(1H), Bm/3(3H), . . . , Bm/3((n−1)H) applied to the (m+1)th data line DLm+1 in the previous horizontal period have been reproduced. In one aspect of the present invention, a positive pixel voltage may be applied to the odd data lines DL1, DL3, DL5, . . . , DLm−1, DLm+1 while a negative pixel voltage may be applied to the even data lines DL2, DL4, DL6, . . . , DLm−2, DLm in the nth frame interval. In another aspect of the present invention, a polarity of the pixel voltages applied to each data line DL1 to DLm+1 may be inverted in transitioning to the (n+1)th frame, as shown in FIG. 27B.

Referring to FIG. 27B, during odd numbered horizontal periods 1H, 3H, . . . , (n−1)H in the (n+1)th frame, red, green, and blue pixel voltages R1(1H), G1(1H), . . . , Bm/3(1H), R1(3H), G1(3H), . . . , Bm/3(3H), and R1((n−1)H), G1((n−1)H), . . . , Bm/3((n−1)H) may be applied to the 2nd to (m+1)th data lines DL2 to DLm+1 while the first red pixel voltages R1(2H), R1(4H), . . . , R1((n−2)H) at the pre-stage may be applied to the 1st data line DL1. In one aspect of the present invention, a pixel voltage applied to the 1st data line DL1 in the first horizontal period 1H may comprise a voltage wherein the first red pixel voltage R1 applied in the last horizontal period nH of the nth frame has been reproduced under control of the timing controller 258, or a blank data voltage BK. During even numbered horizontal periods 2H, 4H, . . . , nH in the (n+1)th frame, red, green, and blue pixel voltages R1(2H), G1(2H), . . . , Bm/3(2H), R1(4H), G1(4H), . . . , Bm/3(4H), . . . , R1(nH), G1(nH), Bm/3(nH) may be applied to the 1st to mth data lines DL1 to DLm while the last blue pixel voltages Bm/3(1H), Bm/3(3H), . . . , Bm/3((n−1)H) at the pre-stage may be applied to the (m+1)th data line DLm+1. In one aspect of the present invention, a negative pixel voltage may be applied to the odd data lines DL1, DL3, DL5, . . . , DLm−1, and DLm+1 while a positive pixel voltage may be applied to the even data lines DL2, DL4, DL6, . . . , DLm−2, and DLm in the (n+1)th frame interval.

According to the principles of invention described above, consecutive ones of TFTs arranged within a column of liquid crystal cells may be alternately connected to two adjacent data lines. Further, polarities of pixel voltages applied to data lines may be controlled according to a column inversion system while a liquid crystal display panel, of which the data lines are a part, may be driven according to a dot inversion system. Accordingly, flicker between adjacent horizontal and vertical lines of liquid crystal cells within the liquid crystal display panel may be minimized while the amount of power the LCD consumes can be reduced, compared to the amount of power LCDs including dot inversion driven data driver consume. Furthermore, reproduced data, obtained by reproducing adjacent data, rather than blank data, may be applied to the first or last of successively arranged data lines arranged on the liquid crystal display panel such that a voltage swing width at the first or last data line may be reduced and a load variation of the first or last data lines may be minimized, thereby lowering power consumption of the LCD even further.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display, comprising:

generating dummy data by reproducing a portion of an inputted image data;

applying a scanning pulse to gate lines of a liquid crystal display panel comprising successively arranged data lines crossing the gate lines and thin film transistors arranged at the crossings of the data and gate lines, wherein consecutive ones of thin film transistors arranged within a column defined by two adjacent data lines on opposite sides of the column are alternately connected to the two adjacent data lines; and applying the inputted image data and the dummy data to the data lines of the liquid crystal display panel in synchrony with the scanning pulse; wherein the dummy data is applied to a different data line with each scanning pulse.

2. The method according to claim 1, wherein the generating further comprises:

detecting a last portion of the inputted data included within a first data interval;

generating a first dummy data using the last portion of the inputted data;

outputting the inputted data included within the first data interval and the first dummy data via an assigned output data bus;

detecting a first portion of the inputted data included within a second data interval following the first data interval;

generating a second dummy data using the first portion of the inputted data; and delaying the inputted data included within the second data interval and inputted via a specific input data bus.

3. The method according to claim 1, wherein the generating the dummy data further comprises:

detecting a first portion of inputted data included within a first data interval;

generating a first dummy data using the first portion of the inputted data;

outputting the inputted data included within the first data interval and the first dummy data via an assigned output data bus;

detecting a last portion of the inputted data included within a second data interval following the first data interval;

generating a second dummy data using the last portion of the inputted data; and delaying the inputted data included within the second data interval and inputted via a specific input data bus.

4. The method according to claim 1, wherein the generating the dummy data comprises:

detecting a last portion of the inputted data included within a first data interval;

generating a first dummy data by delaying the last portion of the inputted data by one horizontal period;

outputting inputted data included within a second data interval, following the first data interval, and the first dummy data via an assigned output data bus;

detecting a first portion of the inputted data included within the second data interval;

generating a second dummy data by delaying the first portion of the inputted data by one horizontal period;

delaying the inputted data included within a third data interval, following the second data interval, inputted via a specific input data bus.

5. The method according to claim 1, wherein the generating the dummy data comprises:

detecting a first portion of the inputted data included within a first data interval;

generating a first dummy data by delaying the first portion of the inputted data by one horizontal period;

outputting inputted data included within a second data interval, following the first data interval, and the first dummy data via an assigned output data bus;

detecting a last portion of the inputted data included within the second data interval;

delaying the last portion of the inputted data by one horizontal period to generate a second dummy data;

delaying the inputted data included within a third data interval, following the second data interval, inputted via a specific input data bus.

6. The method according to claim 1, wherein the applying the data comprises:

applying a first dummy data to the last one of the successively arranged data lines while applying the inputted data included within a first data interval to data lines other than the last one of the successively arranged data lines; and applying a second dummy data to the first one of the successively arranged data lines while applying the inputted data included within a second data interval, following the first data interval, to data lines other than the first one of the successively arranged data lines.

7. The method according to claim 1, wherein the applying the data comprises:

applying a first dummy data to the first one of the successively arranged data lines while applying the inputted data included within a first data interval to data lines other than the first one of the successively arranged data lines; and applying a second dummy data to the last one of the successively arranged data lines while applying the inputted data included within a second data interval, following the first data interval, to data lines other than the last one of the successively arranged data lines.

8. The method according to claim 1, wherein applying the data comprises:

applying a first dummy data to the first one of the successively arranged data lines while applying the inputted data included within a second data interval to data lines other than the first one of the successively arranged data lines; and applying a second dummy data to the last one of the successively arranged data lines while applying the inputted data included within a third data interval, following the second data interval, to data lines other than the last one of the successively arranged data lines.

9. The method according to claim 1, wherein the applying the data comprises:

applying a first dummy data to the last one of the successively arranged data lines while applying the inputted data included within a second data interval to data lines other than the last one of the successively arranged data lines; and applying a second dummy data to the first one of the successively arranged data lines while applying the inputted data included within a third data interval, following the second data interval, to data lines other than the first one of the successively arranged data lines.

10. The method according to claim 1, wherein polarities of voltages applied to adjacent ones of the successively arranged data lines are inverted.

11. The method according to claim 1, wherein polarities of voltages applied to the successively arranged data lines are maintained during one frame.

12. The method according to claim 1, wherein polarities of voltages applied to the successively arranged data lines are inverted every frame.

13. A driving apparatus for a liquid crystal display, comprising:

a dummy data generator for reproducing a portion of an inputted image data and for generating dummy data;

a liquid crystal display panel comprising successively arranged data lines crossing gate lines and thin film transistors arranged at the crossings of the data and gate lines, wherein consecutive ones of thin film transistors arranged within a column defined by two adjacent data lines on opposite sides of the column are alternately connected to the two adjacent data lines;

a gate driver for applying a scanning pulse to the gate lines; and a data driver for applying the inputted image data and the dummy data to the data lines in synchrony with the scanning pulse; wherein the dummy data is applied to a different data line with each scanning pulse.

14. The driving apparatus according to claim 13, wherein the dummy data generator:

outputs a first dummy data generated using a last portion of the inputted data included within a first data interval and the inputted data included within the first data interval via an assigned output data bus;

delays the inputted data included within a second data interval, following the first data interval, inputted via a specific input data bus; and outputs a second dummy data, generated using a first portion of the inputted data included within the second data interval, and the delayed inputted data via a specific output data bus.

15. The driving apparatus according to claim 14, wherein the dummy data generator comprises:

a latch for delaying the inputted data for generating the first and second dummy data;

a register for temporarily storing data outputted from the latch and inputted data inputted via the specific input data bus;

a selector for selecting the inputted data from an input line and the temporarily stored data from the register; and a controller for controlling the selector for each horizontal period.

16. The driving apparatus according to claim 13, wherein the dummy data generator:

outputs a first dummy data generated using a first portion of the inputted included within a first data interval and the inputted data included within the first data interval via an assigned output data bus;

delays the inputted data included within a second data interval, following the first data interval, inputted via a specific input data bus; and outputs a second dummy data, generated using a last portion of the inputted data included within the second data interval, and the delayed inputted data via a specific output data bus.

17. The driving apparatus according to claim 16, wherein the dummy data generator comprises:

a latch for delaying the inputted data for generating the first and second dummy data;

a register for temporarily storing data outputted from the latch and inputted data inputted via the specific input data bus;

a selector for selecting the inputted data from an input line and the temporarily stored data from the register; and a controller for controlling the selector for each horizontal period.

18. The driving apparatus according to claim 13, wherein the dummy data generator:

outputs a first dummy data, generated by delaying a last portion of the inputted data included within a first data interval for one horizontal period, and the inputted data included within a second data interval, following the first data interval, via an assigned output data bus;

delays the inputted data included within a third data interval, following the second data interval, inputted via a specific input data bus;

outputs a second dummy data, generated by delaying a first portion of the inputted data included within the second data interval by one horizontal period, and the delayed inputted data via a specific output data bus.

19. The driving apparatus according to claim 18, wherein the dummy data generator comprises:

a line memory for delaying the inputted data for one horizontal period for generating the first and second dummy data;

a register for temporarily storing data outputted from the line memory and data inputted via the specific input data bus;

a selector for selecting the inputted data from an input line and the temporarily stored data from the register; and a controller for controlling the selector for each horizontal period.

20. The driving apparatus according to claim 13, wherein the dummy data generator:

outputs a first dummy data, generated by delaying a first portion of the inputted data included within a first data interval by one horizontal period, and the inputted data included within a second data interval, following the first data interval, via an assigned output data bus;

delays the inputted data included within a third data interval, following the second data interval, inputted via a specific input data bus;

outputs a second dummy data, generated by delaying a last portion of the inputted data included within the second data interval by one horizontal period, and the delayed inputted data via a specific output data bus.

21. The driving apparatus according to claim 20, wherein the dummy data generator comprises:

a line memory for delaying the inputted data for one horizontal period for generating the first and second dummy data;

a register for temporarily storing data outputted from the line memory and data inputted via the specific input data bus;

a selector for selecting the inputted data from an input line and the temporarily stored data from the register; and a controller for controlling the selector for each horizontal period.

22. The driving apparatus according to claim 13, wherein said data driver:

applies a first dummy data to the last one of the successively arranged data lines while applying the inputted data included within a first data interval to data lines other than the last one of the successively arranged data lines; and a second dummy data to the first one of the successively arranged data lines while applying the inputted data included within a second data interval, following the first data interval, to data lines other than the first one of the successively arranged data lines.

23. The driving apparatus according to claim 13, wherein data driver:

applies a first dummy data to the first one of the successively arranged data lines while applying the inputted data included within a first data interval to data lines other than the first one of the successively arranged data lines; and applies a second dummy data to the last one of the successively arranged data lines while applying the inputted data included within a second data interval, following the first data interval, to data lines other than the last one of the successively arranged data lines.

24. The driving apparatus according to claim 13, wherein data driver:

applies a first dummy data to the first one of the successively arranged data lines while applying the inputted data included within a second data interval to data lines other than the first one of the successively arranged data lines; and applies a second dummy data to the last one of the successively arranged data lines while applying the inputted data included within a third data interval, following the second data interval, to data lines other than the last one of the successively arranged data lines.

25. The driving apparatus according to claim 13, wherein data driver:

applies a first dummy data to the last one of the successively arranged data lines while applying the inputted data included within a second data interval to data lines other than the last one of the successively arranged data lines; and applies a second dummy data to the first one of the successively arranged data lines while applying the inputted data included within a third data interval, following the second data interval, to data lines other than the first one of the successively arranged data lines.

26. The driving apparatus according to claim 13, wherein polarities of voltages applied to adjacent ones of the successively arranged data lines are inverted.

27. The driving apparatus according to claim 13, wherein polarities of voltages applied to the successively arranged data lines are maintained during one frame.

28. The driving apparatus according to claim 13, wherein polarities of voltages applied to the successively arranged data lines are inverted every frame.

* * * * *